US005667958A

United States Patent [19]

Hioki et al.

[11] Patent Number: 5,667,958

[45] Date of Patent: Sep. 16, 1997

[54] SILVER HALIDE PHOTOGRAPHIC MATERIAL

[75] Inventors: Takanori Hioki; Tadashi Ikeda, both of Kanagawa, Japan

[73] Assignee: Fuji Photo Film Co., Ltd., Kanagawa, Japan

[21] Appl. No.: 677,686

[22] Filed: Jul. 8, 1996

Related U.S. Application Data

[62] Division of Ser. No. 557,493, Nov. 14, 1995, Pat. No. 5,578,440.

[30] Foreign Application Priority Data

Nov. 15, 1994 [JP] Japan ..... 6-305628
Dec. 27, 1994 [JP] Japan ..... 6-337014

[51] Int. Cl.[6] ..... G03C 1/09; G03C 1/12

[52] U.S. Cl. ..... 430/604; 430/603; 430/605; 430/611; 430/612; 430/581

[58] Field of Search ..... 430/603, 604, 430/605, 611, 612, 581

[56] References Cited

U.S. PATENT DOCUMENTS

| | | | |
|---|---|---|---|
| 3,718,470 | 2/1973 | Spence et al. | 430/581 |
| 4,702,999 | 10/1987 | Ohashi et al. | 430/611 |
| 4,719,174 | 1/1988 | Hirano et al. | 430/612 |
| 4,737,452 | 4/1988 | Kameoka et al. | 430/603 |
| 4,800,154 | 1/1989 | Okazaki et al. | 430/581 |
| 5,368,999 | 11/1994 | Makino | 430/603 |
| 5,457,022 | 10/1995 | Hioki et al. | 430/604 |
| 5,578,440 | 11/1996 | Hioki et al. | 430/581 |

*Primary Examiner*—Mark F. Huff
*Attorney, Agent, or Firm*—Sughrue, Mion, Zinn, Macpeak & Seas

[57] ABSTRACT

A silver halide photographic material having high sensitivity, reduced in fog and excellent in storage stability is described, which comprises a support having thereon at least one constituent layer containing at least one hydrazone compound having a methine dye residue or an adsorbing group to silver halide through a covalent bond or containing at least one metallocene compound having a methine dye residue through a covalent bond.

8 Claims, No Drawings

SILVER HALIDE PHOTOGRAPHIC MATERIAL

This is a divisional of application Ser. No. 08/557,493 filed Nov. 14, 1995, now U.S. Pat. No. 5,578,440.

FIELD OF THE INVENTION

The present invention relates to a silver halide photographic material, more specifically, it relates to a high-sensitivity silver halide photographic material reduced in fog and having excellent storage stability.

BACKGROUND OF THE INVENTION

A high-sensitivity silver halide light-sensitive material has been long desired. In particular, a silver halide light-sensitive material which is spectrally sensitized has been demanded to have high sensitivity.

The spectral sensitization is a very important and essential technique for producing a high-sensitivity light-sensitive material excellent in color reproduction. The spectral sensitizer has such a function that it absorbs light in a long wavelength region which the silver halide photographic emulsion does not substantially absorb by nature and transmits the absorbed light energy to silver halide. Therefore, it is advantageous for elevating the photographic sensitivity to use a spectral sensitizer which increases the captured light amount. Accordingly, a large number of attempts have been made to increase the addition amount of the spectral sensitizer to a silver halide emulsion to thereby increase the captured light amount. However, if the spectral sensitizer is added to a silver halide emulsion in excess of the optimal amount, the sensitivity is rather greatly reduced. This is generally called dye desensitization which is, more specifically, a phenomenon that the sensitivity in the light-sensitive region inherent to silver halide, where the sensitizing dye does not substantially absorb light, is reduced. If the dye desensitization is large, the overall sensitivity becomes low though the spectral sensitization effect is provided. In other words, if the dye desensitization is reduced, the sensitivity in light absorption region by the sensitizing dye (namely, spectral sensitization sensitivity) is increased in proportion. Accordingly, it is a matter of very importance in the spectral sensitization technology to improve the dye desensitization. The dye desensitization is commonly greater as the sensitizing dye has light sensitivity in the longer wavelength region. This is described in T. H. James, *The Theory of the Photographic Process*, pp. 265–268, Macmillan (1966).

JP-A-47-28916 (the term "JP-A" as used herein means an "unexamined published Japanese patent application"), JP-A-49-46738, JP-A-54-118236 and U.S. Pat. No. 4,011,083 describe methods for increasing the sensitivity while reducing the dye sensitization. However, according to the methods in these publications, the sensitizing dyes which can be used are restricted and the effect obtained is far from satisfaction. The most effective method for improving the dye desensitization known at present is the use in combination of a bisaminostilbene compound substituted by a pyrimidine derivative or a triazine derivative, which is described, for example, in JP-B-45-22189 (the term "JP-B" as used herein means an "examined Japanese patent publication"), JP-A-54-18726, JP-A-52-4822, JP-A-52-151026 and U.S. Pat. No. 2,945,762. However, the sensitizing dye for which the combination use of the above-described compound is effective is a so-called M-band sensitization-type dye which shows a gentle sensitization peak, such as dicarbocyanine, tricarbocyanine, rhodacyanine and merocyanine and the use is restricted to the dyes having a sensitization peak in a relatively long wavelength region.

U.S. Pat. No. 3,695,888 describes that the sensitization in an infrared region can be obtained by the combination of tricarbocyanine with an ascorbic acid, British Patent 1,255,084 describes that the minus blue sensitivity is elevated by the combination use of a specific dye with an ascorbic acid, British Patent 1,064,193 describes that the sensitivity can be increased by the combination use of a specific dye with an ascorbic acid and U.S. Pat. No. 3,809,561 describes a combination use of a desensitive nucleus-containing cyanine dye with a supersensitizer such as an ascorbic acid.

However, according to the above-described conventional techniques, the sensitization effect by the dye is still not yet satisfactory and if the sensitization effect is large, it is likely accompanied by the increase in fog.

It is also known, as described in T. Tani, et al., *Journal of the Physical Chemistry*, Vol. 94, p. 1298 (1990), that the sensitizing dye having a reduction potential higher than −1.25 V is low in the relative quantum yield of spectral sensitization. In order to increase the relative quantum yield of spectral sensitization of the dye, supersensitization by trapping positive holes has been proposed, for example, in the above-described *The Theory of the photographic Process*, pp. 259–265 (1966). However, more effective supersensitizer has been demanded.

In order to achieve high sensitivity of a silver halide photographic material, investigations have been made from the old to effect reduction sensitization. For example, U.S. Pat. No. 2,487,850 discloses a tin compound, U.S. Pat. No. 2,512,925 discloses a polyamine compound and British Patent 789,823 discloses a thiourea dioxide-based compound as effective reduction sensitizers. Further, *Photographic Science and Engineering*, Vol. 23, p. 113 (1979) sets forth comparison on the properties of silver nuclei formed by various reduction sensitization methods and methods using dimethylamineborane, stannous chloride, hydrazine, high pH ripening or low pAg ripening are employed. The reduction sensitization method is also described in U.S. Pat. Nos. 2,518,698, 3,201,254, 3,411,917, 3,779,777 and 3,930,867. JP-B-57-33572 and JP-B-58-1410 describe not only the selection of reduction sensitizers but also the design for reduction sensitization method.

However, according to the investigations by the present inventors, it is found that when a sensitizing dye is adsorbed to a silver halide grain having been subjected to reduction sensitization, the fog is increased. In order to prevent desorption (in particular, at a high humidity) of a sensitizing dye from a silver halide grain in the light-sensitive material, the sensitizing dye may be adsorbed at a high temperature (50° C. or higher) but this operation also causes deterioration with respect to the fog. Further, a sensitizing dye may be adsorbed before chemical sensitization so that high sensitivity can be achieved but this method also causes deterioration with respect to the fog.

SUMMARY OF THE INVENTION

A first object of the present invention is to provide a high-sensitivity silver halide photographic material reduced in fog.

A second object of the present invention is to provide a silver halide photographic material having high storage stability.

The above-described objects of the present invention have been achieved by:

(1) A silver halide photographic material comprising a support having thereon at least one silver halide emulsion layer, said silver halide photographic material containing at least one hydrazone compound having a methine dye residue or an adsorbing group to silver halide through a covalent bond.

The hydrazone is a condensation product of a carbonyl compound with hydrazine and includes aldehyde hydrazone and ketone hydrazone. The hydrazone compound of the present invention includes these two hyrazones, in which, however, both of two hydrogen atoms at the N-position are substituted.

(2) The silver halide photographic material described in item (1) above, wherein the hydrazone compound is preferably represented by the following formula (I) or (II):

Preferred hydrazone compound having a methine dye residue through a covalent bond:

$$(MET)_{k_{1a}}[(Q_1)_{k_{2a}}(Hyd_1)]_{k_{3a}} \quad (I)$$

Preferred hydrazone compound having an adsorbing group through a covalent bond:

$$(Het)_{k_{1b}}[(Q_2)_{k_{2b}}(Hyd_2)]_{k_{3b}} \quad (II)$$

wherein in formula (I), MET represents a methine dye residue, $Q_1$ represents a linking group comprising an atom or an atomic group containing at least one of carbon atom, nitrogen atom, sulfur atom and oxygen atom, $Hyd_1$ represents a group having a hydrazone structure represented by formula (III), $k_{1a}$ and $k_{3a}$ each represents an integer of from 1 to 4, $k_{2a}$ represents 0 or 1:

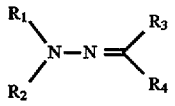

(III)

wherein $R_1$, $R_2$ and $R_3$ each represents an aliphatic group, an aryl group or a heterocyclic group and $R_4$ represents a hydrogen atom or has the same meaning as $R_3$; and in formula (II), Het is an adsorbing group to silver halide which contains a 5-, 6- or 7-membered heterocyclic ring which has at least one nitrogen atom and may have a hetero atom other than nitrogen, $Q_2$ represents a linking group comprising an atom or an atomic group containing at least one of carbon atom, nitrogen atom, sulfur atom and oxygen atom, $Hyd_2$ represents a group having a hydrazone structure represented by formula (III), $k_{1b}$ and $k_{3b}$ each represents an integer of from 1 to 4 and $k_{2b}$ represents 0 or 1;

(3) A silver halide photographic material comprising a support having thereon at least one silver halide emulsion layer, wherein at least one of the emulsion layers contains at least one hydrazone compound described in item (1) or (2) above and silver halide grains in the emulsion layers are subjected to reduction sensitization; and (4) The silver halide photographic material as described in item (1), (2) or (3) above, wherein the silver halide emulsion layer contains at least one compound represented by formula (XX), (XXI) or (XXII):

$$R_{101}—SO_2S—M_{101} \quad (XX)$$

$$R_{101}—SO_2S—R_{102} \quad (XXI)$$

$$R_{101}—SO_2S—(E)_a—SSO_2—R_{103} \quad (XXII)$$

wherein $R_{101}$, $R_{102}$ and $R_{103}$ each represents an aliphatic group, an aromatic group or a heterocyclic group, $M_{101}$ represents a cation, E represents a divalent linking group and a represents 0 or 1.

The above-described objects of the present invention have also been achieved by:

(5) A silver halide photographic material comprising a support having thereon at least one silver halide emulsion layer, said silver halide photographic material containing at least one metallocene compound having a methine dye residue through a covalent bond;

(6) The silver halide photographic material described in item (5) above, wherein the metallocene compound is preferably represented by formula (IA):

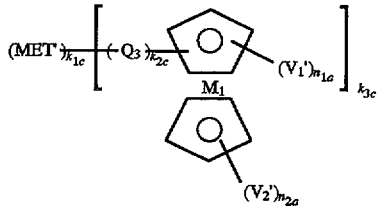

(IA)

wherein MET' represents a methine dye residue, $Q_3$ represents a linking group comprising an atom or atomic group containing at least one of carbon atom, nitrogen atom, sulfur atom and oxygen atom, $M_1$ represents Fe, Ti, V, Cr, Co, Ni, Ru, Os or Pd, $V_1'$ and $V_2'$ each represents a monovalent substituent, $n_{1a}$ represents 0 or an integer of from 1 to 4, $n_{2a}$ represents 0 or an integer of from 1 to 5, $k_{1c}$ represents an integer of from 1 to 4, $k_{3c}$ represents an integer of from 1 to 4 and $k_{2c}$ represents 0 or 1;

(7) A silver halide photographic material comprising a support having thereon at least one silver halide emulsion layer, wherein at least one of the emulsion layers contains at least one metallocene compound described in item (5) or (6) above and silver halide grains in the emulsion layers are subjected to reduction sensitization; and (8) The silver halide photographic material as described in item (5), (6) or (7) above, wherein the silver halide emulsion layer further contains at least one compound represented by the above-described formula (XX), (XXI) or (XXII).

DETAILED DESCRIPTION OF THE INVENTION

The present invention is described below in detail.

The methine dye residue, the group represented by MET in formula (I) and the group represented by MET' in formula (IA) each is a group having a cyanine structure formed by a nitrogen-containing heterocyclic ring called as a basic nucleus and another nitrogen-containing heterocyclic ring which are connected through a conjugated bond so as to conjugate with each other, a merocyanine structure formed of a heterocyclic ring called an acidic nucleus and a basic nucleus where a carbonyl group in the acidic nucleus and the nitrogen atom in the basic nucleus are connected through a conjugated double bond so as to conjugate with each other, a rhodacyanine structure having a combination of these structures, an oxonol structure, a hemicyanine structure, a styryl structure or a benzylidene structure.

Examples of the polymethine dye are described, for example, in T. H. James, *The Theory of the Photographic Process*, Chap. 8, Macmillan (1977), F. M. Hamer, *Heterocyclic Compounds— Cyanine Dyes and Related Compounds*, John Wiley & Sons, New York, London (1964), D. M. Sturmer, *Heterocyclic Compounds— Special Topics in Heterocyclic Chemistry—*, Chap. 18, Para. 14, pp. 482–515, John Wiley & Sons, New York, London (1977), *Rodd's Chemistry of Carbon Compounds*, 2nd. Ed., Vol. IV, Part B, Chap. 15, pp. 369–422, Elsvier Science Publishing Company Inc., New York (1977) and *Rodd's Chemistry of Carbon Compounds*, 2nd. Ed., Vol. IV, Part B, Chap. 15, pp. 267–296, Elsvier Science Publishing Company Inc., New York (1985).

The cyanine structure, the merocyanine structure, the rhodacyanine structure and the allopolar dye structure which are preferably used as MET or MET' in the present invention are represented by formula (IV), formula (V), formula (VI) and formula (VII), respectively:

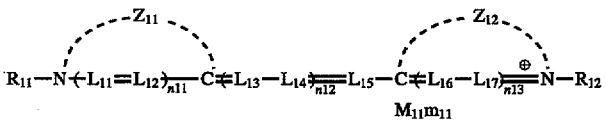

(IV)

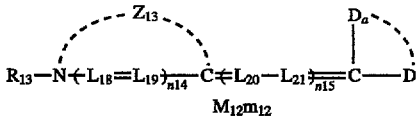

(V)

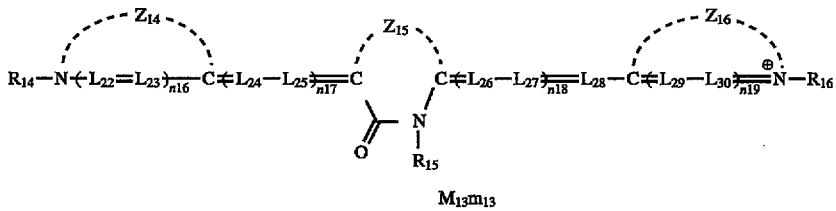

(VI)

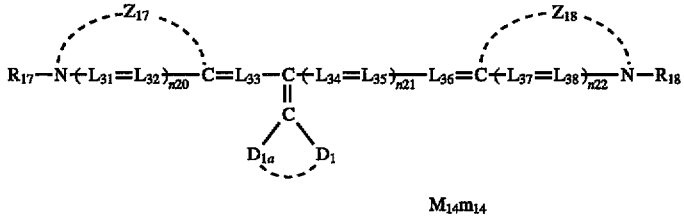

(VII)

wherein $Z_{11}$, $Z_{12}$, $Z_{13}$, $Z_{14}$, $Z_{15}$, $Z_{16}$, $Z_{17}$ and $Z_{18}$ each represents an atomic group necessary for forming a 5- or 6-membered nitrogen-containing heterocyclic ring;

D, $D_a$, $D_1$ and $D_{1a}$ each represents an atomic group necessary for forming an acyclic or cyclic acidic nucleus;

$R_{11}$, $R_{12}$, $R_{13}$, $R_{14}$, $R_{16}$, $R_{17}$ and $R_{18}$ each represents an alkyl group;

R . represents an alkyl group, an aryl group or a heterocyclic group;

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$ and $L_{38}$ each represents a methine group;

$M_{11}$, $M_{12}$, $M_{13}$ and $M_{14}$ each represents a charge-neutralizing counter ion;

$m_{11}$, $m_{12}$, $m_{13}$ and $m_{14}$ each represents a number of from 0 to 5 necessary for neutralizing the charge within the molecule;

$n_{11}$, $n_{13}$, $n_{14}$, $n_{16}$, $n_{19}$, $n_{20}$, $n_{21}$ and $n_{22}$ each represents 0 or 1; and $n_{12}$, $n_{15}$, $n_{17}$ and $n_{18}$ each represents 0 or an integer of from 1 to 4.

Among these, preferred are dye structures represented by formula (IV) and (VII), more preferred is a dye structure represented by formula (VII).

Formulae (IV), (V), (VI) and (VII) are described below in greater detail.

$R_{11}$, $R_{12}$, $R_{13}$, $R_{14}$, $R_{16}$, $R_{17}$ and $R_{18}$ each is preferably an unsubstituted alkyl group having from 1 to 18, more preferably from 1 to 7, particularly preferably from 1 to 4 carbon atoms (e.g., methyl, ethyl, propyl, butyl, pentyl, octyl, decyl, dodecyl, octadecyl), a substituted alkyl group having from 1 to 18, more preferably 1 to 7 carbon atoms {an alkyl group substituted, for example, by a carboxy group, a sulfo group, a cyano group, a halogen atom (e.g., fluorine, chlorine, bromine), a hydroxy group, an alkoxycarbonyl group having from 1 to 8 carbon atoms (e.g., methoxycarbonyl, ethoxycarbonyl, phenoxycarbonyl, benzyloxycarbonyl), an alkoxy group having from 1 to 8 carbon atoms (e.g., methoxy, ethoxy, benzyloxy, phenethyloxy), a monocyclic aryloxy group having from 6 to 10 carbon atoms (e.g., phenoxy, p-tolyloxy), an acyloxy group having from 1 to 3 carbon atoms (e.g., acetyloxy, propionyloxy), an acyl group having from 1 to 8 carbon atoms (e.g., acetyl, propionyl, benzoyl, mesyl), a carbamoyl group having from 1 to 8 carbon atoms (e.g., carbamoyl, N,N-dimethylcarbamoyl, morpholinocarbonyl, piperidinocarbonyl), a sulfamoyl group having from 1 to 8 carbon atoms (e.g., sulfamoyl, N,N-dimethylsulfamoyl, morpholinosulfonyl, piperidinosulfonyl) or an aryl group having from 6 to 10 carbon atoms (e.g., phenyl, 4-chlorophenyl, 4-methylphenyl, α-naphthyl)} or a substituted or unsubstituted alkenyl group having from 3 to 10 carbon atoms (e.g., 3-methoxy-2-propenyl, allyl); more preferably an unsubstituted alkyl group having from 1 to 4 carbon atoms (e.g., methyl, ethyl, n-propyl, n-butyl, n-pentyl, n-hexyl), a carboxyalkyl group having from 1 to 5 carbon atoms (e.g., 2-carboxyethyl, carboxymethyl), a sulfoalkyl group (e.g., 2-sulfoethyl, 3-sulfopropyl, 4-sulfobutyl, 3-sulfobutyl) or a methanesulfonylcarbamoylmethyl group; and particularly preferably a sulfoalkyl group.

$M_{11}m_{11}$, $M_{12}m_{12}$, $M_{13}m_{13}$ and $M_{14}m_{14}$ each is included in the formulae so as to show the presence or absence of a cation or anion when it is necessary for neutralizing the ion charge of the dye. Whether a certain dye is a cation or an anion or whether the dye has a net ion charge or not depends on its auxochrome or substituent. Typical examples of the cation include an inorganic or organic ammonium ion (e.g., ammonium ion, tetraalkylammonium ion, pyridinium ion), an alkali metal ion (e.g., sodium ion, potassium ion) and an alkaline earth metal ion (e.g., calcium ion). The anion may be either an inorganic anion or an organic anion and specific examples thereof include a halogen anion (e.g., fluorine ion, chlorine ion, bromine ion, iodine ion), a substituted arylsulfonic acid ion (e.g., p-toluenesulfonic acid ion, p-chlorobenzenesulfonic acid ion), an aryldisulfonic acid ion (e.g., 1,3-benzenedisulfonic acid ion, 1,5-naphthalenedisulfonic acid ion, 2,6-naphthalenedisulfonic acid ion), an alkylsulfuric acid ion (e.g., methylsulfuric acid ion, ethylsulfuric acid ion), a sulfuric acid ion, a thiocyanic acid ion, a perchloric acid ion, a tetrafluoroboric acid ion, a picric acid ion, an acetic acid ion and a trifluoromethansulfonic acid ion.

In addition, an ionic polymer or other dye having a reverse charge to the dye may be used as a charge-neutralizing counter ion or a metal complex ion may also be used.

Among these, preferred are an ammonium ion, an iodine ion and a p-toluenesulfonic acid ion.

$m_{11}$, $m_{12}$, $m_{13}$ and $m_{14}$ each is preferably 0, 1 or 2.

Examples of the nucleus formed by $Z_{11}$, $Z_{12}$, $Z_{13}$, $Z_{14}$, $Z_{16}$, $Z_{17}$ or $Z_{18}$ include a thiazole nucleus {for example, a thiazole nucleus (e.g., thiazole, 4-methylthiazole, 4-phenylthiazole, 4,5-dimethylthiazole, 4,5-diphenylthiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylthiobenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 6-methylthiobenzothiazole, 5-ethoxybenzothiazole, 5-ethoxy-carbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethylthiobenzothiazole, 5,6-dimethoxybenzothiazole, 5-hydroxy-6-methylbenzothiazole, tetrahydrobenzothiazole, 4-phenylbenzothiazole) and a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole)}, a thiazoline nucleus (for example, thiazoline, 4-methylthiazoline and 4-nitrothiazoline), an oxazole nucleus {for example, an oxazole nucleus (e.g., oxazole, 4-methyloxazole, 4-nitrooxazole, 5-methyloxazole, 4-phenyloxazole, 4,5-diphenyloxazole, 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethyl-benzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazol), and a naphthoxazole nucleus (for example, naphth[2,1-d]oxazole, naphth[1,2-d]oxazole, naphth[2,3-d]oxazole, 5-nitronaphth[2,1-d]oxazole)}, an oxazoline nucleus (for example, 4,4-dimethyloxazoline), a selenazole nucleus {for example, a selenazol nucleus (e.g., 4-methylselenazole, 4-nitroselenazole, 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), a naphthoselenazole nucleus (e.g., naphtho[2,1-d]selenazole, naphtho[1,2-d]selenazole)}, a selenazoline nucleus (e.g., selenazoline, 4-methylselenazoline), a tellurazole nucleus {for example, a tellurazole nucleus (e.g., tellurazole, 4-methyltellurazole, 4-phenyltellurazole), a benzotellurazole nucleus (e.g., benzotellurazole, 5-chlorobenzotellurazole, 5-methylbenzotellurazole, 5,6-dimethylbenzotellurazole, 6-methoxybenzotellurazole), a naphthotellurazole nucleus (e.g., naphtho[2,1-d]tellurazole, naphtho[1,2-d]tellurazole)}, a tellurazoline nucleus (for example, tellurazoline, 4-methyltellurazoline), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine), an imidazole nucleus {for example, an imidazole nucleus (e.g., 1-alkylimidazole, 1-alkyl-4-phenylimidazole, 1-arylimidazole), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole), a naphthoimidazole nucleus (for example, alkylnaphto[1,2-d]imidazole, 1-arylnaphtho[1,2-d]imidazole); the alkyl group is preferably an alkyl group having from 1 to 8 carbon atoms such as an unsubstituted alkyl group (e.g., methyl, ethyl, propyl, isopropyl, butyl) or a hydroxyalkyl group (e.g., 2-hydroxyethyl, 3-hydroxypropyl), more preferably an ethyl group or an ethyl group; the aryl group is a phenyl group, a halogen(e.g., chloro)-substituted phenyl group, an alkyl (e.g., methyl)-substituted phenyl group or an alkoxy(e.g., methoxy)-substituted phenyl group}, a pyridine nucleus (for example, 2-pyridine, 4-pyridine, 5-methyl-2-pyridine, 3-methyl-4-pyridine), a quinoline nucleus {for example, a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoine, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline), an isoquinoline nucleus (e.g., 6-nitro-1-isoquinoline, 3,4-dihydro-1-isoquinoline, 6-nitro-3-isoquinoline)}, an imidazo[4,5-b]quinoxaline nucleus (for example, 1,3-diethylimidazo[4,5-b]quinoxaline, 6-chloro-1,3-diallylimidazo[4,5-b]quinoxaline), an oxadiazole nucleus, a thiazole nucleus, a tetrazole nucleus and a pyrimidine nucleus.

The nucleus formed by $Z_{11}$, $Z_{12}$, $Z_{13}$, $Z_{14}$, $Z_{16}$, $Z_{17}$ or $Z_{18}$ is preferably a benzothiazole nucleus, a naphthothiazole nucleus, a benzoxazole nucleus, a naphthoxazole nucleus, a benzimidazole nucleus, a 2-quinoline nucleus or a 4-quinoline nucleus. The nucleus formed by $Z_{17}$ or $Z_{18}$ is more preferably a naphto[1,2-d]thiazole nucleus.

D and $D_a$ or $D_1$ and $D_{1a}$ each represents an atomic group necessary for forming an acidic nucleus and an acidic nucleus of any common merocyanine dye may be formed. The term "acidic nucleus" as used herein means an acidic nucleus defined, for example, in James, *The Theory of the Photographic Process*, 4th Ed., Macmillan, p. 198 (1977). In a preferred embodiment, the substituent participating in the resonance of D or $D_1$ is, for example, a carbonyl group, a thiocarbonyl group, a cyano group, a sulfonyl group or a sulfenyl group. $D_a$ and $D_{1a}$ each represents the remaining atomic group necessary for forming an acidic nucleus.

Specific examples thereof include those described in U.S. Pat. Nos. 3,567,719, 3,575,869, 3,804,634, 3,837,862, 4,002,480 and 4,925,777 and JP-A-3-167546.

When the acidic nucleus is acyclic, the methine bond has a terminal group such as malononitrile, alkanesulfonylacetonitrile, cyanomethylbenzofuranyl ketone or cyanomethylphenyl ketone.

When it is cyclic, D and $D_a$ or $D_1$ and $D_{1a}$ form a 5- or 6-membered heterocyclic ring comprising carbon, nitrogen and chalcogen (typically, oxygen, sulfur, selenium or tellurium) atoms.

Preferred examples of the acidic nucleus include nuclei such as 2-pyrazoline-5-one, pyrazolidine-3,5-dione, imidazoline-5-one, hydantoin, 2-thiohydantoin, 4-thiohydantoin, 2-iminooxazolidine-4-one, 2-oxazoline-5-one, 2-thiooxazolidine-2,4-dione, isoxazoline-5-one, 2-thiazoline-4-one, thiazolidine-2,4-dione, rhodanine, thiazolidine-2,4-dithione, isorhodanine, indane-1,3-dione, thiophene-3-one-1, 1-dioxide, indoline-2-one, indoline-3-one, indazoline-3-one, 2-oxoindazolium, 3-oxoindazolium, 5,7-dioxo-6,7-dihydrothiazolo[3,2-a]pyrimidine, cyclohexane-1,3-dione, 3,4-dihydroisoquinoline-4-one, 1,3-dioxane-4,4-dione, barbituric acid, 2-thiobarbituric acid, chroman-2,4-dione, indazoline-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide and 3-dicyanomethine-2,3-dihydrobenzo[d]thiophene-1,1-dioxide. More preferred are 3-alkylrhodanine, 3-alkyl-2-thiooxazolidine-2,4-dione, 3-alkyl-2-thiohydantoinbarbituric acid and 2-thiobarbituric acid. The acidic nucleus formed by $D_1$ and $D_{1a}$ is most preferably a barbituric acid.

The substituent bonded to the nitrogen atom contained in the above-described acidic nucleus and $R_{15}$ each is a hydrogen atom, an alkyl group having from 1 to 18, preferably from 1 to 8, more preferably from 1 to 4 carbon atoms (e.g., methyl, ethyl, propyl, isopropyl, butyl, isobutyl, hexyl, octyl, dodecyl, octadecyl), an aryl group having from 6 to 18, preferably from 6 to 12 carbon atoms (e.g., phenyl, 2-naphthyl, 1-naphthyl) or a heterocyclic group having from 1 to 18, preferably from 6 to 12 carbon atoms (e.g., 2-pyridyl, 2-thiazolyl, 2-furyl). These substituents may further be substituted. Examples of the substituent include a carboxyl group, a sulfo group, a cyano group, a nitro group, a halogen atom (e.g., fluorine, chlorine, iodine, bromine), a hydroxy group, an alkoxy group having from 1 to 8 carbon atoms (e.g., methoxy, ethoxy, benzyloxy, phenethyloxy), an aryloxy group having from 6 to 15 carbon atoms (e.g., phenoxy), an acyloxy group having from 1 to 8 carbon atoms (e.g., acetyloxy), an alkoxycarbonyl group having from 2 to 8 carbon atoms, an acyl group having from 1 to 8 carbon atoms, a sulfamoyl group, a carbamoyl group, an alkanesulfonylaminocarbonyl group having from 2 to 8 carbon atoms (e.g., methanesulfonylaminocarbonyl), an acylaminosulfonyl group having from 1 to 8 carbon atoms (e.g., acetylaminosulfonyl), an aryl group having from 6 to 15 carbon atoms (e.g., phenyl, 4-methylphenyl, 4-chlorophenyl, naphthyl) and a heterocyclic group having from 4 to 15 carbon atoms (e.g., pyrrolidine-2-one-1-yl, tetrahydrofurfuryl, 2-morpholino), which may further be substituted by a substituent represented by V described below, such as a methyl group and a hydroxy group.

The substituent bonded to the nitrogen atom contained in the acidic nucleus and $R_{15}$ each is more preferably an unsubstituted alkyl group having from 1 to 5 carbon atoms (e.g., methyl, ethyl, n-propyl, n-butyl, n-pentyl), a carboxyalkyl group having from 2 to 5 carbon atoms (e.g., carboxymethyl, 2-carboxyethyl) and a sulfoalkyl group having from 2 to 5 carbon atoms (e.g., 2-sulfoethyl).

The 5- or 6-membered nitrogen-containing heterocyclic ring formed by $Z_{15}$ is one resulting from removing the oxo group or the thioxo group positioned at an appropriate site, more preferably the thioxo group of the rhodanine nucleus from the heterocyclic ring represented by D and $D_a$.

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$ and $L_{38}$ each represents a methine group or a substituted methine group {for example, substituted by a substituted or unsubstituted alkyl group having from 1 to 8, preferably 1 to 4 carbon atoms (e.g., methyl, ethyl, 2-carboxyethyl), examples of substituents of the substituted alkyl group being a carboxyl group and a hydroxy group, a substituted or unsubstituted aryl group having from 6 to 12 carbon atoms (e.g., phenyl, o-carboxyphenyl), examples of substituents of the substituted aryl group being a carboxyl group and a hydroxy group, a heterocyclic group having from 4 to 12 carbon atoms (e.g., barbituric acid), a halogen atom (e.g., chlorine, bromine), an alkoxy group having from 1 to 6 carbon atoms (e.g., methoxy, ethoxy), an amino group having from 0 to 15 carbon atoms (e.g., N,N-diphenylamino, N-methyl-N-phenylamino, N-methylpiperazino) or an alkylthio group having from 1 to 8 carbon atoms (e.g., methylthio, ethylthio)}, and they may form a ring with other methine group or may form a ring with an auxochrome.

$L_{11}$, $L_{12}$, $L_{16}$, $L_{17}$, $L_{18}$, $L_{19}$, $L_{22}$, $L_{23}$, $L_{29}$, $L_{30}$, $L_{31}$, $L_{32}$, $L_{37}$ and $L_{38}$ each is preferably an unsubstituted methine group.

$n_{12}$ is preferably 0, 1, 2 or 3.

$L_{13}$, $L_{14}$ and $L_{15}$ together form a monomethine, trimethine, pentamethine or heptamethine dye. When $n_{12}$ is 2 or greater, the unit comprising $L_{13}$ and $L_{14}$ is repeated but they may not be the same.

Preferred examples of $L_{13}$, $L_{14}$ and $L_{15}$ are described below.

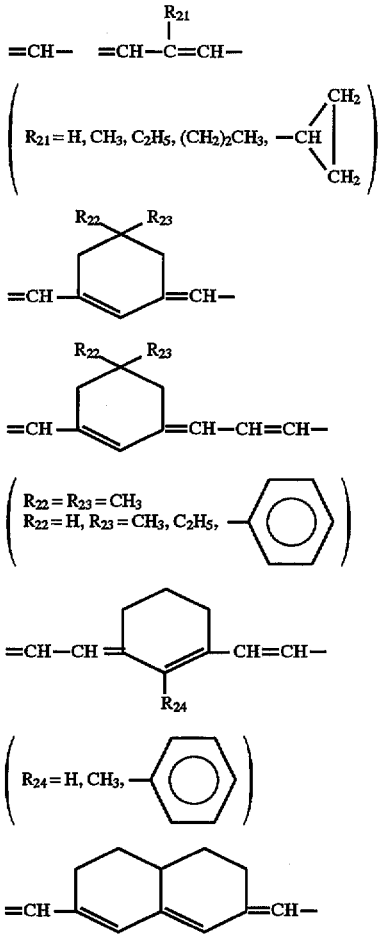

$R_{21}$, $R_{22}$, $R_{23}$, $R_{24}$ = hydrogen atom, alkyl group, aryl group, heterocyclic group.

$n_{12}$ is more preferably 1.

$n_{15}$ is preferably 0, 1, 2 or 3.

$L_{20}$ and $L_{21}$ together form a zero methine, dimethine, tetramethine or hexamethine dye. When $n_{15}$ is 2 or greater, the unit comprising $L_{20}$ and $L_{21}$ is repeated but they may not be the same.

Preferred examples of $L_{20}$ and $L_{21}$ are described below.

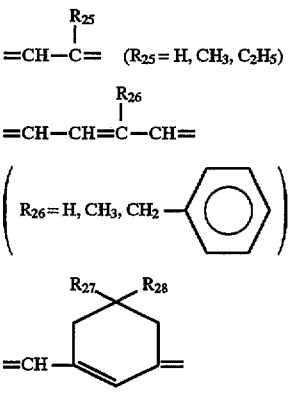

-continued

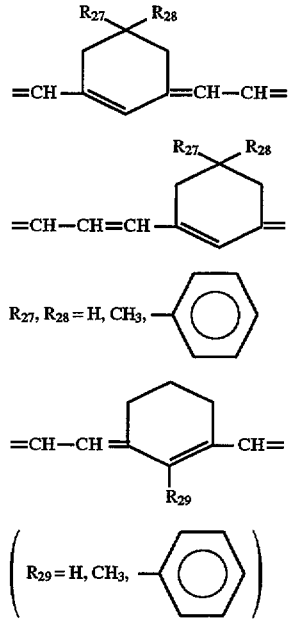

$R_{25}$, $R_{26}$, $R_{27}$, $R_{28}$, $R_{29}$: hydrogen atom, alkyl group, aryl group, heterocyclic group $n_{17}$ is preferably 0, 1, 2 or 3.

$L_{24}$ and $L_{25}$ together form zero methine, dimethine, tetramethine or hexamethine. When $n_{17}$ is 2 or greater, the unit comprising $L_{24}$ and $L_{25}$ is repeated but they may not be the same.

Preferred examples of $L_{24}$ and $L_{25}$ are the same as those of $L_{20}$ and $L_{21}$.

$n_{18}$ is preferably 0, 1, 2 or 3.

$L_{26}$, $L_{27}$ and $L_{28}$ together form monomethine, trimethine, pentamethine or heptamethine. When $n_{18}$ is 2 or greater, the unit comprising $L_{26}$ and $L_{27}$ is repeated but they may not be the same.

Preferred examples of $L_{26}$, $L_{27}$, and $L_{28}$ are described below:

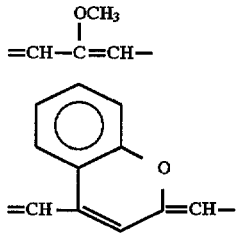

In addition, those described for $L_{13}$, $L_{14}$ and $L_{15}$ are preferred. $n_{21}$ is preferably 0. $L_{33}$ and $L_{36}$ each is preferably an unsubstituted methine group.

In the methine dye structure represented by formula (IV), (V), (VI) or (VII), at least one metallocene compound is substituted. The substitution site of the compound may be any of $Z_{11}$, $Z_{12}$, $Z_{13}$, $Z_{14}$, $Z_{15}$, $Z_{16}$, $Z_{17}$, $Z_{18}$, D, $D_a$, $D_1$, $D_{1a}$, $R_{11}$, $R_{12}$, $R_{13}$, $R_{14}$, $R_{15}$, $R_{16}$, $R_{17}$, $R_{18}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$ and $L_{38}$. The metallocene compound is preferably substituted to the group represented by $D_1$, $D_{1a}$, $R_{11}$, $R_{12}$, $R_{13}$, $R_{14}$, $R_{15}$, $R_{16}$, $R_{17}$ or $R_{18}$.

The hydrazone structure represented by formula (III) which is preferably used as $Hyd_1$ of the present invention is described below in greater detail.

Preferred examples of the group represented by $R_1$, $R_2$ and $R_3$ include an unsubstituted alkyl group having from 1 to 18, preferably from 1 to 8 carbon atoms (e.g., methyl, ethyl, propyl, isopropyl, butyl, isobutyl, hexyl, octyl, dodecyl, octadecyl, cyclopentyl, cyclopropyl, cyclohexyl) and a substituted alkyl group having from 1 to 24, preferably from 1 to 18 carbon atoms {assuming that the substituent is V, the substituent represented by V is not particularly restricted but examples thereof include a carboxyl group, a sulfo group, a cyano group, a halogen atom (e.g., fluorine, chlorine, bromine, iodine), a hydroxy group, an alkoxycarbonyl group having from 2 to 8 carbon atoms (e.g., methoxycarbonyl, ethoxycarbonyl, benzyloxycarbonyl), an aryloxycarbonyl having from 7 to 12 carbon atoms (e.g., phenoxycarbonyl), an alkoxy group having from 1 to 8 carbon atoms (e.g., methoxy, ethoxy, benzyloxy, phenethyloxy), an aryloxy group having from 6 to 18 carbon atoms (e.g., phenoxy, 4-methylphenoxy, α-naphthoxy), an acyloxy group having from 1 to 8 carbon atoms (e.g., acetyloxy, propionyloxy), an acyl group having from 1 to 8 carbon atoms (e.g., acetyl, propionyl, benzoyl, mesyl), a carbamoyl group having from 1 to 8 carbon atoms (e.g., carbamoyl, N,N-dimethylcarbamoyl, morpholinocarbonyl, piperidinocarbonyl), a sulfamoyl group having from 0 to 8 carbon atoms (e.g., sulfamoyl, N,N-dimethylsulfamoyl, morpholinosulfonyl, piperidinosulfonyl), an aryl group having from 6 to 12 carbon atoms (e.g., phenyl, 4-chlorophenyl, 4-methylphenyl, α-naphthyl), a heterocyclic group having from 4 to 12 carbon atoms (e.g., 2-pyridyl, tetrahydrofurfuryl, morpholino, 2-thiopheno), an amino group having from 0 to 12 carbon atoms (e.g., amino, dimethylamino, anilino, diphenylamino), an alkylthio group having from 1 to 12 carbon atoms (e.g., methylthio, ethylthio), an alkylsulfonyl group having from 1 to 8 carbon atoms (e.g., methylsulfonyl, propylsulfonyl), an alkylsulfinyl group having from 1 to 8 carbon atoms (e.g., methylsulfinyl), a nitro group, a phosphoric acid group, an acylamino group having from 1 to 8 carbon atoms (e.g., acetylamino), an ammonium group having from 1 to 8 carbon atoms (e.g., trimethylammonium, tributylammonium), a mercapto group, a hydrazino group having from 0 to 8 carbon atoms (e.g., trimethylhydrazino), a ureido group having from 1 to 8 carbon atoms (e.g., ureido, N,N-dimethylureido), an imide group, an unsaturated hydrocarbon group having from 2 to 16 carbon atoms (e.g., vinyl, ethynyl, 1-cyclohexenyl, benzylidine, benzylidene) and an unsubstituted alkyl group (e.g., methyl); these substituents may further be substituted by V; and specific examples of the substituent represented by V include an alkyl group having from 1 to 18 carbon atoms (e.g., carboxymethyl, 2-carboxyethyl, 3-carboxypropyl, 4-carboxybutyl, 2-sulfoethyl, 3-sulfopropyl, 4-sulfobutyl, 3-sulfobutyl, 2-hydroxy-3-sulfopropyl, 2-cyanoethyl, 2-chloroethyl, 2-bromoethyl, 2-hydroxyethyl, 3-hydroxypropyl, hydroxymethyl, 2-hydroxymethyl, 2-methoxyethyl, 2-ethoxyethyl, 2-ethoxycarbonylethyl, methoxycarbonylmethyl, 2-methoxyethyl, 2-ethoxyethyl, 2-phenoxyethyl, 2-acetyloxyethyl, 2-propionyloxyethyl, 2-acetylethyl, 3-benzoylpropyl, 2-carbamoylethyl, 2-morpholinocarbonylethyl, sulfamoylmethyl, 2-(N,N-dimethylsulfamoyl)ethyl, benzyl, 2-naphthylethyl, 2-(2-pyridyl)ethyl, allyl, 3-aminopropyl, 3-dimethylaminopropyl, methylthiomethyl, 2-methylsulfonylethyl, methylsulfinylmethyl, 2-acetylaminoethyl, 3-trimethylammoniumethyl, 2-mercaptoethyl, 2-trimethylhydrazinoethyl, methylsulfonylcarbamoylmethyl and (2-methoxy)ethoxymethyl)}, an aryl group having from 6 to 18, preferably from 6 to 12 carbon atoms (e.g., phenyl, α-naphthyl, β-naphthyl, phenyl group substituted by the above-described substituent V, naphthyl) and a heterocyclic group having from 4 to 18, preferably from 4 to 12 carbon atoms (e.g., 2-pyridyl, 2-pyridyl group substituted by the above-described substituent V)}.

$R_1$ and $R_2$ or $R_3$ and $R_4$ may be combined with each other to form a ring. The ring may be substituted, for example, by the above-described substituent V.

However, the carbon atom of $R_1$ or R2 bonded directly to the nitrogen atom is not substituted by an oxo group, a thioxo group or an imino group. For example, $R_1$ or $R_2$ is not an acetyl group, a carboxy group, a benzoyl group, a formyl group, a thioacetyl group, a thioaldehyde group, a thiocarboxy group, a thiobenzoyl group, an imino group, an N-methylimino group, a malonyl group when a ring is formed by two N-phenylimino groups, a succinyl group, a glutaryl group or an adipoyl group.

$R_1$ and $R_2$ each is more preferably an unsubstituted or substituted alkyl group which is described above, still more preferably an unsubstituted alkyl group having from 1 to 5 carbon atoms (e.g., methyl, ethyl, propyl, butyl) or a substituted alkyl group having from 1 to 5 carbon atoms {for example, a sulfoalkyl group (e.g., 2-sulfoethyl, 3-sulfopropyl, 4-sulfobutyl, 3-sulfobutyl), a carboxyalkyl group having from 1 to 5 carbon atoms (e.g., carboxymethyl, 2-carboxyethyl) or a hydroxyalkyl group having from 1 to 5 carbon atoms (e.g., 2-hydroxyethyl)}.

$R_3$ is more preferably a substituent represented by the following formula (IIIa):

$$\text{-}(L_2=L_3)_{n_1}\text{-}Ar \qquad \text{(IIIa)}$$

wherein $L_2$ and $L_3$ each represents a methine group, Ar represents an aryl group and $n_1$ represents 0 or an integer of from 1 to 4.

Ar is preferably a phenyl group or a substituted phenyl group having from 6 to 18 carbon atoms (of which substituent includes those represented by the above-described V).

$L_2$ and $R_3$ each is preferably an unsubstituted methine group.

$n_1$ is preferably 0 or 1.

$R_4$ is a hydrogen atom or a substituent the same as described for $R_1$, $R_2$ or $R_3$, preferably a hydrogen atom.

If it is advantageous in view of synthesis or storage, the hydrazone compound represented by formula (I) or (II) may be isolated as a salt. In this case, any compound may be used as long as it can form a hydrazone and a salt but preferred examples of the salt include an arylsulfonate having from 6 to 16 carbon atoms (e.g., p-toluenesulfonate, p-chlorobenzenesulfonate), an aryldisulfonate having from 6 to 16 carbon atoms (e.g.,1,3-benzenedisulfonate, 1,5-naphthalenedisulfonate, 2,6-naphthalenedisulfonate), a thiocyanate, a picrate, a carboxylate (e.g., oxalate, acetate, benzoate, hydrogen-oxalate), a halogen acid salt (e.g., hydrochloric acid salt, hydrofluoric acid salt, hydrobromic acid salt, hydroiodic acid salt), a sulfate, a perchlorate, a tetrafluoroborate, a sulfite, a nitrate, a phosphate, a carbonate and a bicarbonate, with hydrogenoxalate, oxalate and hydrochloric acid salt being preferred.

The hydrazone structure represented by formula (III) is preferably represented by the following formula (IIIb):

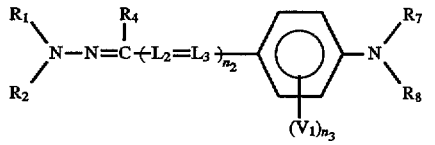

(IIIb)

wherein $R_1$, $R_2$ and $R_4$ are the same as $R_1$, $R_2$ and $R_4$ of formula (III), respectively; $R_7$ and $R_8$ each represents a hydrogen atom, an aliphatic group, an aryl group or a heterocyclic group; $V_1$ represents a hydrogen atom or a monovalent substituent; $n_3$ represents an integer of from 1 to 4; $L_2$ and $L_3$ are the same as $L_2$ and $L_3$ of formula (IIIa), respectively; and n represents 0 or 1.

Formula (IIIb) is described below in detail.

$R_7$ and $R_8$ each is preferably a hydrogen atom or a group the same as described for $R_1$ or $R_2$ above, more preferably an unsubstituted or substituted alkyl group having from 1 to 18 carbon atoms, particularly preferably an unsubstituted alkyl group having from 1 to 5 carbon atoms (e.g., methyl, ethyl, propyl, butyl) or a substituted alkyl group having from 1 to 12 carbon atoms {for example, a sulfoalkyl group (e.g., 2-sulfoethyl, 3-sulfopropyl, 4-sulfobutyl, 3-sulfobutyl), a carboxyalkyl group (e.g., carboxymethyl, 2-carboxyethyl) or a hydroxyalkyl group (e.g., 2-hydroxyethyl)}, examples of substituents of the substituted alkyl group being a carboxyl group and a hydroxy group.

$V_1$ represents a hydrogen atom or a monovalent substituent. The substituent is not particularly restricted but include those described above for $R_1$, $R_2$ and V. More preferred examples of the substituent include an unsubstituted alkyl group having from 1 to 4 carbon atoms (e.g., methyl, ethyl), a substituted alkyl group having from 1 to 6 carbon atoms (e.g., 2-sulfobutyl, 2-carboxyethyl), examples of substituents of the substituted alkyl group being a carboxyl group and a hydroxy group and an alkoxy group having from 1 to 4 carbon atoms (e.g., methoxy, ethoxy).

$L_2$ and $L_3$ each represents an unsubstituted or substituted methine group (examples of the substituent include those described above for $R_1$, $R_2$, $R_3$ and V), preferably an unsubstituted methine group.

$n_1$ is preferably 0.

In the hydrazone compound, at least one of $R_1$, $R_2$, $R_3$ and $R_4$ of formula (III), at least one of $R_1$, $R_2$, $R_4$, $L_2$, $L_3$ and Ar of formula (IIIa) or at least one of $R_7$, $R_8$, $L_2$, $L_3$ and $V_1$ of formula (IIIb) is bonded to $-(Q_1)_{k_{2a}}-(MET)_{k_{1a}}$ or $-(Q_2)_{k_{2b}}-(Het)_{k_{1b}}$. More preferably, $R_1$, $R_2$, $R_5$, $R_6$, $R_7$ or $R_8$ is bonded to the moiety and still more preferably, $R_7$ or $R_8$ is bonded thereto.

$Q_1$ and $Q_2$ each represents a linking group comprising an atom or an atomic group containing at least one of a carbon atom, a nitrogen atom, a sulfur atom and an oxygen atom.

The linking group represented by $Q_1$ or $Q_2$ may have a valence required. More specifically, $Q_1$ and $Q_2$ have a valence of $(K_{1a}+1)$ and $(K_{1b}+1)$, respectively. For example, when $K_{1a}$ is 1, $Q_1$ is a divalent linking group.

Preferably, $Q_1$ and $Q_2$ each represents a divalent linking group having from 1 to 20 carbon atoms comprising a combination of one or more of an alkylene group having from 1 to 18, preferably from 1 to 6 carbon atoms (e.g., methylene, ethylene, propylene, butylene, pentylene), an arylene group having from 6 to 18, preferably from 6 to 12 carbon atoms (e.g., phenylene, naphthylene), an alkenylene group having from 1 to 18, preferably from 1 to 6 carbon atoms (e.g., ethenylene, propenylene), $-N(R^1)-$ having from 1 to 12 carbon atoms (wherein $R^1$ represents a hydrogen atom, a substituted or unsubstituted alkyl group or a substituted or unsubstituted aryl group), a heterocyclic divalent group having from 4 to 18, preferably from 4 to 12 carbon atoms (e.g., 6-chloro-1,3,5-triazine-2,4-diyl, pyrimidine-2,4-diyl, quinoxaline-2,3-diyl) and the following linking groups 1Q to 10Q:

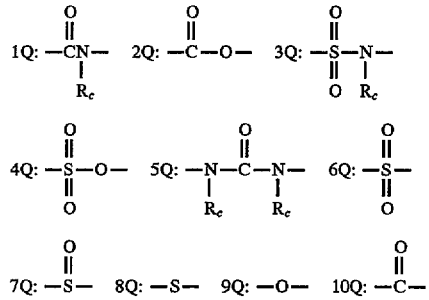

wherein $R_c$ represents an aliphatic group or an aryl group. Among these, preferred are 1Q, 2Q and 5Q.

$k_{1a}$ and $k_{3a}$ each is preferably 1 or 2. $k_{1a}$, $k_{2a}$ and $k_{3a}$ each is more preferably 1.

The adsorbing group to silver halide may be any as long as it adsorbs to silver halide but preferably, it has the following characteristic features in view of chemical structure:

i) a 5-, 6- or 7-membered nitrogen-containing heterocyclic ring having a quaternary nitrogen atom represented by formula (A):

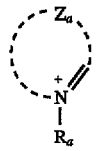

(A)

ii) a 5-, 6- or 7-membered heterocyclic ring having a thioxo group represented by formula (B):

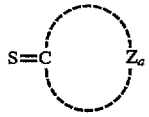

(B)

iii) a 5-, 6- or 7-membered nitrogen-containing heterocyclic ring having at least three nitrogen atoms represented by formula (C):

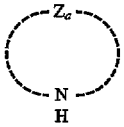

(C)

provided that a thioether group ($-SR_b$) (wherein $R_b$ represents an aliphatic group, an aryl group or a heterocyclic group) does not substitute $Z_a$;

iv) a 5-, 6- or 7-membered nitrogen-containing heterocyclic ring represented by (D) or (E):

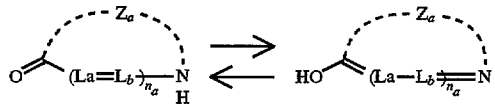

(D)

-continued

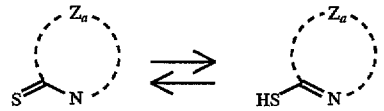

(E)

wherein in formulae (A), (B), (C), (D) and (E), Za represents an atomic group necessary for forming a 5-, 6- or 7-membered nitrogen-containing heterocyclic ring, $L_a$, and $L_b$ each represents a methine group, $n_a$ represents 0, 1, 2 or 3 and $R_a$ represents an aliphatic group.

The adsorbing group to silver halide more preferably has a characteristic feature i), ii) or iv).

The group represented by Het in formula (II) is an adsorbing group to silver halide having a 5-, 6- or 7-membered heterocyclic ring which has one of characteristic features i) to iv), contains at least one nitrogen atom and may further have a hetero atom other a nitrogen atom (e.g., an oxygen atom, a sulfur atom, a selenium atom, a tellurium atom). Preferred examples thereof include an azole ring (e.g., imidazole, triazole, tetrazole, oxazole, selenazole, benzimidazole, benzotriazole, indazole, benzoxazole, benzothiazole, thiadiazole, oxadiazole, benzoselenazole, pyrazole, naphthothiazole, naphthoimidazole, naphthoxazole, azabenzimidazole, purine), a pyrimidine ring, a triazine ring and an azaindene ring (e.g., triazaindene, tetrazaindene, pentazaindene).

Het is more preferably a group having a chemical structure represented by formula (XI), (XII), (XIII), (XIV) or (XV):

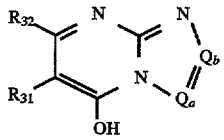

(XI)

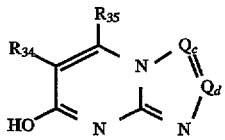

(XII)

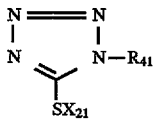

(XIII)

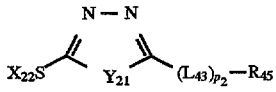

(XIV)

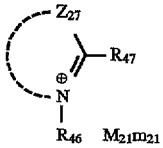

(XV)

wherein $Q_a$ represents =N— or =C($R_{33}$)—; when $Q_a$ is =N—, $Q_b$ represents =C($R_{33}$)— and when $Q_a$ is =C($R_{33}$)—, $Q_b$ represents =N—; $Q_c$ represents =N— or =C($R_{36}$)—; when $Q_c$ is =N—, $Q_d$ represents =C($R_{36}$)— and when $Q_c$ is =C($R_{36}$)—, $Q_d$ represents =N—; $R_{31}$, $R_{32}$, $R_{33}$, $R_{34}$, $R_{35}$ and $R_{36}$ each represents a hydrogen atom or a monovalent substituent; $R_{44}$represents an aliphatic group, an aryl group or a heterocyclic group; $X_{21}$ represents a hydrogen atom, an alkali metal atom, an ammonium group or a precursor; $Y_{21}$ represents an oxygen atom, a sulfur atom =NH, =N—$(L_{44})_{p3}$—$R_{48}$; $L_{43}$ and $L_{44}$ each represents a divalent linking group; $R_{45}$ and $R_{48}$ each represents a hydrogen atom, an aliphatic group, an aryl group or a heterocyclic group; $X_{22}$ has the same meaning as $X_{21}$; $p_2$ and $P_3$ each represents 0 or an integer of from 1 to 3; $Z_{27}$ represents an atomic group necessary for forming a 5- or 6-membered nitrogen-containing heterocyclic ring; $R_{46}$ represents an aliphatic group; and $R_{47}$ represents a hydrogen atom or an aliphatic group; provided that in formula (XI), (XII), (XIII), (XIV) or (XV), at least one —$(Q_2)_{k_{2b}}$-($Hyd_2$) is substituted but not to $X_{21}$ of formula (XIII) or to $X_{22}$ of formula (XIV).

Among formulae (XI) to (XV), preferred are formulae (XI) and (XIII) and more preferred is formula (XIII).

Formulae (XI), (XII), (XIII), (XIV) and (XV) are described below in greater detail.

The term "aliphatic group" as used herein means an aliphatic hydrocarbon group which may be linear, branched or cyclic, saturated or unsaturated, or unsubstituted or substituted with the substituents represented by the above-described V, such as a hydroxy group and a carboxyl group and examples thereof include a substituted or unsubstituted alkyl group, a substituted or unsubstituted alkenyl group, a substituted or unsubstituted alkynyl group, a substituted or unsubstituted cycloalkyl group and a substituted or unsubstituted cycloalkenyl group, examples of substituents of the substituted alkyl group, substituted alkenyl group, substituted alkynyl group, substituted cycloalkyl group and substituted cycloalkenyl group being substituted with the substituents represented by the above-described V, such as a hydroxy group and a carboxyl group.

$R_{31}$, $R_{32}$, $R_{33}$, $R_{34}$, $R_{35}$ and $R_{36}$ each represents a hydrogen atom or a monovalent substituent. Examples of the monovalent substituent include substituents described above as preferred examples for $R_1$, $R_2$ and V.

$R_{31}$, $R_{32}$, $R_{33}$, $R_{34}$, $R_{35}$ and $R_{36}$ each more preferably represents a lower aliphatic group (preferably a substituted or unsubstituted aliphatic group having from 1 to 4 carbon atoms, e.g., methyl, ethyl, n-propyl, isopropyl, n-butyl, t-butyl, methoxyethyl, hydroxyethyl, hydroxymethyl, vinyl, allyl), a carboxy group, an alkoxy group (preferably a substituted or unsubstituted alkoxy group having from 1 to 5 carbon atoms, e.g., methoxy, ethoxy, methoxyethoxy, hydroxyethoxy), an aralkyl group (preferably a substituted or unsubstituted aralkyl group having from 7 to 12 carbon atoms, e.g., benzyl, phenethyl, phenylpropyl), an aryl group (preferably a substituted or unsubstituted aryl group having from 6 to 12 carbon atoms, e.g., phenyl, 4-methylphenyl, 4-methoxyphenyl), a heterocyclic group (e.g., 2-pyridyl), an alkylthio group (preferably a substituted or unsubstituted alkylthio group having from 1 to 10 carbon atoms, e.g., methylthio, ethylthio), an arylthio group (preferably a substituted or unsubstituted arylthio group having from 6 to 12 carbon atoms, e.g., phenylthio), an aryloxy group (preferably a substituted or unsubstituted aryloxy group having from 6 to 12 carbon atoms, e.g., phenoxy), an alkylamino group having 3 or more carbon atoms (e.g., propylamino, butylamino), an arylamino group (e.g., anilino), a halogen atom (e.g., chlorine, bromine, fluorine) and the following substituents:

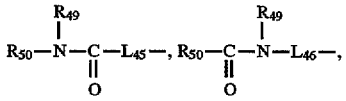

-continued

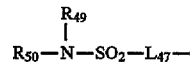

wherein $L_{45}$, $L_{46}$ and $L_{47}$ each represents a linking group and is an alkylene group (preferably an alkylene group having from 1 to 5 carbon atoms, e.g., methylene, propylene, 2-hydroxy-propylene), examples of substituents of the substituted aliphatic group, substituted alkoxy group, substituted aralkyl group, substituted aryl group, substituted alkylthio group, substituted arylthio group and substituted aryloxy group being substituted with the substituents represented by the above-described V, such as a hydroxy group and a carboxyl group; and $R_{49}$ and $R_{50}$, which may be the same or different, each represents a hydrogen atom, an aliphatic group (preferably a substituted or unsubstituted aliphatic group having from 1 to 10 carbon atoms, e.g., methyl, ethyl, n-propyl, isopropyl, n-butyl, t-butyl, n-octyl, methoxyethyl, hydroxyethyl, allyl, propargyl), an aralkyl group (preferably a substituted or unsubstituted aralkyl group having from 7 to 12 carbon atoms, e.g., benzyl, phenethyl, vinylbenzyl), an aryl group (preferably a substituted or unsubstituted aryl group having from 6 to 12 carbon atoms, e.g., phenyl, 4-methylphenyl) or a heterocyclic group (e.g., 2-pyridyl), examples of substituents of the substituted aliphatic group, substituted aralkyl group and substituted aryl group being substituted with substituents represented by the above-described V, such as a hydroxy group and a carboxyl group.

The aliphatic group, the aryl group or the heterocyclic group represented by $R_{44}$ may be either unsubstituted or substituted.

Examples of the substituent include substituents described above as preferred examples for $R_1$, $R_2$ and V.

More preferred examples of the substituent include a halogen atom (e.g., chlorine, bromine, fluorine), a nitro group, a cyano group, a hydroxy group, an alkoxy group having from 1 to 4 carbon atoms (e.g., methoxy), an aryl group having from 6 to 12 carbon atoms (e.g., phenyl), an acylamino group having from 1 to 4 carbon atoms (e.g., propionylamino), an alkoxycarbonylamino group having from 2 to 6 carbon atoms (e.g., methoxycarbonylamino), a ureido group having from 1 to 8 carbon atoms, an amino group having from 0 to 8 carbon atoms, a heterocyclic group having from 4 to 12 carbon atoms (e.g., 2-pyridyl), an acyl group having from 1 to 4 carbon atoms (e.g., acetyl), a sulfamoyl group having from 0 to 8 carbon atoms, a sulfonamide group having from 0 to 8 carbon atoms, a thioureido group having from 1 to 8 carbon atoms, a carbamoyl group having from 1 to 8 carbon atoms, an alkylthio group having from 1 to 5 carbon atoms (e.g., methylthio), an arylthio group having from 6 to 12 carbon atoms (e.g., phenylthio), a heterocyclic thio group (e.g., 2-benzothiazolylthio), a carboxylic acid group, a sulfonic acid group and a salt of these.

The above-described ureido, thioureido, sulfamoyl, carbamoyl or amino group may be unsubstituted, N-alkyl-substituted or N-aryl-substituted. Examples of the aryl group include a phenyl group or a substituted phenyl group and examples of the substituent include substituents described above as preferred examples for $R_1$, $R_2$ and V.

Examples of the alkali metal atom represented by $X_{21}$ and $X_{22}$ include a sodium atom and a potassium atom and examples of the ammonium group include tetramethylammonium and trimethylbenzylammonium. The precursor is a group capable of converting into a hydrogen atom, an alkali metal or an ammonium under alkaline conditions and examples thereof include an acetyl group, a cyanoethyl group and a methanesulfonylethyl group.

Specific examples of the divalent linking group represented by $L_{43}$ and $L_{44}$ include the following linking groups and a combination of these.

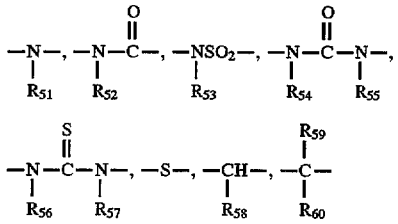

wherein $R_{51}$, $R_{52}$, $R_{53}$, $R_{54}$, $R_{55}$, $R_{56}$, $R_{57}$, $R_{58}$, $R_{59}$ and $R_{60}$ each represents a hydrogen atom, an aliphatic group (preferably a substituted or unsubstituted aliphatic group having from 1 to 4 carbon atoms, e.g., methyl, ethyl, n-butyl, methoxyethyl, hydroxyethyl, allyl) or an aralkyl group (preferably a substituted or unsubstituted aralkyl group having from 7 to 12 carbon atoms, e.g., benzyl, phenethyl, phenylpropyl), examples of substituents of the substituted aliphatic group and substituted aralkyl group being substituted with substituents represented by the above-described V, such as a hydroxy group and a carboxyl group.

$R_{45}$ and $R_{48}$ a each preferably represents the same substituent as described above for $R_{44}$.

$Z_{27}$ preferably represents a thiazolium (e.g., thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium), an oxazolium (e.g., oxazolium, 4-methyloxazolium, benzoxazolium, 5-chlorobenzoxazolium, 5-phenylbenzoxazolium, 5-methylbenzoxazolium, naphth[1,2-d]oxazolium), an imidazolium (e.g., 1-methylbenzimidazolium, 1-propyl-5-chlorobenzimidazolium, 1-ethyl-5,6-cyclobenzimidazolium, 1-allyl-5-trifluoromethyl-6-chlorobenzimidazolium) or a selenazolium (e.g., benzoselenazolium, 5-chlorobenzoselenazolium, 5-methylbenzoselenazolium, 5-methoxybenzoselenazolium, naphtho[1,2-d]selenazolium), more preferably a thiazolium (e.g., benzothiazolium, 5-chlorobenzoxazolium, 5-methoxybenzothiazolium, naphtho[1,2-d]thiazolium).

$R_{46}$ and $R_{47}$ each preferably represents a hydrogen atom, an unsubstituted alkyl group having from 1 to 18 carbon atoms (e.g., methyl, ethyl, propyl, butyl, pentyl, octyl, decyl, dodecyl, octadecyl) or a substituted alkyl group {examples of the substituent include a vinyl group, a carboxy group, a sulfo group, a cyano group, a halogen atom (e.g., fluorine, chlorine, bromine), a hydroxy group, an alkoxycarbonyl group having from 2 to 8 carbon atoms (e.g., methoxycarbonyl, ethoxycarbonyl, phenoxycarbonyl, benzyloxycarbonyl), an alkoxy group having from 1 to 8 carbon atoms (e.g., methoxy, ethoxy, benzyloxy, phenethyloxy), a monocyclic aryloxy group having from 1 to 10 carbon atoms (e.g., phenoxy, p-tolyloxy), an acyloxy group having from 1 to 3 carbon atoms (e.g., acetyloxy, propionyloxy), an acyl group having from 1 to 8 carbon atoms (e.g., acetyl, propionyl, benzoyl, mesyl), a carbamoyl group having from 1 to 8 carbon atoms (e.g., carbamoyl, N,N-dimethylcarbamoyl, morpholinocarbamoyl, piperidinocarbamoyl), a sulfamoyl group having from 0 to 8 carbon atoms (e.g., sulfamoyl, N,N-dimethylsulfamoyl, morpholinosulfonyl, piperidinosulfonyl), an aryl group having 10 or less carbon atoms (e.g., phenyl, 4-chlorophenyl, 4-methylphenyl, α-naphthyl) and a substituted or unsubstituted alkenyl group (e.g., allyl), examples of substituents of the substituted alkenyl group being substituted with substituents represented by the above-described V, such as a hydroxy group and a carboxyl group}, provided that $R_{46}$ is not a hydrogen atom.

More preferably, $R_{46}$ represents an unsubstituted alkyl group (e.g., methyl, ethyl) or an alkenyl group (e.g., allyl) and $R_{47}$ represents a hydrogen atom or an unsubstituted lower alkyl group (e.g., methyl, ethyl).

$M_{21}m_{21}$ is included in the formulae so as to show the presence or absence of a cation or anion when it is necessary for neutralizing the ion charge of the hydrazone compound represented by formula (II). Whether a certain dye is a cation or an anion or whether the dye has a net ion charge or not depends on its auxochrome or substituent. Typical examples of the cation include an inorganic or organic ammonium ion and an alkali metal ion, whereas the anion may be either an inorganic anion or an organic anion and specific examples thereof include a halogen anion (e.g., fluorine ion, chlorine ion, bromine ion, iodine ion), a substituted arylsulfonic acid ion (e.g., p-toluenesulfonic acid ion, p-chlorobenzenesulfonic acid ion), an aryldisulfonic acid ion (e.g., 1,3-benzenedisulfonic acid ion, 1,5-naphthalenedisulfonic acid ion, 2,6-naphthalenedisulfonic acid ion), an alkylsulfuric acid ion (e.g., methylsulfuric acid ion), a sulfuric acid ion, a thiocyanic acid ion, a perchloric acid ion, a tetrafluoroboric acid ion, a picric acid ion, an acetic acid ion and a trifluoromethansulfonic acid ion.

Among these, preferred are a ammonium ion, an iodine ion, a bromine ion and a p-toluenesulfonic acid ion.

The hydrazone compound of the present invention has at least one adsorbing group to silver halide represented by formula (XI), (XII), (XIII), (XIV) or (XV). The substitution site thereof may be $R_{31}$, $R_{32}$, $R_{33}$, $R_{34}$, $R_{35}$, $R_{36}$, $R_{44}$, $R_{45}$, $R_{46}$, $R_{47}$, $Y_{21}$, $L_{43}$ or $Z_{27}$. It is more preferably $R_{44}$ of formula (XIII).

$Hyd_2$ has the same meaning as $Hyd_1$.

$k_{1b}$ and $k_{3b}$ each is preferably 1 or 2, $k_{3b}$ is preferably 1 or 2. More preferably, $k_{1b}$ is 1, $k_{2b}$ is 1 and $k_{3b}$ is 1.

$Q_2$ has the same meaning as $Q_1$ and it is also the same therewith in the preferred embodiment.

The hydrazone compound of the present invention is particularly preferably represented by formula (XVI):

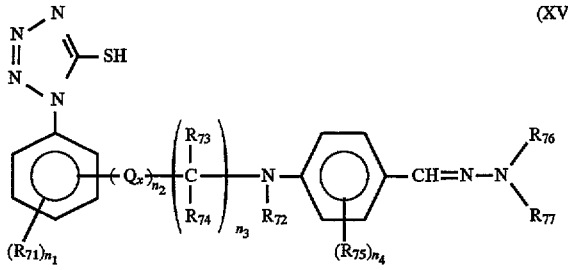

(XVI)

wherein $Q_x$ has the same meaning as $Q_2$; $R_{71}$ and $R_{75}$ each represents a monovalent substituent; $R_{73}$ and $R_{74}$ each represents a hydrogen atom or a monovalent substituent; $R_{72}$, $R_{76}$ and $R_{77}$ each represents an aliphatic group; $n_1$ and $n_4$ each represents 0 and an integer of from 1 to 4; $n_2$ represents 0 or 1; and $n_3$ represents an integer of from 1 to 6.

$Q_x$ is preferably the same as $Q_2$, more preferably a ureido group, an ester group or an amide group.

$R_{73}$ and $R_{75}$ each is preferably the same as $V_1$.

$R_{73}$ and $R_{74}$ each is preferably the same as $R_{41}$, more preferably a hydrogen atom.

$R_{72}$, $R_{76}$ and $R_{77}$ each is preferably the same as an aliphatic group for $R_1$ or $R_2$, more preferably an unsubstituted alkyl group having from 1 to 4 carbon atoms (e.g., methyl ethyl).

$n_2$ is preferably 1.

$n_3$ is preferably from 2 to 4.

When $n_1$, $n_3$ or $n_4$ is 2 or greater, $R_{71}$, $C(R_{73})(R_{74})$ or $R_{75}$ may be repeated but they may not be the same.

Typical examples of the hydrazone compound of the present invention are described below, but the present invention is by no means limited to these.

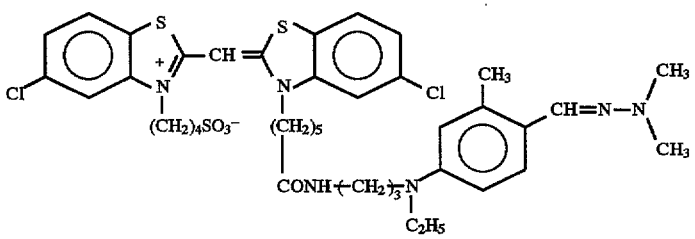

(I-1)

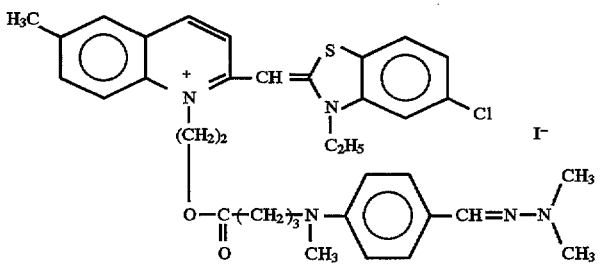

(I-2)

-continued
(I-3)
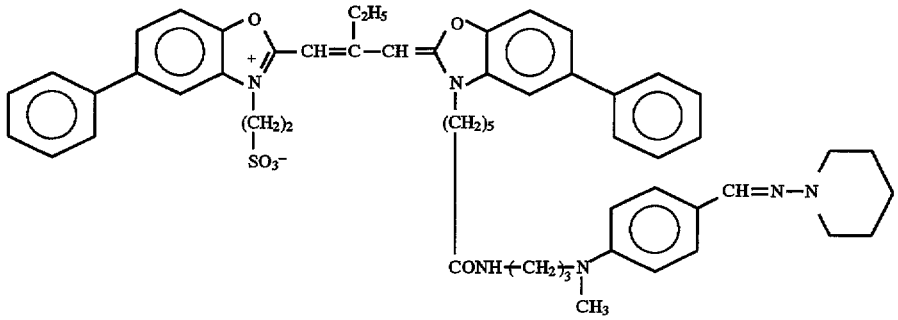
(I-4)
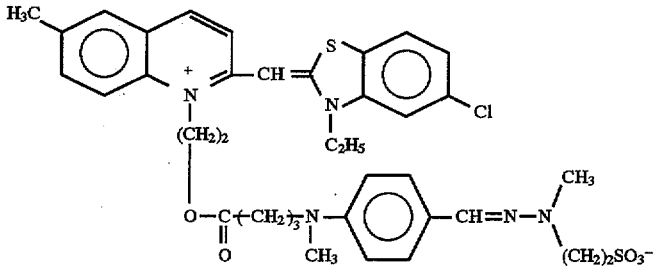
(I-5)
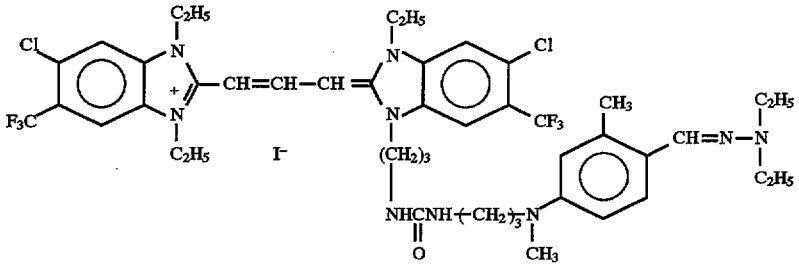
(I-6)
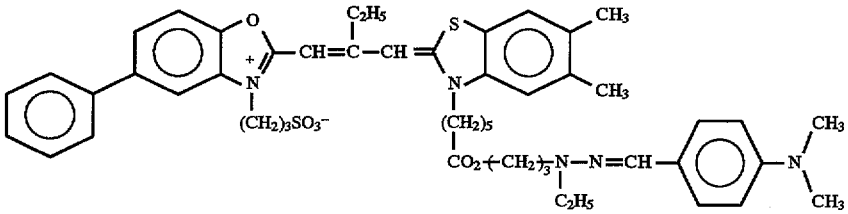
(I-7)
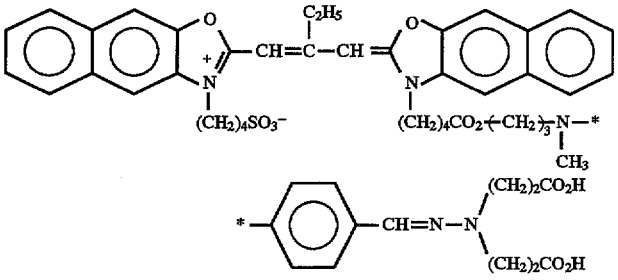

-continued
(I-8)
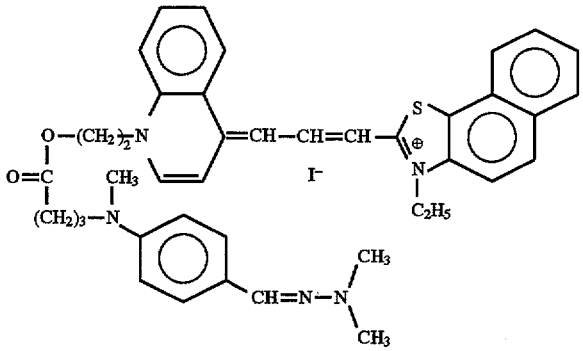
(I-9)
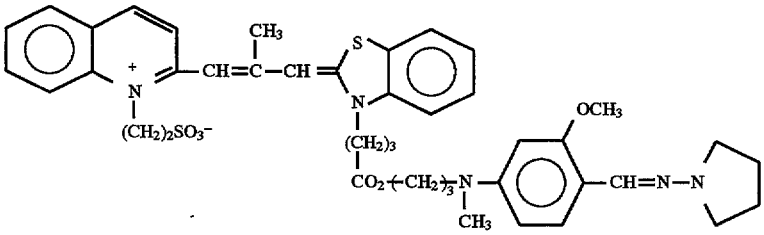
(I-10)
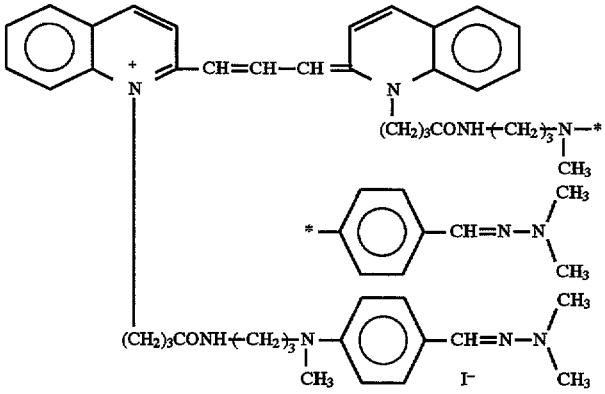
(I-11)
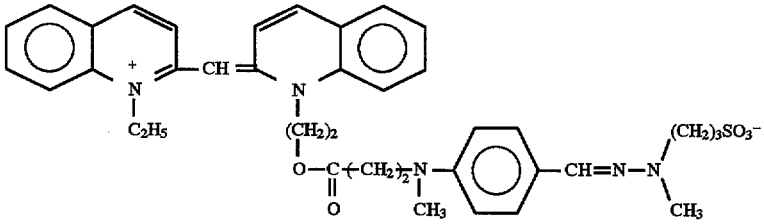
(I-12)
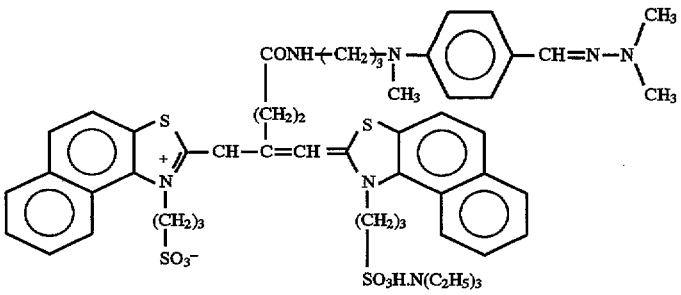

-continued
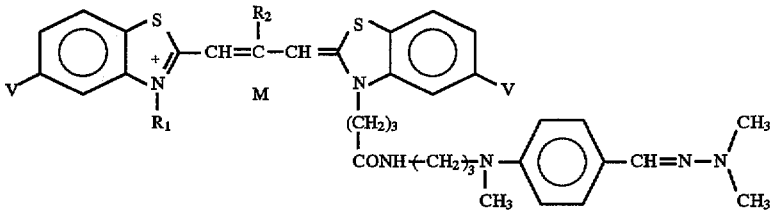
V = H, $R_1 = C_2H_5$, $R_2$ = H, M = $I^-$ (I-13)
V = Cl, $R_1 = C_2H_5$, $R_2 = CH_3$, M = $I^-$ (I-14)
V = Cl, $R_1 = (CH_2)_3SO_3^-$, $R_2 = C_2H_5$, M = none (I-15)
(I-16)
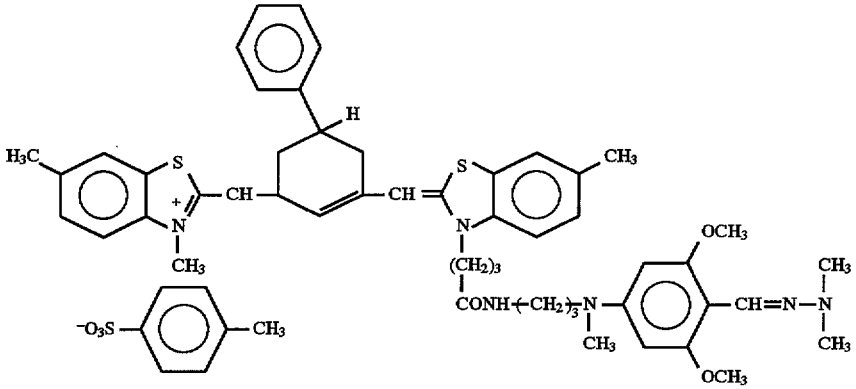
(I-17)
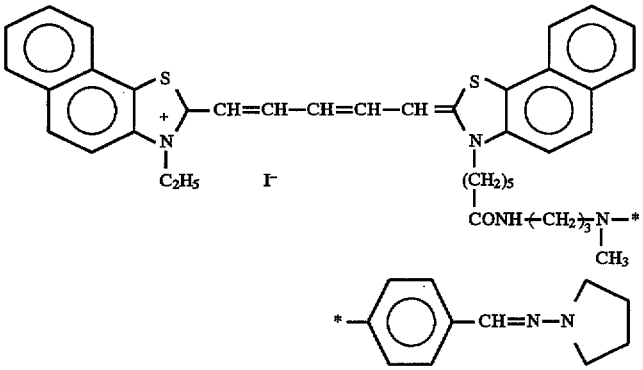
(I-18)
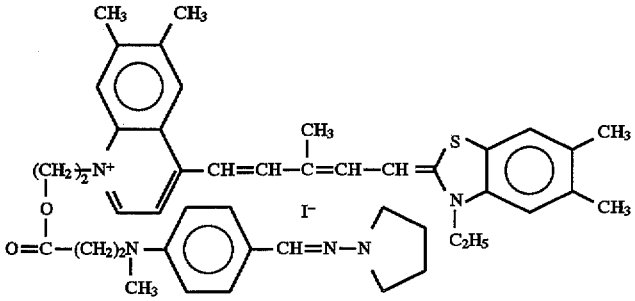

-continued
(I-19)
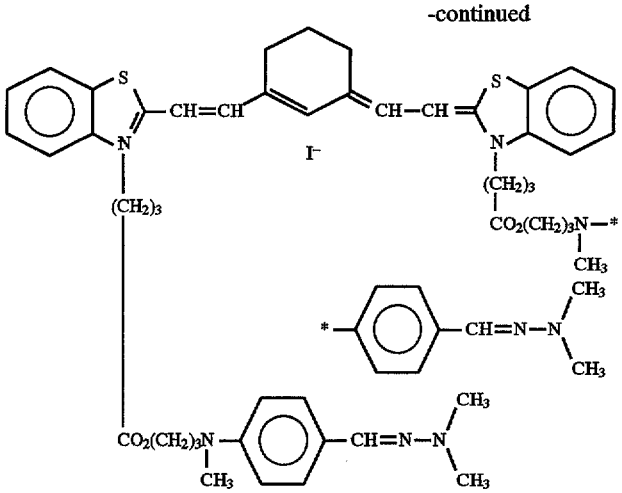
(I-20)
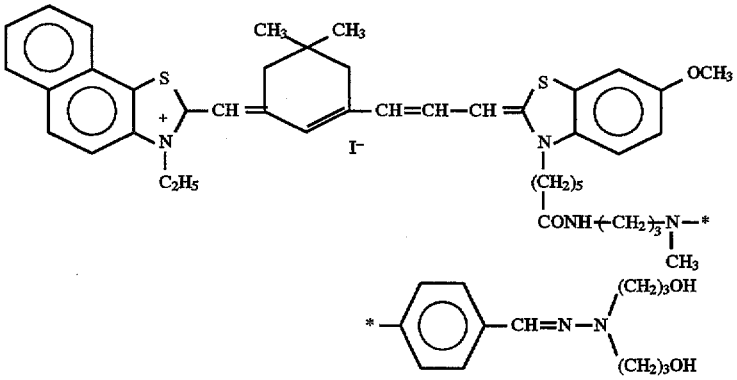
(I-21)
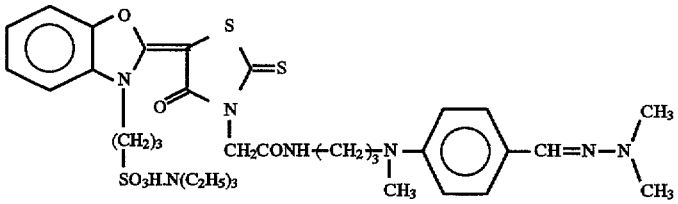
(I-22)
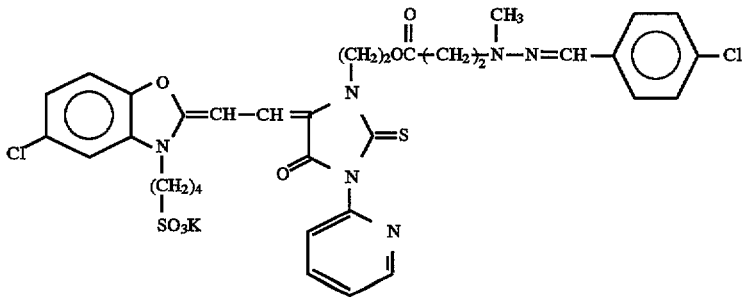
(I-23)
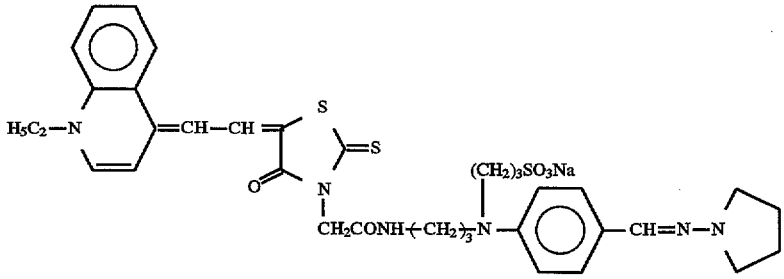

-continued
(I-24)
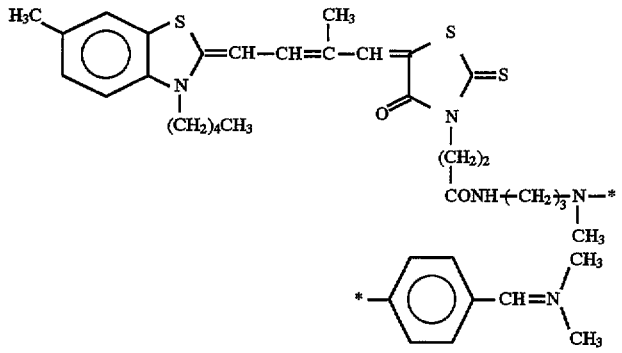
(I-25)
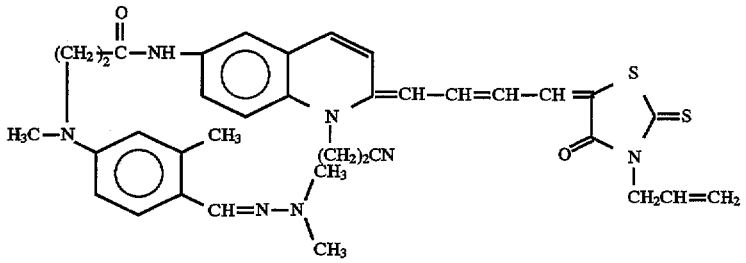
(I-26)
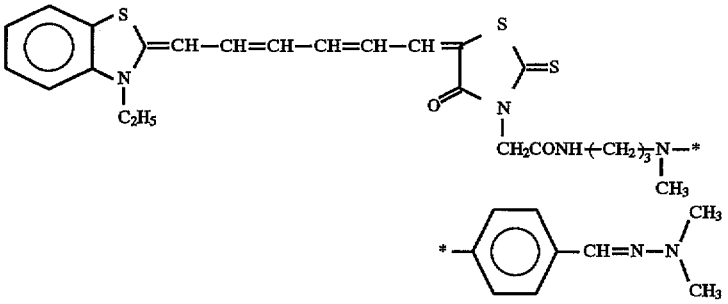
(I-27)
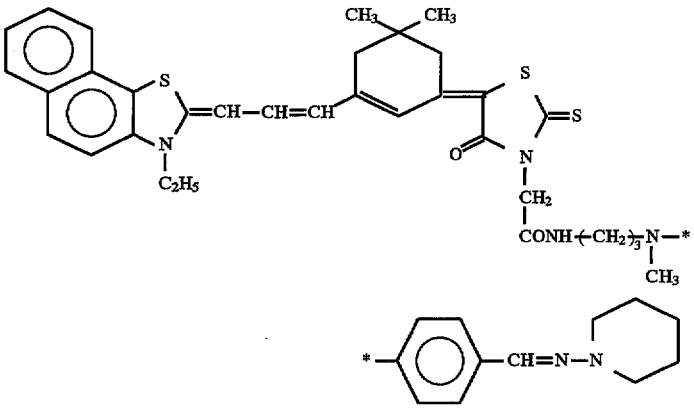
((I-28)
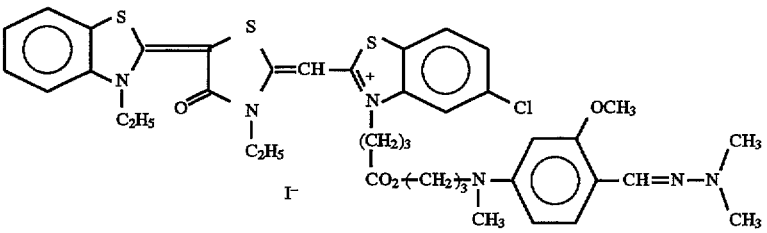

-continued
(I-29)
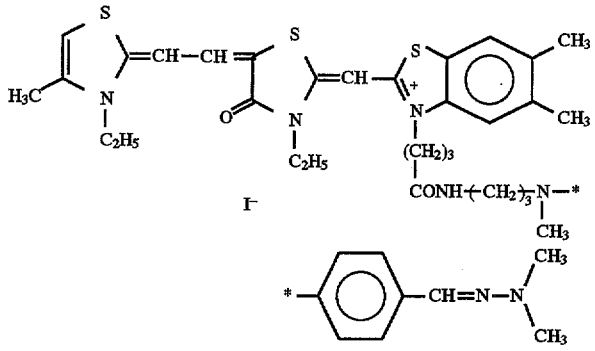
(I-30)
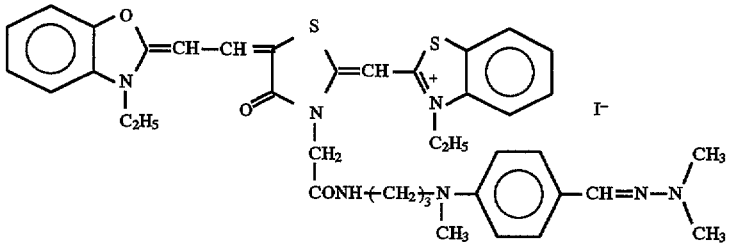
(I-31)
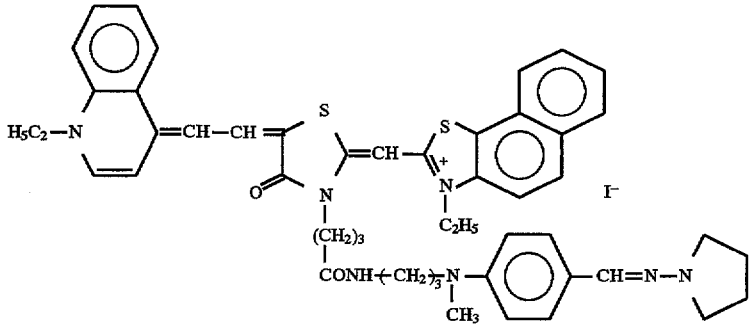
(I-32)
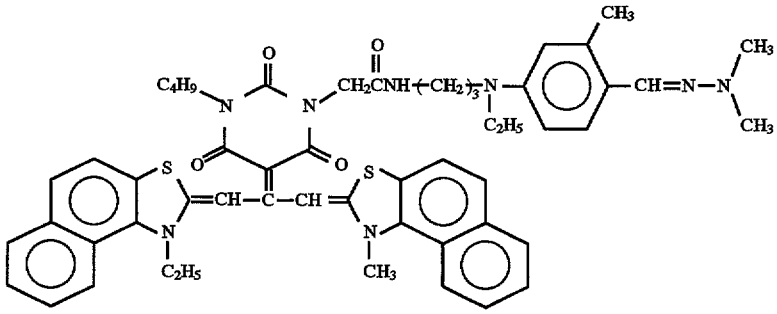
(I-33)
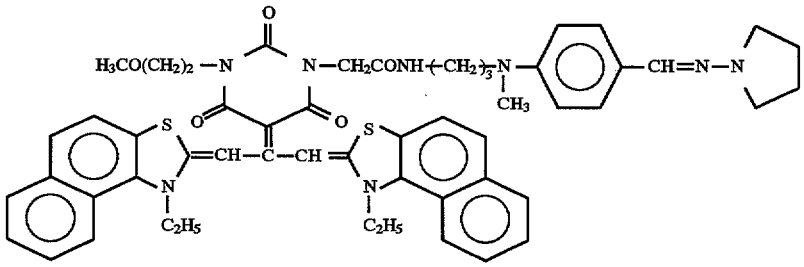

-continued
(I-34)
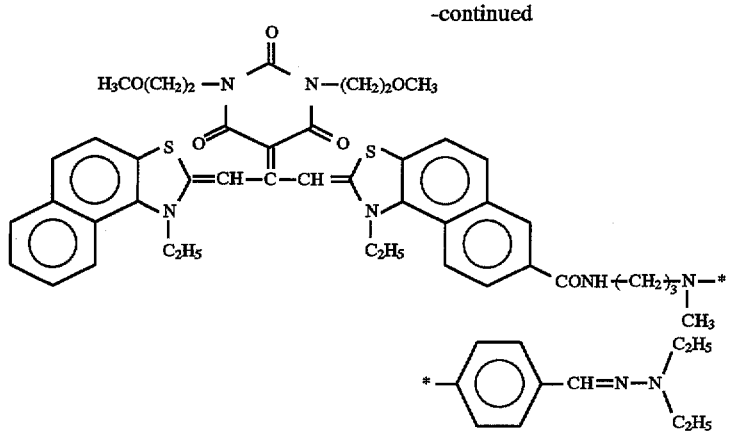
(I-35)
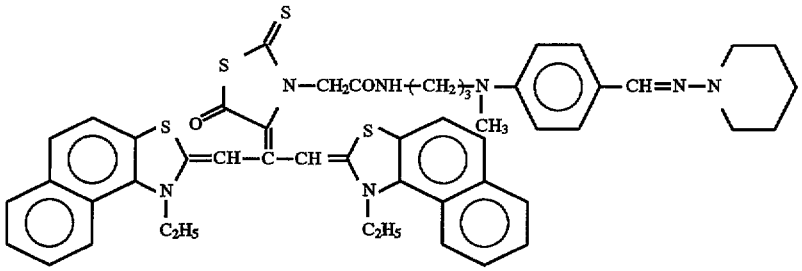
(I-36)
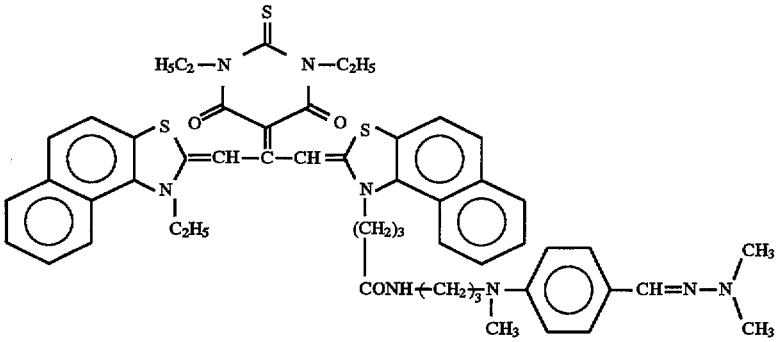
(II-1)
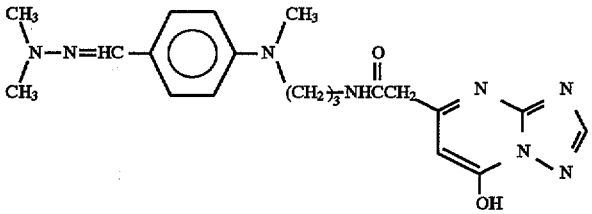
(II-2)
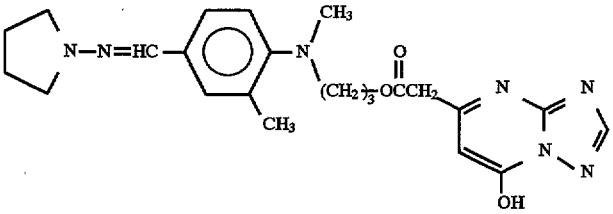
(II-3)
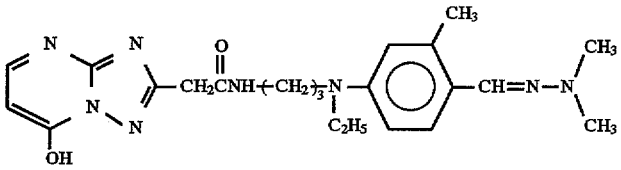

-continued
(II-4)
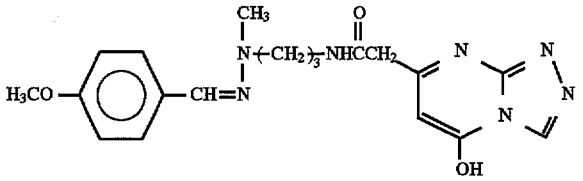
(II-5)
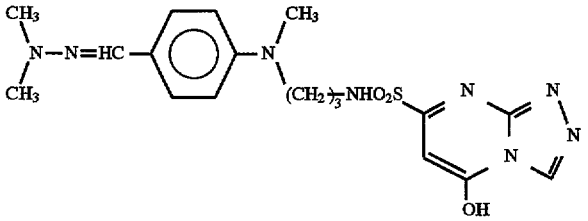
(II-6)
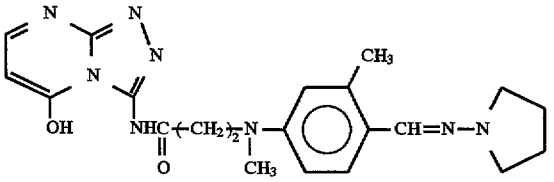
(II-7)
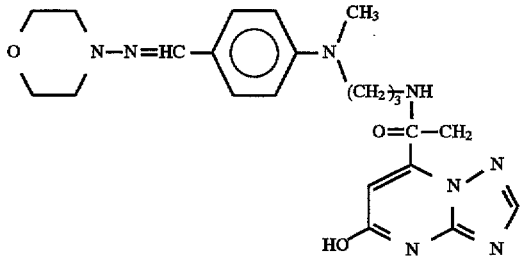
(II-8)
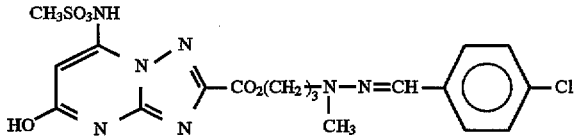
(II-9)
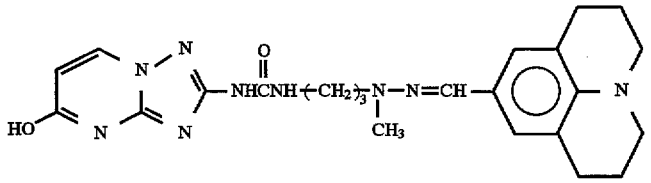
(II-10)
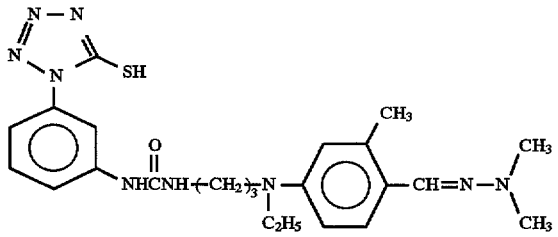

-continued
(II-11)
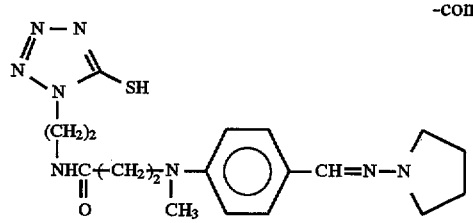
(II-12)
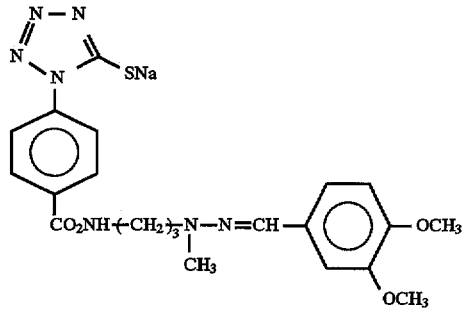
(II-13)
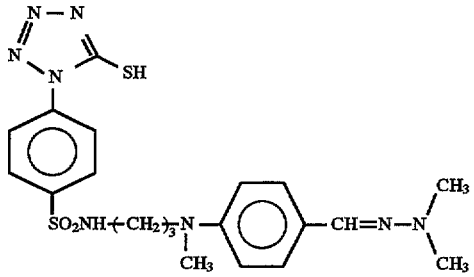
(II-14)
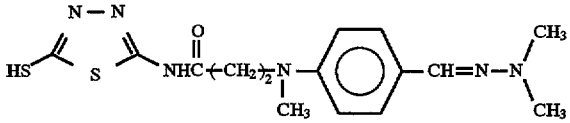
(II-15)
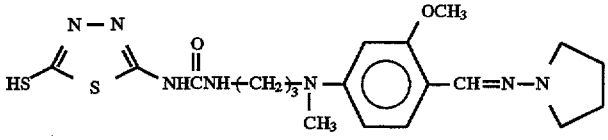
(II-16)
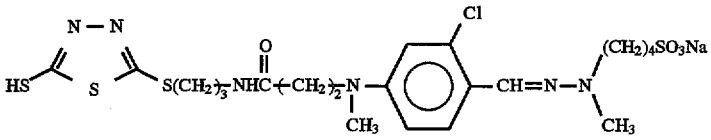
(II-17)
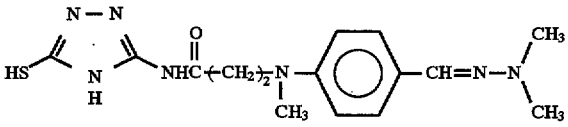
(II-18)
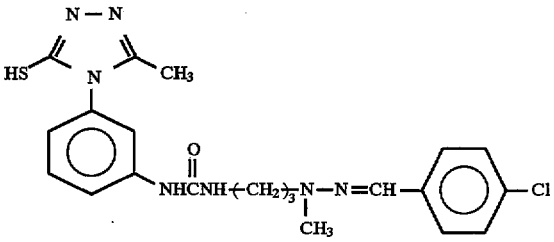

-continued

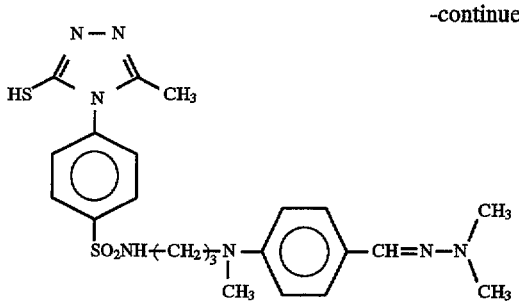

(II-19)

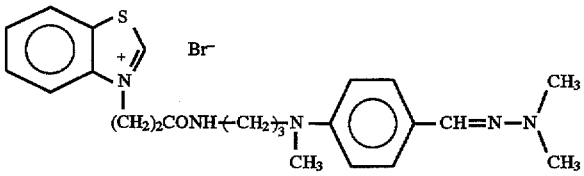

(II-20)

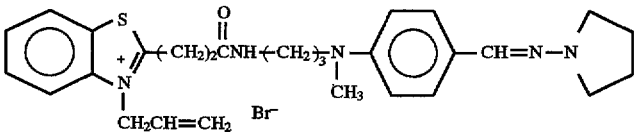

(II-21)

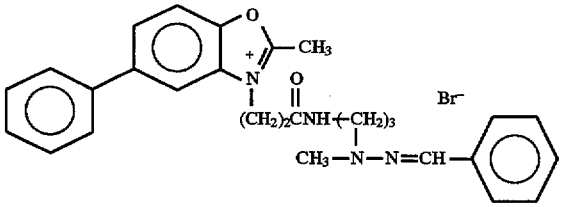

(II-22)

The metallocene compound is described below.

The metallocene compound is a generic name of a bis-cyclopentadienyl metal compound (see, B. Tamamushi, et al. *Iwanami Rikagaku Jiten*, 3rd Ed., *Enlarged Edition*, p. 1335, Iwanami Shoten (1986)).

More preferably, the metallocene compound is a compound when $M_l$ of formula (IA) is Fe, Ti, V, Cr, Co, Ni, Ru Os or Pd.

Still more preferably, it is a compound when $M_1$ is Fe and such a compound is called a ferrocene.

$V_1'$ and $V_2'$ each represents a monovalent substituent.

The substituent may be any but preferred examples thereof include an unsubstituted alkyl group having from 1 to 18, preferably from 1 to 8 carbon atoms (e.g., methyl, ethyl, propyl, isopropyl, butyl, isobutyl, hexyl, octyl, dodecyl, octadecyl, cyclopentyl, cyclopropyl, cyclohexyl), a substituted alkyl group having from 1 to 24, preferably from 1 to 18 carbon atoms {assuming that the substituent is V', the substituent represented by V' is not particularly restricted but examples thereof include a carboxy group, a sulfo group, a cyano group, a halogen atom (e.g., fluorine, chlorine, bromine, iodine), a hydroxy group, an alkoxycarbonyl group having from 2 to 8 carbon atoms (e.g., methoxycarbonyl, ethoxycarbonyl, benzyloxycarbonyl), an aryloxycarbonyl group having from 7 to 12 carbon atoms (e.g., phenoxycarbonyl), an alkoxy group having from 1 to 8 carbon atoms (e.g., methoxy, ethoxy, benzyloxy, phenethyloxy), an aryloxy group having from 6 to 18 carbon atoms (e.g., phenoxy, 4-methylphenoxy, α-naphthoxy), an acyloxy group having from 1 to 8 carbon atoms (e.g., acetyloxy, propionyloxy), an acyl group having from 1 to 8 carbon atoms (e.g., acetyl, propionyl, benzoyl, mesyl), a carbamoyl group having from 1 to 8 carbon atoms (e.g., carbamoyl, N,N-dimethylcarbamoyl, morpholinocarbamoyl, piperidinocarbamoyl), a sulfamoyl group having from 0 to 8 carbon atoms (e.g., sulfamoyl, N,N-dimethylsulfamoyl, morpholinosulfonyl, piperidinosulfonyl), an aryl group having from 6 to 12 carbon atoms (e.g., phenyl, 4-chlorophenyl, 4-methylphenyl, α-naphthyl), a heterocyclic group having from 4 to 12 carbon atoms (e.g., 2-pyridyl, tetrahydrofurfuryl, morpholino, 2-thiopheno), an amino group having from 0 to 12 carbon atoms (e.g., amino, dimethylamino, anilino, diphenylamino), an alkylthio group having from 1 to 12 carbon atoms (e.g., methylthio, ethylthio), an alkylsulfonyl group having from 1 to 8 carbon atoms (e.g., methylsulfonyl, propylsulfonyl), an alkylsulfinyl group having from 1 to 8 carbon atoms (e.g., methylsulfinyl), a nitro group, a phosphoric acid group, an acylamino group having from 1 to 8 carbon atoms (e.g., acetylamino), an ammonium group having from 1 to 8 carbon atoms (e.g., trimethylammonium, tributylammonium), a mercapto group, a hydrazino group (e.g., trimethylhydrazino), a ureido group (e.g., ureido, N,N-dimethylureido), an imide group, an unsaturated hydrocarbon group having from 2 to 16 carbon atoms (e.g., vinyl, ethynyl, 1-cyclohexenyl, benzylidine, benzylidene) and an unsubstituted alkyl group (e.g., methyl); these substituents each may further be substituted by V'}, an unsubstituted aryl group having from 6 to 18, preferably 6 to 12 carbon atoms (e.g., phenyl, 1-naphthyl), a substituted aryl group having from 6 to 18, preferably 6 to 12 carbon atoms (of which substituent includes those described above for V'), an unsubstituted heterocyclic group having from 4 to 18, preferably 4 to 12 carbon atoms (e.g., 2-pyridyl, 2-thiazolyl, morpholino, 2-thiopheno), a substituted heterocyclic group having from 4 to 18, preferably 4 to 12 carbon atoms (of which substituent includes those described above for V') and the above-described substituent represented by V'.

More specific and preferred examples of the substituent include an alkyl group having from 1 to 12 carbon atoms (e.g., methyl, ethyl, carboxymethyl, 2-carboxyethyl, 3-carboxypropyl, 4-carboxybutyl, sulfomethyl, 2-sulfoethyl, 3-sulfopropyl, 4-sulfobutyl, 3-sulfobutyl, 2-hydroxy-3-sulfopropyl, 2-cyanoethyl, 2-chloroethyl, 2-bromoethyl, 2-hydroxyethyl, 3-hydroxypropyl, hydroxymethyl, 2-hydroxyethyl, 4-hydroxybutyl, 2,4-dihydroxybutyl, 2-methoxyethyl, 2-ethoxyethyl, methoxymethyl, 2-ethoxycarbonylethyl, methoxycarbonylmethyl, 2-methoxyethyl, 2-ethoxyethyl, 2-phenoxyethyl, 2-acetyloxyethyl, 2-propionyloxyethyl, 2-acetylethyl, 3-benzoylpropyl, 2-carbamoylethyl, 2-morpholinocarbonylethyl, sulfamoylmethyl, 2-(N,N-dimethylsulfamoyl)ethyl, benzyl, 2-naphthylethyl, 2-(2-pyridyl)ethyl, allyl, 3-aminopropyl, dimethylaminomethyl, 3-dimethylaminopropyl, methylthiomethyl, 2-methylsulfonylethyl, methylsulfinylmethyl, 2-acetylaminoethyl, acetylaminomethyl, trimethylammonimmethyl, 2-mercaptoethyl, 2-trimethylhydrazinoethyl, methylsulfonylcarbamoylmethyl and (2-methoxy)ethoxymethyl), an aryl group having from 6 to 12 carbon atoms (e.g., phenyl, 1-naphthyl, p-chlorophenyl), a heterocyclic group having from 4 to 12 carbon atoms (e.g., 2-pyridyl, 2-thiazolyl, 4-phenyl-2-thiazolyl) and a substituent represented by V' having from 0 to 12 carbon atoms (e.g., carboxy, formyl, acetyl, benzoyl, 3-carboxypropanoyl, 3-hydroxypropanoyl, chlorine, N-phenylcarbamoyl, N-butylcarbamoyl, boric acid, sulfo, cyano, hydroxy, methoxy, methoxycarbonyl, acetyloxy, dimethylamino).

Out of the substituents represented by $V_1'$ or $V_2'$, two substituents adjacent with each other may be combined to form a ring and the ring may be either aliphatic or aromatic. The ring may be substituted, for example, by the above-described substituent V'.

When $n_{1a}$ and $n_{2a}$ a each is 2 or greater, $V_1'$ or $V_2'$ is repeated but they may not be the same.

As the notations for metallocene and ferrocene, the following notations other than those of the present invention are known but the compound indicated is the same.

Notation of the Present Invention

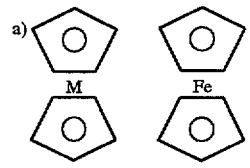

Other Notations

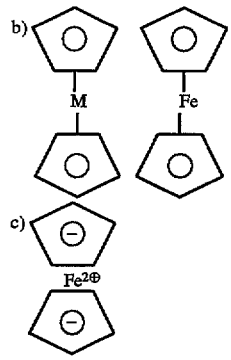

$Q_3$ has the same meaning as $Q_1$ or $Q_2$ described above.

The linking group represented by $Q_3$ may have a valence required. More specifically, $Q_3$ has a valence of $(k_{1c}+1)$ and, for example, when $k_{1c}$ is 1, $Q_3$ is a divalent linking group.

$k_{1c}$ is preferably 1 or 2 and $k_{3c}$ is preferably 1 or 2. More preferably, $k_{1c}$ is 1, $k_{2c}$ is 1 and $k_{3c}$ is 1.

Typical examples of the metallocene compound of the present invention are set forth below, but the present invention is by no means limited to these.

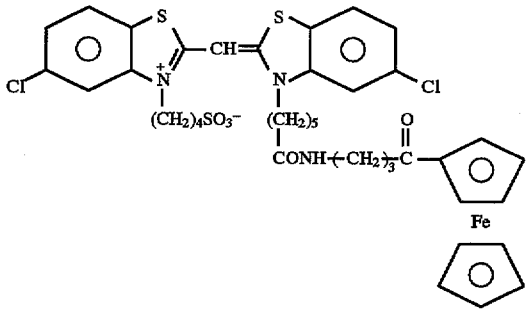

(IA-1)

-continued
(IA-2)
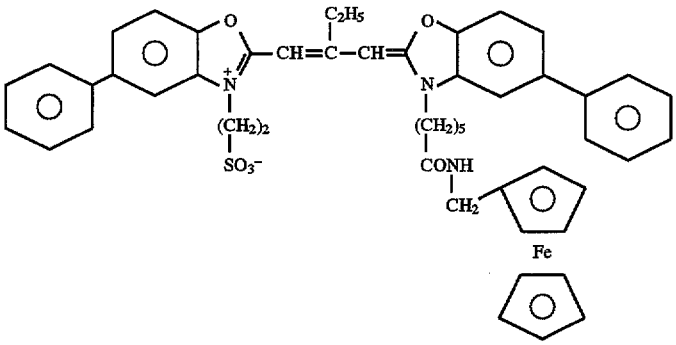
(IA-3)
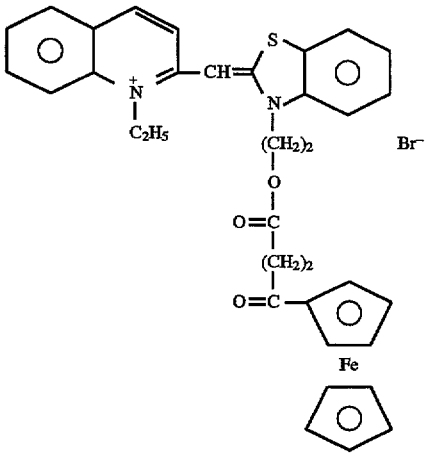
(IA-4)
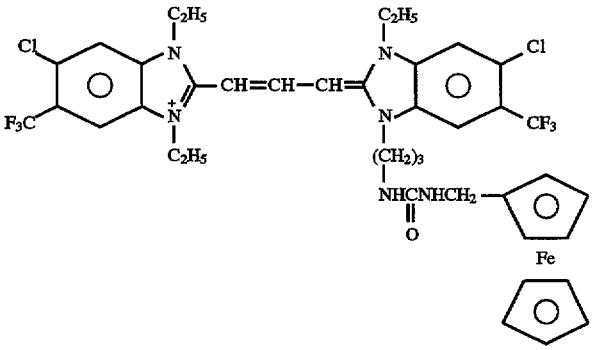
(IA-5)
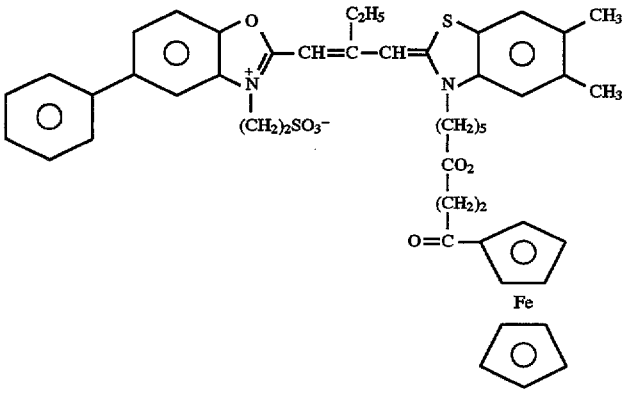

-continued
(IA-6)
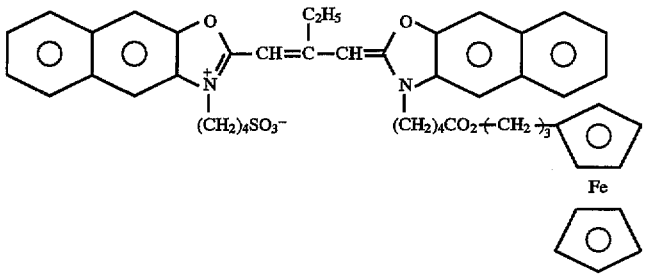
(IA-7)
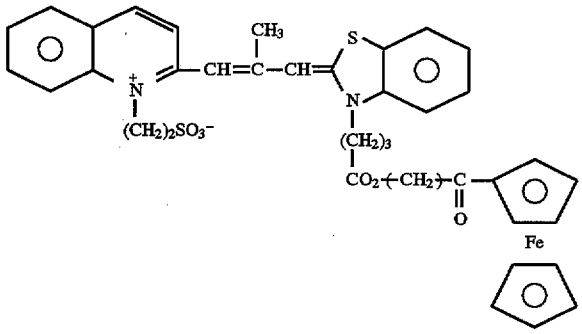
(IA-8)
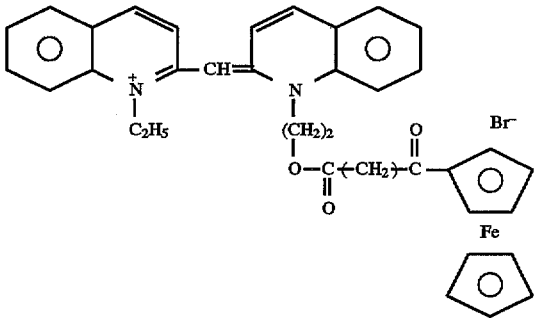
(IA-9)
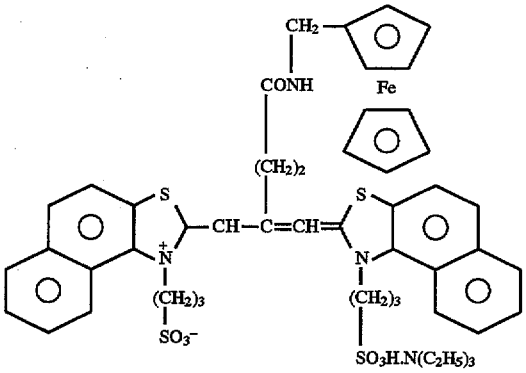
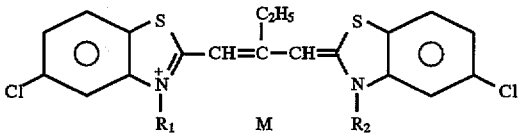

-continued
(IA-10)
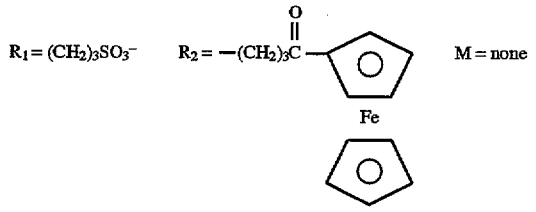
(IA-11)
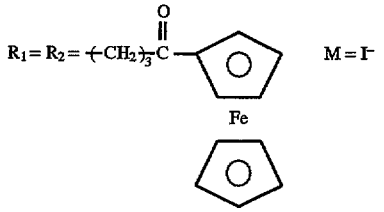
(IA-12)
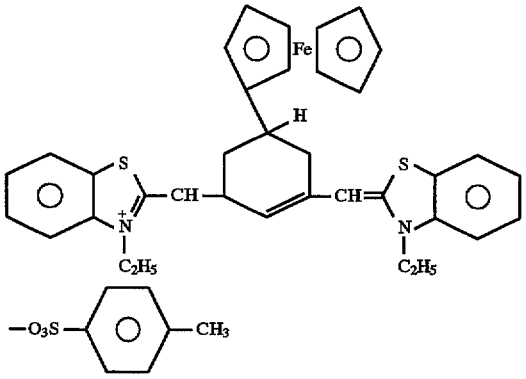
(IA-13)
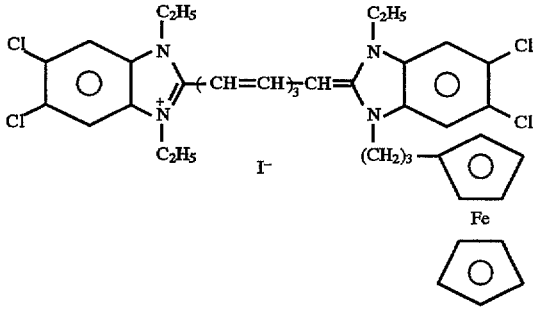
(IA-14)
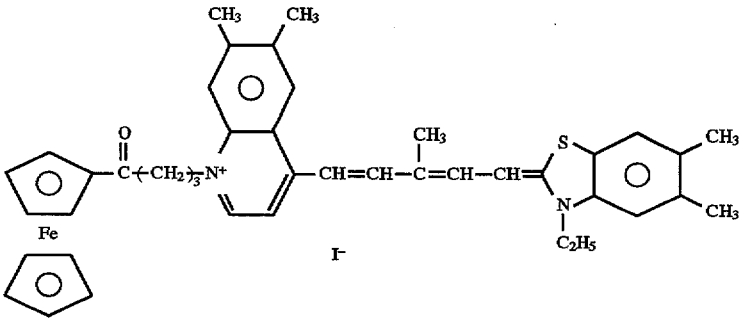

-continued
(IA-15)
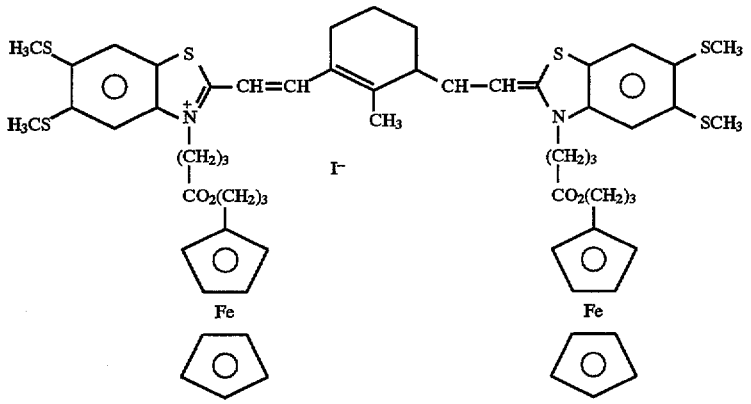
(IA-16)
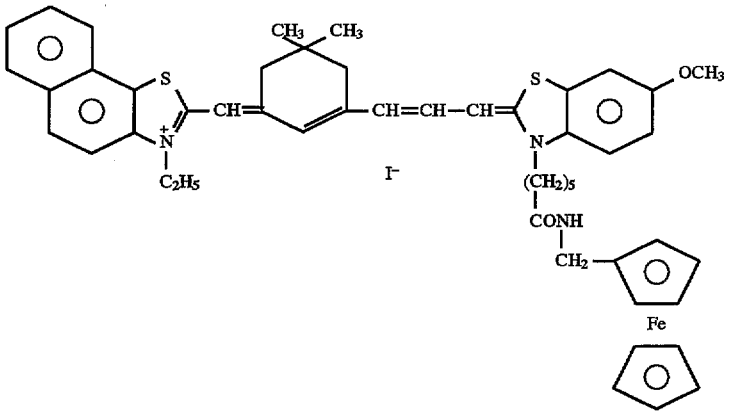
(IA-17)
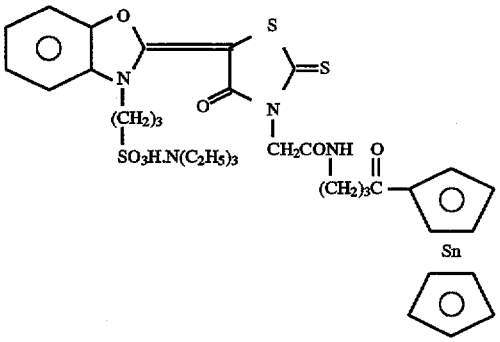
(IA-18)
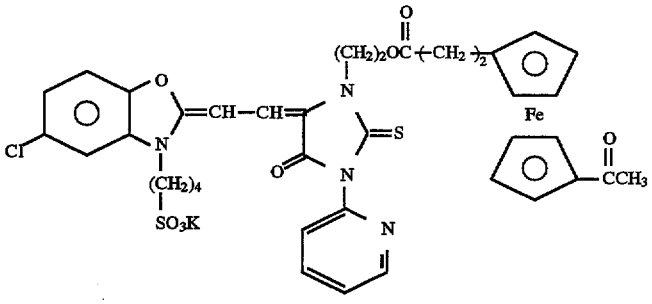

-continued
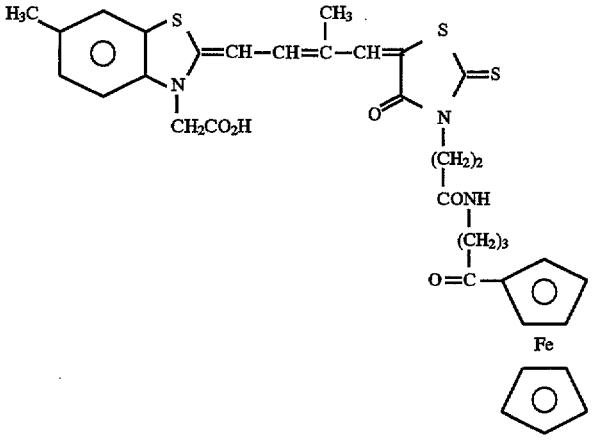
(IA-19)
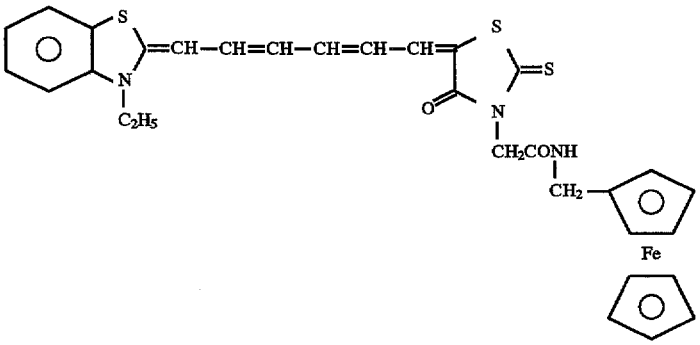
(IA-20)
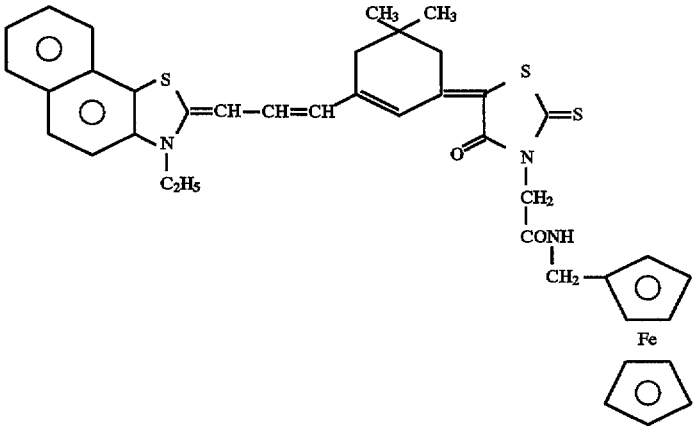
(IA-21)
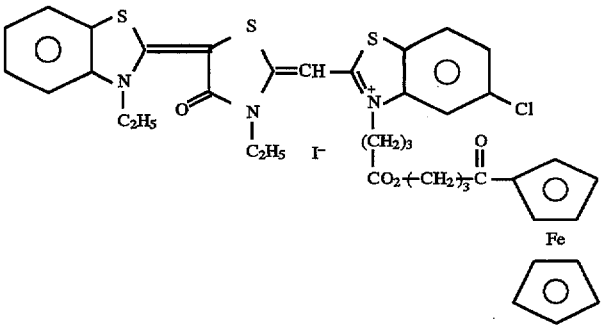
(IA-22)

-continued
(IA-23)
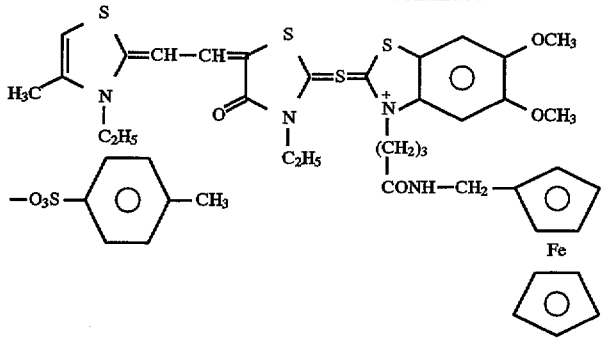
(IA-24)
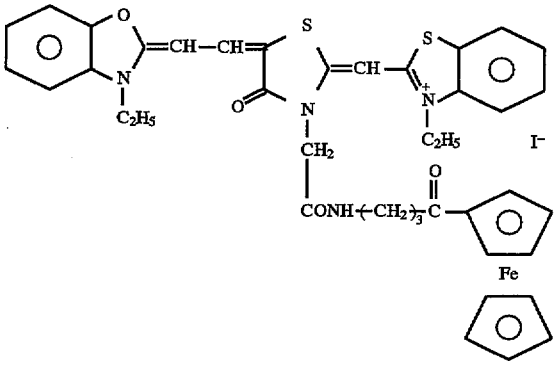
(IA-25)
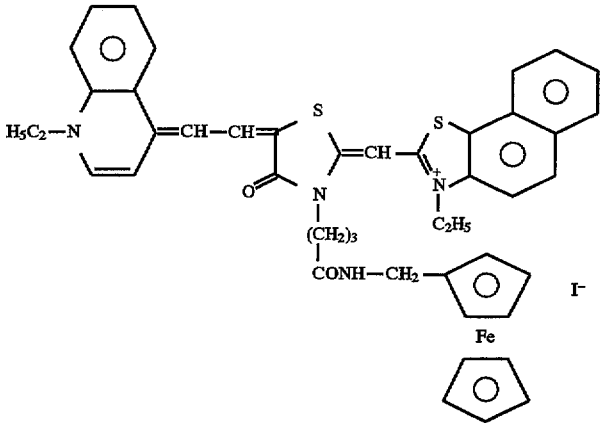
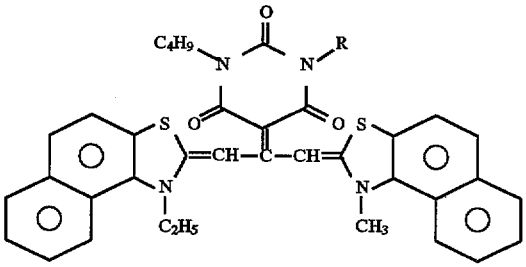
(IA-26)
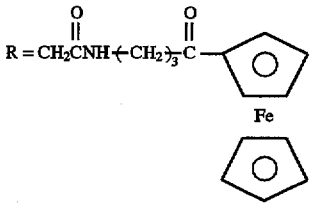

-continued (IA-27)

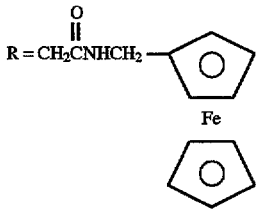

(IA-28)

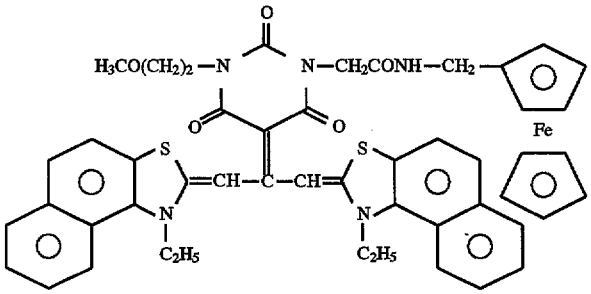

(IA-29)

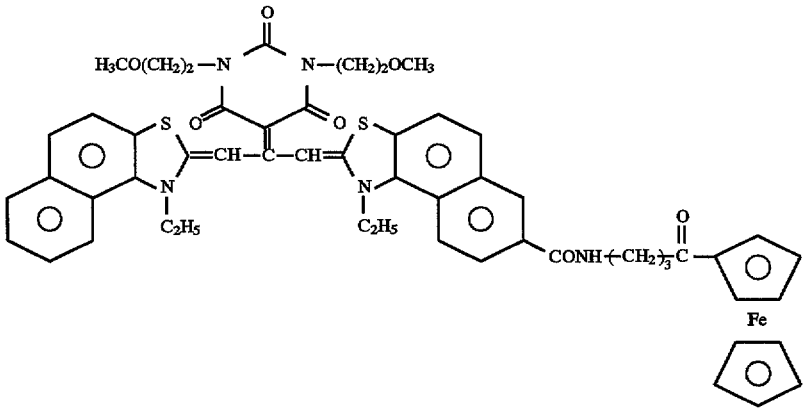

The structure moieties MET of formula (I) and MET' of formula (IA) can be synthesized according to the methods described, for example, in F. M. Hamer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry-*, Chap. 18, Para. 14, pp. 482–515, John Wiley & Sons, New York, London (1977), *Rodd's Chemistry of Carbon Compounds*, 2nd. Ed., Vol. IV, Part B, Chap. 15, pp. 369–422, Elsvier Science Publishing Company Inc., New York (1977) and *Rodd's Chemistry of Carbon Compounds*, 2nd. Ed., Vol. IV, Part B, Chap. 15, pp. 267–296, Elsvier Science Publishing Company Inc., New York (1985).

The hydrazone structure moiety represented by formula (III) can be easily produced by a known method.

More specifically, the moiety can be obtained by condensing a hydrazine, an aldehyde or a ketone with the addition, if desired, of a small amount of an acid (e.g., acetic acid, hydrochloric acid) as a condensing agent.

Specific examples of the production method are described in JP-B-60-34099 and JP-B-60-34100.

The structure moiety Het of formula (II) for use in the present invention is described in and can be produced by referring to U.S. Pat. No. 3,266,897, Belgian Patent 671,402, JP-A-60-138548, JP-A-59-68732; JP-A-59-123838, JP-B-58-9939, JP-A-59-137951, JP-A-57-202531, JP-A-57-164734, JP-A-57-14836, JP-A- 57-116340, U.S. Pat. No. 4,418,140, JP-A-58-95728, JP-A-55-79436, German Patent Application (OLS) Nos. 2,205,029 and 1,962,605, JP-A-55-59463, JP-B-48-18257, JP-B-53-28084, JP-A-53-48723, JP-B-59-52414, JP-A-58-217928, JP-B-49-8334, U.S. Pat. No. 3,598,602 British Patent 965,047, Belgian Patent 737,809, U.S. Pat. No. 3,622,340, JP-A-60-87322, JP-A-57-211142, JP-A-58-158631, JP-A-59-15240, U.S. Pat. No. 3,671,255, JP-B-48-34166, JP-B-48-322112, JP-A-58-221839, JP-B-48-32367, JP-A-60-130731, JP-A-60-122936, JP-A-60-117240, U.S. Pat. No. 3,228,770, JP-B-43-13496, JP-B-43-10256, JP-B-47-8725, JP-B-47-30206, JP-B-47-4417, JP-B-51-25340, British Patent 1,165,075, U.S. Pat. Nos. 3,512,982 and 1,472,845, JP-B-39-22067, JP-B-39-22068, U.S. Pat. Nos. 3,148,067, 3,759,901 and 3,909,268, JP-B-50-40665, JP-B-39-2829, U.S. Pat. No. 3,148,066, JP-B-45-22190, U.S. Pat. No. 1,399,449, British Patent 1,287,284, U.S. Pat. Nos. 3,900,321, 3,655,391 and 3,910,792, British Patent 1,064,805, U.S. Pat. Nos. 3,544,336 and 4,003,746, British Patents 1,344,525 and 972,211, JP-B-43-4136, U.S. Pat. No. 3,140,178, French Patent 2,015,456, U.S. Pat. No. 3,114,637, Belgian Patent 681,359, U.S. Pat. No. 3,220,839, British Patent 1,290,868, U.S. Pat. Nos. 3,137,578, 3,420,670, 2,759,908 and 3,622,340, German Patent Application (OLS) No. 2,501,261, German Patent Publication (DAS) No. 1,772,424, U.S. Pat. No. 3,157,509, French Patent 1,351,234, U.S. Pat. No. 3,630,745, French Patent 2,005,204, German Patent 1,447,796, U.S. Pat. No. 3,915,710, JP-B-49-8334, British Patents 1,021,199 and 919,061, JP-B-46-17513, U.S. Pat. No. 3,202,512, German Patent Application (OLS) No. 2,553,127, JP-A-50-104927, French Patent 1,467,510, U.S. Pat. Nos. 3,449,126, 3,503,936 and 3,576,638, French Patent 2,093,209, British Patent 1,246,311, U.S. Pat. Nos. 3,844,788 and 3,535,115, British Patent 1,161,264, U.S. Pat. Nos. 3,841,878 and 3,615,616, JP-A-48-39039, British Patent 1,249,077, JP-B-48-34166, U.S. Pat. No. 3,671,255, British Patent No. 1,459,160, JP-A-50-6323, British Patent 1,402,819, German Patent Application (OLS) No. 2,031,314, *Research Disclosure* No. 13651, U.S. Pat. Nos. 3,910,791, 3,954,478 and 3,813,249, British Patent 1,387,654, JP-A-57-135945, JP-A-57-96331, JP-A-57-22234, JP-A-59-26731, German Patent Application (OLS) No. 2,217,153, British Patent 1,394,371, British Patents 1,308,777, 1,389,089 and 1,347,544, German Patent 1,107,508, U.S. Pat. No. 3,386,831, British Patent 1,129,623, JP-A-49-14120, JP-B-46-34675, JP-A-50-43923, U.S. Pat. No. 3,642,481, British Patent 1,269,268, U.S. Pat. Nos. 3,128,185, 3,295,981, 3,396,023 and 2,895,827, JP-B-48-38418, JP-A-48-47335, JP-A-50-87028, U.S. Pat. Nos. 3,236,652 and 3,443,951, British Patent 1,065,669, U.S. Pat. Nos. 3,312,552, 3,310,405 and 3,300,312, British Patents 952,162 and 948,442, JP-A-49-120628, JP-B-48-35372, JP-B-47-5315, JP-B-39-18706, JP-B-43-4941 and JP-A-59-34530.

The bond formation reaction including amide bond formation reaction or ester bond formation reaction of (MET) with the moiety $(Q_1)_{k_{2a}}$-(Hyd$_1$) or (Het) with the moiety $(Q_2)_{k_{2b}}$-(Hyd$_2$) can use methods known in the organic chemistry. More specifically, a method where MET or Het is connected to Hyd$_1$ or Hyd$_2$, a method where Hyd$_1$ or Hyd$_2$ is connected to a synthesis raw material or an intermediate of MET or Het and then MET or Het is synthesized or a method where a synthesis raw material or an intermediate of Hyd$_1$ or Hyd$_2$ is connected to the MET or Het moiety and then Hyd$_1$ or Hyd$_2$ is synthesized may be used and these methods may be appropriately selected. The synthesis method for connecting the moieties may be referred to a large number of publications relating to organic synthesis reaction such as *Shin Jikken Kagaku Koza* 14, *Yuki Kagobutsu no Gosei to Han'no*, Vols. I to V, compiled by Nippon Kagaku Kai, Maruzen, Tokyo (1977), Y. Ogata, *Yuki Han'no Ron*, Maruzen, Tokyo (1962), and L. F. Fieser and M. Fieser, *Advanced Organic Chemistry*, Maruzen, Tokyo (1962).

Specific examples thereof are described in Synthesis Examples 1 to 3.

The compound represented by formula (I) or (II) of the present invention may be used individually but it is preferably used in combination with other spectral sensitizing dye. Preferred examples of the dye used in combination include a cyanine dye {a dye having a structure represented by formula (IV) but not substituted by $(Q_1)_{k_{2a}}$-(Hyd$_1$)}, a merocyanine dye {a dye having a structure represented by formula (V) but not substituted by $(Q_1)_{k_{2a}}$-(Hyd$_1$)}, a rhodacyanine dye {a dye having a structure represented by formula (VI) but not substituted by $(Q_1)_{k_{2a}}$-(Hyd$_1$)} and an allopolar dye {a dye having a structure represented by formula (VII) but not substituted by $(Q_1)_{k_{2a}}$-( Hyd$_1$)}. In addition, a hemicyanine dye, an oxonol dye, a hemioxonol dye or a styryl dye may be used.

Most preferably, an allopolar dye having a structure (Hyd$_1$) or a thiacarbocyanine dye having a structure represented by formula (IV) but not substituted by $(Q_1)_{k_{2a}}$-(Hyd$_1$) is used in combination.

The metallocene compound can be easily produced by known methods, for example, by referring to the methods described in D. E. Bublitz, et al., *Organic Reactions*, Vol. 17, pp. 1–154 (1969).

Assuming that MS is a metallocene group, the bond formation reaction including the amide bond formation reaction or the ester bond formation reaction of (MET') with the $(Q_3)_{k_{2c}}$(MS) moiety can use methods known in the organic chemistry. More specifically, a method where MET' is connected to MS, a method where MS is connected to a synthesis raw material or an intermediate of MET' and then MET' is synthesized or a method where a synthesis raw material or an intermediate of MS is connected to the MET' moiety and then MS is synthesized may be used and these methods may be appropriately selected. The synthesis method for connecting the moieties may be referred to a large number of publications relating to organic synthesis reaction such as *Shin Jikken Kagaku Koza* 14, *Yuki Kagobutsu no Gosei to Han'no*, Vols. I to V, compiled by Nippon Kagaku Kai, Maruzen, Tokyo (1977), Y. Ogata, *Yuki Han'no Ron*, Maruzen, Tokyo (1962), and L. F. Fieser and M. Fieser, *Advanced Organic Chemistry*, Maruzen, Tokyo (1962).

Specific examples are described later in Synthesis Examples.

The compound represented by formula (IA) of the present invention may be used individually but it is preferably used in combination with other spectral sensitizing dye. Preferred examples of the dye used in combination include a cyanine dye {a dye having a structure represented by formula (IV) but not substituted by a metallocene compound}, a rhodacyanine dye {a dye having a structure represented by formula (VI) but not substituted by a metallocene compound}, an allopolar dye {a dye having a structure represented by formula (VII) but not substituted by a metallocene compound}. In addition, a hemicyanine dye, an oxonol dye, a hemioxonol dye or a styryl dye may be used.

Most preferably, an allopolar dye having a structure represented by formula (VII) but not substituted by a metallocene compound or a thiacarbocyanine dye having a structure represented by formula (IV) but not substituted by a metallocene compound is used in combination.

In the present invention, a spectral sensitizing dye is preferably used. Examples of the spectral sensitizing dye include any conventionally known dyes such as a cyanine dye, a merocyanine dye, a rhodacyanine dye, an oxonol dye, a hemicyanine dye, a benzylidene dye, a xanthene dye and a styryl dye, and dyes described, for example, in T. H. James *The Theory of the Photographic Process*, 3rd Ed., pp. 198–228, Macmillan (1966).

Preferred are dyes represented by formulae (XI), (XII), (XIII) and (XIV) of JP-A-5-216152 and more preferred are dyes described therein as specific examples of the dye.

The hydrazone compound (represented by formula (I) or (II)), the metallocene compound (represented by formula (IA)) of the present invention or a sensitizing dye for use in the present invention may be incorporated into a silver halide emulsion of the present invention by dispersing it directly in the emulsion or by dissolving it in a sole or mixed solvent of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide and then adding the solution to the emulsion.

Also, a method where a dye or the like is dissolved in a volatile organic solvent, the solution is dispersed in water or hydrophilic colloid and the dispersion is added to the emulsion as described in U.S. Pat. No. 3,469,987, a method where a water-insoluble dye or the like is dispersed in a water-soluble solvent without dissolving it therein and the dispersion is added to the emulsion as described in JP-B-46-24185, a method where a dye is dissolved in an acid and the solution is added to the emulsion or a dye is formulated into an aqueous solution in the presence of an acid or a base and the aqueous solution is added to the emulsion as described in JP-B-44-23389, JP-B-44-27555 and JP-B-57-22091, a method where an aqueous solution or a colloid dispersion is prepared in the presence of a surface active agent and the solution or dispersion is added to the emulsion as described in U.S. Pat. Nos. 3,822,135 and 4,006,026, a method where a dye or the like is dispersed directly in a hydrophilic colloid and the dispersion is added to the emulsion as described in JP-A-53-102733 and JP-A-58-105141, or a method where a dye is dissolved using a compound capable of redox and the solution is added to the emulsion as described in JP-A-51-74624 may be used.

Further, an ultrasonic wave may be used in the dissolution.

The sensitizing dye for use in the present invention or the hydrazone compound or metallocene compound of the present invention may be added to the silver halide emulsion of the present invention in any step known to be useful during the preparation of emulsion. For example, the dye or the compound may be added during grain formation of silver halide and/or before desalting or during desalting and/or between after desalting and before initiation of chemical ripening as disclosed in U.S. Pat. Nos. 2,735,766, 3,628,960, 4,183,756 and 4,225,666, JP-A-58-184142 and JP-A-60-196749, or the dye or the compound may be added at any time or step before coating of the emulsion such as immediately before or during chemical ripening or after chemical ripening but before coating as described in JP-A-58-113920. Also, the same compound only or in combination with a compound having different structure may be added in installments, for example, a part during grain formation and the remnant during chemical ripening dr after the completion of chemical ripening, or a part before or during chemical ripening and the remnant after the completion of chemical ripening, and the kind of compounds added in installments or the combination of compounds may be changed.

The addition amount of the sensitizing dye for use in the present invention varies depending upon the shape or size of a silver halide grain but it is preferably from $4\times10^{-8}$ to $8\times10^{-2}$ mol per mol of silver halide.

The hydrazone compound or metallocene compound of the present invention is incorporated into the silver halide emulsion, irrespective of whether it is added before or after the addition of the sensitizing dye, in an amount of preferably from $1\times10^{-9}$ to $5\times10^{-1}$, more preferably from $1\times10^{-8}$ to $2\times10^{-2}$ mol per mol of silver halide.

The ratio (molar ratio) of the sensitizing dye to the hydrazone compound of the present invention may be freely selected but the (sensitizing dye/hydrazone compound) is from 1,000/1 to 1/1,000, more preferably from 100/1 to 1/10.

The ratio (molar ratio) of the sensitizing dye to the metallocene compound of the present invention may be freely selected but the (sensitizing dye/metallocene compound) is from 1,000/1 to 1/1,000, more preferably from 100/1 to 1/10.

In combination with a sensitizing dye, a dye which itself has no spectral sensitization effect or a compound which absorbs substantially no visible dye, but which is a compound exhibiting supersensitization may be incorporated into the emulsion. Examples of the dye or compound include an aminostyryl compound substituted by a nitrogen-containing heterocyclic group (those described, for example, in U.S. Pat. Nos. 2,933,390 and 3,635,721), an aromatic organic acid formaldehyde condensate (those described, for example, in U.S. Pat. No. 3,743,510), a cadmium salt and an azaindene compound. Combinations described in U.S. Pat. Nos. 3,615,613, 3,615,641, 3,617,295 and 3,635,721 are particularly useful.

The production process of a silver halide emulsion is roughly classified into grain formation, desalting and chemical sensitization. The grain formation is divided into nucleation, ripening and growing. These steps are not conducted monotonously but the order of processes may be reversed or a process may be conducted repeatedly. To conduct reduction sensitization during the production process of a silver halide emulsion basically means that it may be conducted at any step during the process. The reduction sensitization may be conducted at the nucleation or physical ripening step effected in the initial stage of grain formation or at the grain growth step, or it may be conducted in advance of chemical sensitization other than reduction sensitization or after the chemical sensitization. When chemical sensitization using gold sensitization in combination is conducted, the reduction sensitization is preferably conducted prior to the chemical sensitization so as not to generate adverse fog. Most preferably, the reduction sensitization is conducted during the growth of silver halide grains. The term "to conduct reduction sensitization during the growth of silver halide grains" as used herein includes a method where the reduction sensitization is conducted in such a state that silver halide grains are growing by physical ripening or by the addition of a water-soluble silver salt and an aqueous alkali halide or a method where the reduction sensitization is conducted in such a state that the growth on the way of growing is once stopped and then the growth is again started.

The reduction sensitization of the present invention may be selected from a method where a known reducing agent is added to a silver halide emulsion, a method where the growth or ripening is effected in a low pAg atmosphere at a pAg of from 1 to 7 called silver ripening and a method where the growth or ripening is effected in a high pH atmosphere at a pH of from 8 to 11 called high pH ripening. Two or more methods may also be used in combination.

The method where a reduction sensitizer is added is preferred from the standpoint that the level of reduction sensitization can be delicately controlled.

Examples of known reduction sensitizers include a stannous salt, an amine or polyamine acid, a hydrazine derivative, a formamidinesulfinic acid, a silane compound and a borane compound. In the present invention, one selected from these known compounds may be used or two or more compounds may also be used in combination. Preferred compounds as a reduction sensitizer are stannous chloride, thiourea dioxide and dimethylamineborane. The addition amount of the reduction sensitizer depends upon the production conditions of an emulsion and should be properly selected but it is suitably from $10^{-7}$ to $10^{-3}$ mol per mol of silver halide.

An ascorbic acid or a derivative thereof may also be used as a reduction sensitizer of the present invention.

Specific examples of the ascorbic acid and a derivative thereof (hereinafter collectively referred to as an "ascorbic acid compound") include the following compounds:

(A-1) L-Ascorbic acid
(A-2) Sodium L-ascorbate
(A-3) Potassium L-ascorbate
(A-4) DL-Ascorbic acid
(A-5) Sodium D-ascorbate
(A-6) L-Ascorbic acid-6-acetate
(A-7) L-Ascorbic acid-6-palmitate
(A-8) L-Ascorbic acid-6-benzoate (A-9) L-Ascorbic acid-5,6-diacetate (A-10) L-Ascorbic acid-5,6-O -isopropylidene The ascorbic acid compound for use in the present invention is preferably used in a large amount as compared with the addition amount preferred for the conventional reduction sensitizer. For example, JP-B-57-33572 describes that "the amount of a reducing agent does not usually exceed $0.75\times10^{-2}$ milli-equivalent per g of silver ion ($8\times10^{-4}$ mol/AgX mol). The addition amount of from 0.1 to 10 mg per kg of silver nitrate (in terms of an ascorbic acid, from $10^{-7}$ to $10^{-5}$ mol/AgX mol) is effective in many cases." (The conversion value is calculated by the present inventors.) U.S. Pat. No. 2,487,850 describes that "the addition amount of a tin compound which can be used as a reduction sensitizer is from $1\times10^{-7}$ to $44\times10^{-6}$ mol/AgX mol". Further, JP-A-57-179835 describes that the addition amount of thiourea dioxide is preferably from about 0.01 to about 2 mg per mol of silver halide and the addition amount of stannous chloride is preferably from about 0.01 to about 3 mg per mol of silver halide. The addition amount of the ascorbic acid used in the present invention varies depending upon various factors such as grain size and halogen composition of the emulsion and the temperature, pH and pAg at the preparation of emulsion, but it is preferably from $5\times10^{-5}$ to $1\times10^{-1}$ mol, more preferably from $5\times10^{-4}$ to $1\times10^{-2}$ mol, particularly preferably from $1\times10^{-3}$ to $1\times10^{-2}$ mol, per mol of silver halide.

The reduction sensitizer is dissolved in a solvent such as water, alcohol, glycols, ketones, esters or amides and then added during grain formation or before or after chemical sensitization. The addition time ma be any step during the production process of the emulsion but it is preferably added during grain growth. The reduction sensitizer may be previously added to a reaction vessel but preferably added thereto at a proper time during grain formation. The reduction sensitizer may also be previously added to an aqueous solution of a water-soluble silver salt or a water-soluble alkali halide to effect grain formation using the aqueous solution. Further, it is also a preferred method to add a reduction sensitizer solution in several installments or to continuously add it over a long period of time, accompanying grain formation.

An oxidizing agent for silver is preferably used during the production process of an emulsion of the present invention. The oxidizing agent for silver as used herein means a compound capable of acting on silver metal to convert it into silver ion. In particular, a compound which converts very fine silver grains by-produced during grain formation or chemical sensitization of silver halide emulsion into silver ion is useful. The silver ion produced here may be in the form of a difficultly water-soluble silver salt such as silver halide, silver sulfide or silver selenide or in the form of an easily water-soluble silver salt such as silver nitrate. The oxidizing agent for silver may be either inorganic or organic. Examples of the inorganic oxidizing agent include ozone, a hydrogen peroxide or an adduct thereof (e.g., $NaBO_2\cdot H_2O_2\cdot 3H_2O$, $2NaCO_3\cdot 3H_2O_2$, $Na_4P_2O_7\cdot 2H_2O_2$, $2Na_2SO_4\cdot H_2O_2\cdot 2H_2O$),a peroxy acid salt (e.g., $K_2S_2O_8$, $K_2C_2O_6$, $K_2P_2O_8$), a peroxy complex compound (e.g., $K_2[Ti(O_2)C_2O_4]\cdot 3H_2O$, $4K_2SO_4\cdot Ti(O_2)OH\cdot SO_4\cdot SO_4\cdot 2H_2O$, $Na_3[VO(O_2)(C_2H_4)_2\cdot 6H_2O)$, a permanganate (e.g., $KMnO_4$), an oxyacid salt such as a chromate (e.g., $K_2Cr_2O_7$), a halogen element such as iodine and bromine, a perhalogenic salt (e.g., potassium periodate), a salt of high-valence metal (e.g., potassium hexanocyanoferrate) and a thiosulfonate.

Examples of the organic oxidizing agent include quinones such as p-quinone, organic peroxides such as peracetic acid and perbenzoic acid, and active halogen-releasing compounds (e.g., N-bromosuccinimide, chloramine-T, chloramine-B).

Preferred as the oxidizing agent in the present invention are an inorganic oxide such as ozone, a hydrogen peroxide or an adduct thereof, a halogen element and a thio-sulfonate and an organic oxide such as quinones. The oxidizing agent for silver is preferably used in combination with the above-described reduction sensitization. A method where an oxidizing agent is used and then reduction sensitization is conducted, a method reverse thereto or a method where the use of an oxidizing agent and the reduction sensitization concur may be appropriately selected. These methods may also be selected and used during grain formation or chemical sensitization.

The silver halide photographic material of the present invention preferably contains at least one compound selected from the compounds represented by the following formulae (XX), (XXI) and (XXII):

$$R_{101}—SO_2S—M_{101} \quad (XX)$$

$$R_{101}—SO_2S—R_{102} \quad (XXI)$$

$$R_{101}—SO_2S—(E)_a—SSO_2—R_{103} \quad (XXII)$$

wherein $R_{101}$, $R_{102}$ and $R_{103}$ each represents an aliphatic group, an aromatic group or a heterocyclic group, $M_{101}$ represents a cation, E represents a divalent linking group and a represents 0 or 1.

The compounds represented by formulae (XX), (XXI) and (XXII) are described below in greater detail.

$R_{101}$, $R_{102}$ and $R_{103}$ each preferably represents an alkyl group, an aryl group or a heterocyclic group.

The aliphatic group represented by $R_{101}$, $R_{102}$ or $R_{103}$ is preferably an alkyl group having from 1 to 22 carbon atoms, an alkenyl group having from 2 to 22 carbon atoms or an alkynyl group, which may have a substituent. Examples of the alkyl group include a methyl group, an ethyl group, a propyl group, a butyl group, a pentyl group, a hexyl group, an octyl group, a 2-ethylhexyl group, a decyl group, a dodecyl group, a hexadecyl group, an octadecyl group, a cyclohexyl group, an isopropyl group and a t-butyl group.

Examples of the alkenyl group include an allyl group and a butenyl group.

Examples of the alkynyl group include propargyl and butynyl.

The aromatic group represented by $R_{101}$, $R_{102}$ or $R_{103}$ is preferably an aromatic group having from 6 to 20 carbon atoms and examples thereof include a phenyl group and a naphthyl group, which may be substituted.

The heterocyclic group represented by $R_{101}$, $R_{102}$ or $R_{103}$ is preferably a 3-, 4-, 5-, 6-, 7-, 8-, 9-, 10-, 11-, 12-, 13-, 14- or 15-membered heterocyclic group having at least one element selected from nitrogen, oxygen, sulfur, selenium and tellurium and examples thereof include a pyrrolidine ring, a piperidine ring, a pyridine ring, a tetrahydrofuran ring, a thiophene ring, an oxazole ring, a thiazole, ring, an imidazole ring, a benzothiazole ring, a benzoxazole ring, a benzimidazole ring, a selenazole ring, a benzoselenazole ring, a tellurazole ring, a triazole ring, a benzotriazole ring, a tetrazole ring, an oxadiazole ring and a thiadiazole ring.

Examples of the substituent for $R_{101}$, $R_{102}$ or $R_{103}$ include an alkyl group (e.g., methyl, ethyl, hexyl), an alkoxy group (e.g., methoxy, ethoxy, octyloxy), an aryl group (e.g., phenyl, naphthyl, tolyl), a hydroxy group, a halogen atom (e.g., fluorine, chlorine, bromine, iodine), an aryloxy group (e.g., phenoxy), an alkylthio group (e.g., methylthio, butylthio), an arylthio group (e.g., phenylthio), an acyl group (e.g., acetyl, propionyl, butyryl, valeryl), a sulfonyl group (e.g., methylsulfonyl, phenylsulfonyl), an acylamino group (e.g., acetylamino, benzamino), a sulfonylamino group (e.g., methanesulfonylamino, benzenesulfonylamino), an acyloxy group (e.g., acetoxy, benzoxy), a carboxyl group, a cyano group, a sulfo group and an amino group.

E is preferably a divalent aliphatic group or a divalent aromatic group. Examples of the divalent aliphatic group represented by E include $-(CH_2)_n-$ (n=1 to 12),

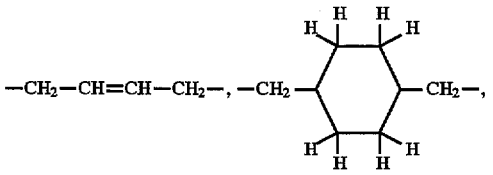

$-CH_2C\equiv C-CH_2-$ and a xylylene group. Examples of the divalent aromatic group represented by E include a phenylene group and a naphthylene group.

These substituents may further be substituted by the above-described substituent represented by V.

$M_{101}$ is preferably a metal ion or an organic cation. Examples of the metal ion include a lithium ion, a sodium ion and a potassium ion. Examples of the organic cation include an ammonium ion (e.g., ammonium, tetramethylammonium, tetrabutylammonium), a phosphonium ion (e.g., tetraphenylphosphonium) and a guanidine group.

Specific examples of the compounds represented by formulae (XX), (XXI) and (XXII) are set forth below, but the present invention is by no means limited thereto.

$CH_3SO_2SNa$ (XX-1)

$C_2H_5SO_2SNa$ (XX-2)

$C_3H_7SO_2SK$ (XX-3)

$C_4H_9SO_2SLi$ (XX-4)

$C_6H_{13}SO_2SNa$ (XX-5)

$C_8H_{17}SO_2SNa$ (XX-6)

$CH_3(CH_2)_3CH(C_2H_5)CH_2SO_2S.NH_4$ (XX-7)

$C_{10}H_{21}SO_2SNa$ (XX-8)

$C_{12}H_{25}SO_2SNa$ (XX-9)

$C_{16}H_{33}SO_2SNa$ (XX-10)

$(CH_3)_2CH-SO_2SK$ (XX-11)

$(t)C_4H_9SO_2SNa$ (XX-12)

$CH_3OCH_2CH_2SO_2S.Na$ (XX-13)

-continued

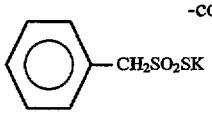

(XX-14)

$CH_2=CHCH_2SO_2SNa$ (XX-15)

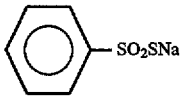

(XX-16)

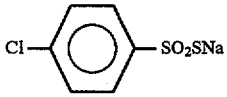

(XX-17)

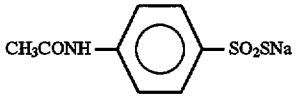

(XX-18)

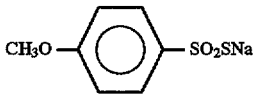

(XX-19)

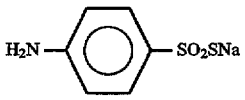

(XX-20)

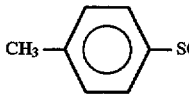

(XX-21)

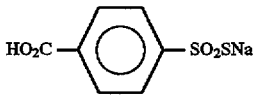

(XX-22)

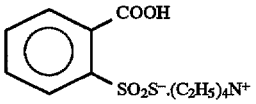

(XX-23)

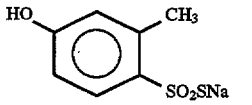

(XX-24)

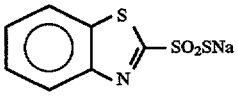

(XX-25)

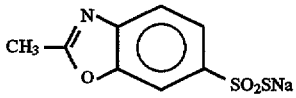

(XX-26)

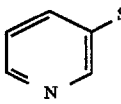

(XX-27)

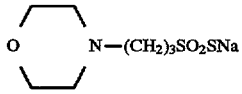

(XX-28)

$KSSO_2(CH_2)_2SO_2SK$ (XX-29)

$NaSSO_2(CH_2)_4SO_2SNa$ (XX-30)

-continued
$NaSSO_2(CH_2)_4S(CH_2)_4SO_2SNa$ (XX-31)
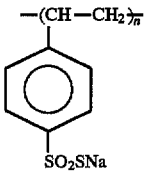
(XX-32)
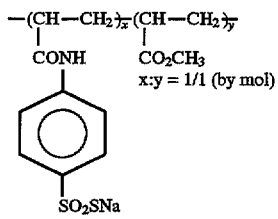
(XX-33)
x:y = 1/1 (by mol)
$C_2H_5SO_2S-CH_3$ (XXI-1)
$C_8H_{17}SO_2SCH_2CH_3$ (XXI-2)
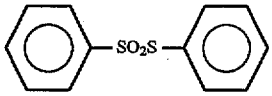
(XXI-3)
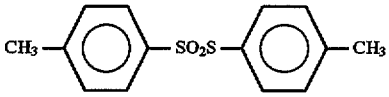
(XXI-4)
$C_2H_5SO_2SCH_2CH_2CN$ (XXI-5)
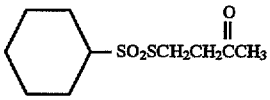
(XXI-6)
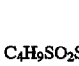
$C_4H_9SO_2SCHCH_2CN$ (XXI-7)
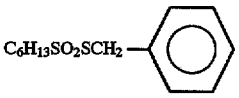
(XXI-8)
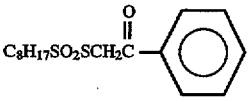
(XXI-9)
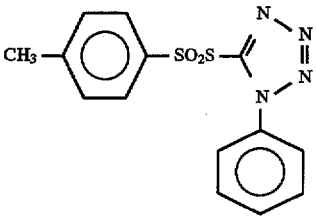
(XXI-10)
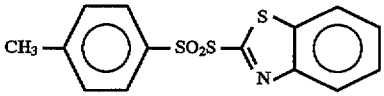
(XXI-11)
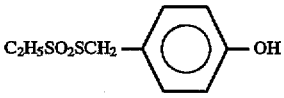
(XXI-12)
-continued
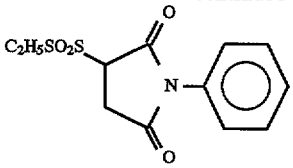
(XXI-13)
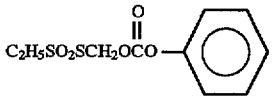
(XXI-14)
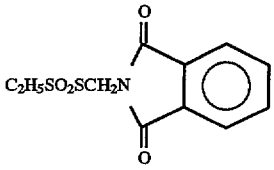
(XXI-15)
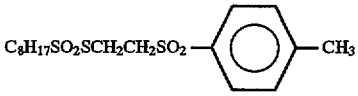
(XXI-16)
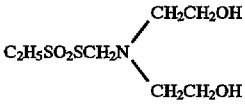
(XXI-17)
$C_2H_5SO_2SCH_2CH_2CH_2CH_2OH$ (XXI-18)
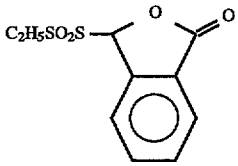
(XXI-19)
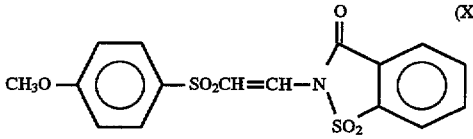
(XXI-20)
$CH_3SSO_2(CH_2)_4SO_2SCH_3$ (XXI-21)
$CH_3SSO_2(CH_2)_2SO_2SCH_3$ (XXI-22)
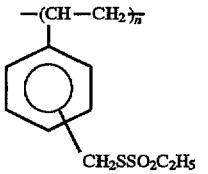
(XXI-23)
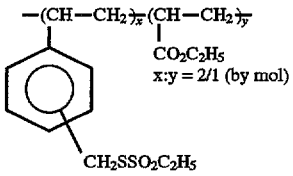
(XXI-24)
x:y = 2/1 (by mol)
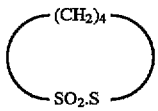
(XXI-25)

-continued

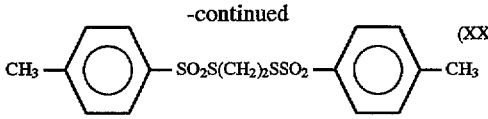

(XXII-1)

$C_2H_5SO_2SCH_2CH_2SO_2CH_2CH_2SSO_2C_2H_5$ (XXII-2)

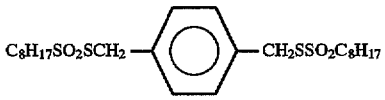

(XXII-3)

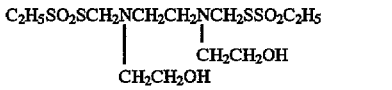

(XXII-4)

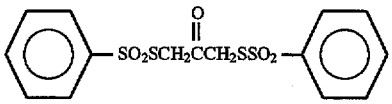

(XXII-5)

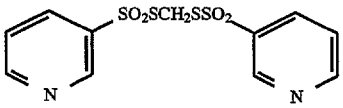

(XXII-6)

$C_2H_5SO_2SSSO_2C_2H_5$ (XXII-7)

$(n)C_3H_7SO_2SSSO_2C_3H_7(n)$ (XXII-8)

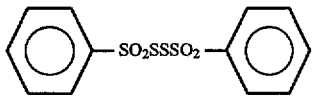

(XXII-9)

The compound represented by formula (XX) can be easily synthesized by the methods described in JP-A-54-1019 and British Patent 972,211.

The compound represented by formula (XX), (XXI) or (XXII) is preferably added in an amount of from $10^{-7}$ to $10^{-1}$ mol, more preferably from $10^{-6}$ to $10^{-2}$, particularly preferably from $10^{-5}$ to $10^{-3}$ mol, per mol of silver halide.

The compound represented by formula (XX), (XXI) or (XXII) is added during the production process by a method commonly used for adding additives to a photographic emulsion. For example, a water-soluble compound is formulated into an aqueous solution at an appropriate concentration or a water-insoluble or difficultly water-solution compound is dissolved in a solvent free from adverse effects on photographic properties selected from organic solvents miscible with water, such as alcohols, glycols, ketones, esters or amides, and the aqueous solution or the solution is added to the photographic emulsion.

The compound represented by formula (XX), (XXI) or (XXII) may be added at any stage during the production such as during grain formation of silver halide emulsion or before or after chemical sensitization of the emulsion, but it is preferably added before or when reduction sensitization is conducted, more preferably during growth of grains.

The compound may be added in advance to a reaction vessel but it is preferably added at an appropriate time during grain formation. The compound represented by formula (XX), (XXI) or (XXII) may also be previously added to an aqueous solution of a water-soluble silver salt or a water-soluble alkali halide to effect grain formation using the aqueous solution. Further, it is also a preferred method to add the compound represented by formula (XX), (XXI) or (XXII) in several installments or to continuously add it over a long period of time.

Among the compounds represented by formula (XX), (XXI) or (XXII), most preferred in the present invention is the compound represented by formula (XX).

The emulsion of the present invention comprises tabular silver halide grains preferably having an aspect ratio of 3 or more and more preferably having an average aspect ratio of from 3 to less than 8. The term "tabular grain" as used herein is a generic term for grains having one twin plane or two or more parallel twin planes. The twin plane indicates a {111} face when ions at all lattice points are in an enantiomeric relation between two sides of the {111} face. When observed the grain from the upside thereof, the tabular grain is in a triangular or hexagonal form or the circular form as a rounded triangle or hexagon and the triangular, hexagonal and circular grain have triangular, hexagonal and circular outer surfaces in parallel with each other, respectively.

The aspect ratio of the tabular grain of the present invention means a value determined on tabular grains having a grain diameter of 0.1 μm or more and is obtained by dividing the diameter of each grain by the thickness. The grain thickness can be easily determined by depositing a metal onto a grain together with a latex for control from the slantwise direction, measuring the length of a shadow thereof on a microphotograph and calculating therefrom by referring to the shadow length of the latex.

The diameter as used in the present invention means a diameter of a circle having an area equal to the projected area of a parallel outer surface of a grain.

The projected area of a grain can be obtained by measuring the area on a microphotograph and then correcting the magnification at the photographing.

The diameter of the tabular grain is preferably from 0.15 to 5.0 μm. The thickness of the tabular grain is preferably from 0.05 to 1.0 μm.

The average aspect ratio can be obtained as an arithmetic mean of aspect ratios of respective grains measured on at least 100 silver halide grains. The average aspect ratio can also be obtained as a ratio of the average diameter to the average thickness of grains.

In the emulsion of the present invention, tabular silver halide grains have an aspect ratio of 3 or more, preferably an average aspect ratio of from 3 to less than 8, and it is preferred that tabular silver halide grains satisfying the above-described conditions occupy 60% or more of the total projected area.

The population of tabular grains in the total projected area is preferably 60% or more, more preferably 80% or more.

By using monodisperse tabular grains, further preferred effects may be obtained. With respect to the structure and the production method of the monodisperse tabular grain, for example, JP-A-63-151618 may be referred to, but briefly stated here on the shape thereof, 70% or more of the total projected area of silver halide grains are occupied by tabular silver halide in a hexagonal form having a ratio of (the length of a side having the longest length) to (the length of a side having the shortest length) of 2 or less and at the same time, having two parallel planes as the outer surface, and the hexagonal tabular silver halide grains are monodisperse having a coefficient of variation in the grain size distribution (namely, a value obtained by dividing the distribution (standard deviation) in the grain size expressed by the diameter in terms of a circle of the projected area of a grain by the average grain size) of 20% or less.

The emulsion of the present invention preferably has dislocation lines and the dislocation lines can be observed by a direct method using a transmission type electron microscope at low temperature described, for example, in J. F. Hamilton, *Phot. Sci. Eng.*, 11, 57 (1967) and T. Shiozawa, *J. Soc. Phot. Sci. Japan*, 35,213 (1972). More specifically, a silver halide grain taken out from an emulsion carefully so as not to apply such a pressure as to cause generation of dislocation lines on the grain is placed on a mesh for observation by an electron microscope and observed according to a transmission method while laying the sample in a cool state so as to prevent any damage (e.g., print out) by the electron beams. At this time, as the thickness of the grain is thicker, the electron beams become hard to be transmitted and therefore, a high-voltage type (200 kV or more to the grain having a thickness of 0.25 μm) electron microscope is preferably used to effect the observation more clearly. The site and the number of dislocation lines on each grain can be determined by observing the grain from the direction perpendicular to the major plane on the photograph of the grain obtained as above.

The number of dislocation lines is 10 or more on average, more preferably 20 or more on average per one grain. In the case when the dislocation lines are present crowdedly or intersected with each other on the observation, the number of dislocation lines per one grain cannot be accurately counted in some cases. However, even in these cases, an approximate number such as about 10, 20 or 30 lines can be counted and it is possible to discriminate the grain from those having only several dislocation lines. The average number of dislocation lines per one grain is obtained as a number average by counting the number of dislocation lines on 100 or more grains.

The dislocation lines can be integrated, for example, in the vicinity of outer circumference of a tabular grain. In this case, the dislocation is nearly perpendicular to the outer circumference and the dislocation lines generated extend from the position at x% length of the distance between the center of the tabular grain and the side (outer circumference) to the outer circumference. x is preferably from 10 to less than 100, more preferably from 30 to less than 99, most preferably from 50 to less than 98. In this case, the shape formed by connecting the starting points of dislocation lines is nearly a similar figure to the grain form but not completely a similar figure and may deform in some cases. This type of dislocation is not observed in the center region of a grain. The dislocation lines crystallographically direct towards the (211) direction but frequently weave or sometimes intersect with each other.

The dislocation lines may be present nearly uniformly throughout the entire outer circumference of a tabular grain or may be present at a local site on the outer circumference. More specifically, for example, in the case of a hexagonal tabular silver halide grain, the dislocation lines may be limited only to the neighborhood of six peaks or may be limited only to the neighborhood of one peak among them. On the contrary, the dislocation lines may be limited only to sides exclusive of the neighborhood of six peaks.

Further, the dislocation lines may be formed over the region including the centers of two parallel major planes. When the dislocation lines are formed over the entire surface of the major plane, they may be crystallographically directed nearly towards the (211) direction upon viewing from the direction perpendicular to the major plane but sometimes directed towards the (110) direction or formed randomly. Further, respective dislocation lines are random in the length and some dislocation may be observed as a short line on the major plane or some dislocation may be observed as a long line extending to the side (outer circumference). The dislocation lines may be linear or may be weaving. The dislocation lines often intersect with each other.

The sites of the dislocation lines may be limited to on the outer circumference, on the major plane or at the local site as described above, or the dislocation lines may be formed on these sites together, that is, may be present on the outer circumference and on the major plane at the same time.

The dislocation lines can be integrated into the outer circumference of a tabular grain by providing a specific high silver iodide layer inside the grain. The high silver iodide layer includes a high silver iodide region provided discontinuously. More specifically, a base grain is prepared, a high silver iodide layer is provided thereon and a layer having a silver iodide content lower than that of the high silver iodide layer covers the outside thereof. The base tabular grain has a silver iodide content lower than that of the high silver iodide layer, preferably of from 0 to 20 mol %, more preferably from 0 to 15 mol %.

The high silver iodide layer inside the grain means a silver halide solid solution containing silver iodide. In this case, the silver halide is preferably silver iodide, silver iodobromide or silver chloroiodobromide and more preferably silver iodide or silver iodobromide (each having a silver iodide content of from 10 to 40 mol %). The high silver iodide layer inside the grain (hereinafter referred to as an inner high silver iodide layer) may be selectively provided either on the edge or at the corner of the base grain by controlling the production conditions of the base grain and the production conditions of the inner high silver iodide layer. With respect to the production conditions of the base grain, the pAg (a logarithm of a reciprocal of silver ion concentration) and the presence or absence, kind, amount and temperature of the silver halide solvent are important. By growing the base grain at a pAg of 8.5 or less, preferably 8 or less, the inner high silver iodide layer can be provided selectively in the vicinity of the peak of the base grain. On the other hand, by growing the base grain at a pAg of 8.5 or more, preferably 9 or more, the inner high silver iodide layer can be provided on the edge of the base grain. The threshold value of the pAg is raised or lowered depending upon the temperature and the presence or absence, the kind and the amount of the silver halide solvent. For example, if thiocyanate is used as the silver halide solvent, the threshold value of the pAg deviates towards a higher value. The particularly important pAg at the growth time is a pAg at the final stage of the growth of the base grain. However, even if the pAg at the growth time does not meet the above-described requirement, the selective site of the inner high silver iodide layer can be controlled by adjusting the pAg after the growth of the base grain to fall within the above-described range and ripening the grain. At this time, the effective silver halide solvent is an ammonia, an amine compound or a thiocyanate. The inner high silver iodide layer may be produced by a so-called conversion method. This method includes a method where, during the grain formation, a halogen ion having a solubility of a salt for forming a silver ion smaller than that of the halogen ion forming the grain or the vicinity of the grain surface at that time is added, but in the present invention, the halogen ion having a smaller solubility added is preferably present in an amount greater than a certain value (relating to the halogen composition) based on the surface area of the grain at that time. For example, KI is added during the grain formation preferably in an amount greater than a certain amount based on the surface area of the AgBr grain at that time. More specifically, the iodide salt is preferably added in an amount of $8.2\times10^{-5}$ mol/m$^2$ or more.

The inner high silver iodide layer is more preferably produced by adding an aqueous silver salt solution at the same time with the addition of an aqueous halide salt solution containing an iodide salt.

For example, an aqueous $AgNO_3$ solution is added at the same time with the addition of an aqueous KI solution by a double jet method. At this time, the addition initiation time and the addition completion time of the aqueous KI solution may be faster or later than those of the aqueous $AgNO_3$ solution. The addition molar ratio of the aqueous $AgNO_3$ solution to the aqueous KI solution is preferably 0.1 or more, more preferably 0.5 or more, still more preferably 1 or more. The total addition molar amount of the aqueous $AgNO_3$ solution may be in a silver excess region to the halogen ion in the system and the iodide ion added. The pAg at the double jet addition of the aqueous halide solution containing these iodide ions and the aqueous silver salt solution is preferably reduced as the double jet addition proceeds. The pAg before the initiation of addition is preferably from 6.5 to 13, more preferably from 7.0 to 11. The pAg at the completion of addition is most preferably from 6.5 to 10.0.

In practicing the above-described method, the silver halide in the mixing system preferably has a solubility as low as possible. Accordingly, the temperature in the mixing system at the time of forming a high silver iodide layer is preferably from 30° to 70° C., more preferably from 30° to 50° C.

The inner high silver iodide layer is formed most preferably by adding fine grain silver iodide (fine silver iodide, hereinafter the same), fine grain silver iodobromide, fine grain silver chloroiodide or fine grain silver chloroiodobromide. The addition of fine grain silver iodide is particularly preferred. These fine grains each has a grain size of usually from 0.01 to 0.1 μm, however, fine grains having a grain size of 0.01 μm or less, or of 0.1 μm or more may also be used. With respect to the preparation method of these fine grain silver halide grains, JP-A-1-183417, JP-A-1-183644, JP-A-1-183645, JP-A-2-43534, JP-A-2-43535 and JP-A-2-44335 may be referred to. By adding the fine grain silver halide and effecting ripening, an inner high silver iodide layer can be provided. In ripening the fine grain to dissolve, the above-described silver halide solvent may also be used. The fine grains added need not be thoroughly dissolved at once to vanish, but it may suffice if the fine grains are dissolved out and vanish at the time of completion of final grains.

The outer layer for covering the inner high silver iodide layer has a silver iodide content lower than that of the high silver iodide layer and the silver iodide content is preferably from 0 to 30 mol %, more preferably from 0 to 20 mol %, most preferably from 0 to 10 mol %. The site of the inner high silver iodide layer is preferably present in the range, measured from the center of a hexagon as a projected shape of a grain, of from 5 to less than 100 mol %, more preferably from 20 to less than 95 mol %, still more preferably from 50 to less than 90 mol %, based on the silver amount of whole grains. The amount of silver halide for forming the inner high silver iodide layer is, in terms of silver amount, 50 mol % or less, more preferably 20 mol % or less based on the whole grains. These values relating to the high silver iodide layer are values for formulation in the production of a silver halide emulsion but not values determined on the halogen composition of a final grain according to various analytic methods. The inner high silver iodide layer very often disappears in the final grain through recrystallization step or the like and the description in the foregoing all relates to the production method thereof.

Accordingly, although the dislocation lines of a final grain may be easily observed according to the above-described method, the inner silver iodide layer incorporated for the incorporation of dislocation lines cannot be confirmed as a definite layer in many cases and, for example, the outer circumferential region of a tabular grain all may be observed as a high silver iodide layer. The halogen composition can be verified by using in combination an X-ray diffraction, an EPMA (sometimes called XMA) method (a method for detecting the silver halide composition by scanning a silver halide grain with electron beams) or an ESCA (sometimes called XPS) method (a method for separating light of photoelectrons coming out from the grain surface upon irradiation of X rays).

The temperature and the pAg at the time of forming the outer layer for covering the inner high silver iodide layer may be freely selected, however, the temperature is preferably from 30° to 80° C., most preferably from 35° to 70° C. and the pAg is preferably from 6.5 to 11.5. The use of the above-described silver halide solvent is preferred in some cases and the most preferred silver halide solvent is a thiocyanate.

The dislocation line may be integrated to the main surface of a tabular grain in such a way that a base grain is prepared, silver halochloride is deposited on the main surface, the silver halochloride is formed into a high silver bromide or high silver iodide layer through conversion and a shell is provided on the outer periphery of the layer. The silver halochloride may be silver chloride or may be silver chlorobromide or silver chloroiodobromide each having a silver chloride content of 10 mol % or more, preferably 60 mol % or more. The silver halochloride may be deposited on the major plane of the base grain by adding separately or simultaneously an aqueous silver nitrate solution and an aqueous solution of an appropriate alkali metal salt (e.g., potassium chloride), or may be deposited by adding an emulsion comprising such a silver salt and effecting ripening. The silver halochloride may be deposited at any pAg region but the pAg is most preferably from 5.0 to 9.5. According to this method, the tabular grain is grown mainly in the thickness direction. The amount of the silver halochloride layer is, in terms of silver, from 1 to 80 mol %, more preferably from 2 to 60 mol % based on the base grain. Dislocation lines can be integrated into the major plane of a tabular grain by subjecting the silver halochloride layer to conversion with an aqueous halide solution capable of forming a silver salt having a solubility lower than that of the silver halochloride. For example, the silver halochloride layer is converted with an aqueous KI solution and then a shell is grown to obtain a final grain. The halogen conversion of the silver halochloride layer does not mean that the layer is thoroughly replaced by a silver salt having a solubility lower than that of the silver halochloride but means that the layer is replaced by a silver salt having a lower solubility in the proportion of preferably 5% or more, more preferably 10% or more, most preferably 20% or more. Dislocation lines can be integrated into a local portion on the major plane by controlling the halogen structure of the base grain on which a silver halochloride layer is provided. For example, if a base grain having an inner high silver iodide structure is displaced on use to the transverse direction of a base tabular grain, the dislocation lines can be integrated only at the peripheral part of the major plane exclusive of the center part of the major plane. Also, if a base grain having an outer high silver iodide structure is displaced on use to the transverse direction of a base tabular grain, the dislocation lines can be integrated only to the center part of the major plane exclusive of the peripheral part thereof. Further, it is also possible that a local governing substance for the epitaxial growth of the silver halochloride, for example, an iodide is used to deposit the silver halochloride only on an areally limited portion and the dislocation lines are integrated only to that portion. The temperature at the deposition of the silver halochloride is preferably from 30° to 70° C., more preferably from 30° to 50° C. The silver halochloride after deposition may be subjected to conversion and then to the growth of a shell, or the silver halochloride after deposition may be subjected to halogen conversion while growing a shell.

The site of the inner silver halochloride layer formed nearly in parallel to the major plane is preferably present in the range, from the center of the grain thickness towards both sides, of from 5 to less than 100 mol %, more preferably from 20 to less than 95 mol %, still more preferably from 50 to less than 90 mol %, based on the silver amount of whole grains.

The shell has a silver iodide content of preferably from 0 to 30 mol %, more preferably from 0 to 20 mol %. The temperature and the pAg at the time of shell formation may be freely selected, but the temperature is preferably from 30° to 80° C., most preferably from 35° to 70° C. and the pAg is preferably from 6.5 to 11.5. In some cases, a silver halide solvent described above may be preferably used and the most preferred silver halide solvent is a thiocyanate. In the final grain, the inner silver halochloride layer subjected to halogen conversion may not be confirmed by the above-described analytic method for the halogen composition depending upon the conditions such as degree of the halogen conversion, however, the dislocation lines can be clearly observed.

This method for integrating dislocation lines to any site on the major plane of a tabular grain and the method for integrating dislocation lines to any site on the outer circumference of a tabular grain described above can also be appropriately combined to integrate dislocation lines.

The silver halide emulsion which can be used in combination in the present invention may use any silver halide of silver bromide, silver iodobromide, silver iodochlorobromide and silver chlorobromide. Preferred silver halide are silver iodobromide and silver iodochlorobromide each having a silver iodide content of 30 mol % or less.

The tabular grain of the present invention can be easily prepared according to the methods described in Cleve, *Photography Theory and Practice*, p. 131 (1930), Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157.

The silver halide emulsion is usually subjected to chemical sensitization. The chemical sensitization can use, for example, a method described in H. Frieser, *Die Grundlagen der Photographischen Prozesse mit Silberhalogeniden*, Akademische Ferlags Gesselshaft, pp. 675–734.

More specifically, a sulfur sensitization method using a compound containing a sulfur capable of reaction with active gelatin or silver (e.g., thiosulfates, thioureas, mercapto compounds, rhodanines); a reduction sensitization method using a reducing material (e.g., stannous salt, amines, hydrazine derivatives, formamidinesulfinic acid, silane compounds); a noble metal sensitization method using a noble metal compound (e.g., gold complex salt, complex salts of a metal belonging to Group VIII of the Periodic Table, such as Pt, Ir, Pd); and a selenium sensitization method using a selenium compound (e.g., selenoureas, selenoketones, selenides) may be used individually or in combination.

The photographic emulsion for use in the present invention may contain various compounds so as to prevent fogging or to stabilize photographic capacity, during preparation, storage or photographic processing of a photographic material. Specifically, a large number of compounds known as an antifoggant or a stabilizer may be added and examples thereof include azoles such as benzothiazolium salts, nitroindazoles, triazoles, benzotriazoles and benzimidazoles (in particular, nitro- or halogen-substitution product); heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole) and mercaptopyrimidines; the above-described heterocyclic mercapto compounds having a water-soluble group such as a carboxyl group or a sulfone group; thioketo compounds such as oxazolinethione; azaindenes such as tetrazaindenes (in particular, 4-hydroxy-substituted (1,3,3a,7) tetrazaindenes); benzenethiosulfonic acids; and benzenesulfinic acids.

The antifoggant or the stabilizer is usually added after chemical sensitization but they are more preferably added on the way of chemical ripening or before initiation of chemical ripening. More specifically, they may be added at any time during addition of silver salt solution, between after the addition and the initiation of chemical ripening, or on the way of chemical ripening (during chemical ripening, within 50%, preferably 20% of the time period from the initiation), as long as it is in the grain formation process of a silver halide emulsion.

The addition amount of the above-described additives used in the present invention varies depending upon the addition method or the amount of silver halide and cannot be generally defined but it is preferably from $10^{-7}$ to $10^{-2}$, more preferably from $10^{-5}$ to $10^{-2}$ mol, per mol of silver halide.

Gelatin is advantageously used as a preservative (a binder or a protective colloid) of the photographic emulsion of the present invention, however, a hydrophilic colloid other than gelatin can also be used.

Examples thereof include proteins such as gelatin derivatives, graft polymers of gelatin to other polymer, albumin and casein; saccharide derivatives such as cellulose derivatives, e.g., hydroxyethyl cellulose, carboxymethyl cellulose and cellulose sulfate, sodium arginates and starch derivatives; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may be a lime-processed gelatin, an acid-processed gelatin or an enzyme-processed gelatin as described in *Bull. Soc. Photo. Japan*, No. 16, p. 30 (1966), and a hydrolysate of gelatin or an enzymolysate of gelatin can also be used. As the gelatin derivative, those obtained by reacting gelatin with a compound such as acid halide, acid anhydride, isocyanates, bromoacetic acid, alkane sultones, vinylsulfonamides, maleinimide compounds, polyalkylene oxides or epoxy compounds are used.

With respect to the dispersion medium for use in the present invention, specific examples thereof are described in *Research Disclosure*, Vol. 176, No. 17643, Item IX (December, 1978).

The present invention can be applied to a color light-sensitive material for general use or movie such as a color negative film, a reversal film, a color negative film for movie, a color positive film or a positive film for movie, or to a black-and-white light-sensitive material such as a black-and-white negative film, a micro film or an X-ray film. The present invention is preferably used in a color light-sensitive material for general use or a black-and-white light-sensitive material for photographing.

The color light-sensitive material to which the present invention is applied may suffice if it has at least one light-sensitive layer on the support. A typical example thereof is a silver halide photographic material comprising a support having thereon at least one light-sensitive layer consisting of a plurality of silver halide emulsion layer having substantially the same spectral sensitivity sensitivities but different light sensitivities, wherein the light-sensitive layer is a unit light-sensitive layer having spectral sensitivity to any of blue light, green light and red light. In the case of a multi-layer silver halide color photographic material, generally, a red-sensitive unit layer, a green-sensitive unit layer and a blue-sensitive unit layer are provided in this order from the support side. However, depending upon the purpose, the above arrangement order may be reversed or a layer having different light sensitivity may be superposed between layers having the same spectral sensitivity. A light-insensitive layer may be provided between the above-described silver halide light-sensitive layers, as an uppermost layer or as the lowermost layer. These layers may contain couplers, DIR compounds or color mixing inhibitors which will be described later. A plurality of silver halide emulsion layers constituting each unit light-sensitive layer preferably has a two-layer structure consisting of a high-sensitivity emulsion layer and a low-sensitivity emulsion layer provided such that the light sensitivity is lowered in sequence towards the support as described in German Patent 1,121,470 and British Patent 923,045. Further, it may also be possible to provide a low-sensitivity emulsion layer farther from the support and a high-sensitivity emulsion layer nearer to the support as described in JP-A-57-112751, JP-A-62-200350 and JP-A-62-206541, JP-A-62-206543.

Specific examples of the layer arrangement include an order, from the farthest side to the support, of a low-sensitivity blue-sensitive layer (BL)/a high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), an order of BH/BL/GL/GH/RH/RL and an order of BH/BL/GH/GL/RL/RH.

Also, as described in JP-B-55-34932, a blue-sensitive layer/GH/RH/GL/RL may be arranged in this order from the farthest side to the support. Further, as described in JP-A-56-25738 and JP-A-62-63936, a blue-sensitive layer/GL/RL/GH may be arranged in this order from the farthest side to the support.

An arrangement consisting of three layers different in the light sensitivity may be taken as described in JP-B-49-15495 where a silver halide emulsion layer having the highest light sensitivity is provided as an upper layer, a silver halide emulsion layer having a light sensitivity lower than that of the upper layer as a medium layer and a silver halide emulsion layer having a light sensitivity lower than that of the medium layer as a lower layer so that the light sensitivity is lowered in sequence towards the support. Even in the case when such a three layer structure having different light sensitivities is used, as described in JP-A-59-202464, a medium-sensitivity emulsion layer/a high-sensitivity emulsion layer/a low-sensitivity emulsion layer may be provided in this order from the farthest side to the support in the same spectrally sensitized layer.

In addition, an order of a high-sensitivity emulsion layer/a low-sensitivity emulsion layer/a medium-sensitivity emulsion layer or an order of a low-sensitivity emulsion layer/a medium-sensitivity emulsion layer/a high-sensitivity emulsion layer may also be used. In the case of four or more layer structure, the layer arrangement may also be changed as described above.

In order to improve color reproducibility, a donor layer (CL) having an interlayer effect which is different in the spectral sensitivity distribution from the main light-sensitive layers such as BL, GL and RL, is preferably provided adjacent to or in the vicinity of a main light-sensitive layer as described in U.S. Pat. Nos. 4,663,271, 4,705,744 and 4,707,436, JP-A-62-160448 and JP-A-63-89850 .

The silver halide for use in the present invention is preferably silver iodobromide, silver iodochloride or silver iodochlorobromide having a silver iodide content of about 30 mol % or less, more preferably silver iodobromide or silver iodochlorobromide having a silver iodide content of from about 2 to about 10 mol %.

The silver halide grain in the photographic emulsion may have a regular crystal from such as cubic, octahedral or tetradecahedral, an irregular crystal form such as spherical or platy, a crystal defect such as twin, or a composite form of these.

The silver halide may be a fine grain having a grain size of about 0.2 μm or less or a large-sized grain having a grain size in terms of a projected area diameter up to about 10 μm, and either a polydisperse emulsion or a monodisperse emulsion may be used.

The silver halide photographic emulsion which can be used in the present invention can be prepared according to the methods described, for example, in *Research Disclosure* (hereinafter simply referred to as "RD") No. 17643, pp. 22–23 "I. Emulsion Preparation and Types" (December, 1978), ibid., No. 18716, p. 648 (November, 1979), ibid., No. 307105, pp. 863–865 (November, 1989), P. Glafkides, *Chemie et Phisique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodisperse emulsions described in U.S. Pat. Nos. 3,574,628 and 3,655,394 and British Patent 1,413,748 are also preferably used.

Also, tabular grains having an aspect ratio of about 3 or more can be used in the present invention. The tabular grain can be easily prepared by the methods described in Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157.

The crystal structure may be homogeneous, may comprise a halogen composition different between the interior and the exterior or may be stratified. A silver halide having a different composition may be conjugated thereto by an epitaxial junction or the silver halide may be conjugated with a compound other than silver halide, such as silver rhodanate or lead oxide. Also, a mixture of grains having various crystal forms may be used.

The above-described emulsion may be a surface latent image-type emulsion forming a latent image mainly on the surface, an internal latent image-type emulsion forming a latent image inside the grain, or a type forming a latent image both on the surface of and inside the grain, however, it needs to be a negative emulsion. As one of internal latent image-type emulsions, a core/shell internal latent image-type emulsion described in JP-A-63-264740 may also be used and the preparation method of this emulsion is described in JP-A-59-133542. In this emulsion, the thickness of the shell varies depending upon the development process and the like, but it is preferably from 3 to 40 nm, more preferably from 5 to 20 nm.

The silver halide emulsion is usually subjected to physical ripening, chemical ripening and spectral sensitization before use. The additives used in these steps are described in RD No. 17643, RD No. 18716 and RD No. 307105 and the pertinent portions thereof are summarized in the table set forth later.

The light-sensitive material of the present invention may use a mixture of two or more kinds of emulsions different at least in one property of the light-sensitive silver halide emulsion, such as the grain size, the grain size distribution, the halogen composition, the grain shape or the sensitivity, in the same layer.

It is preferred to apply a silver halide grain of which surface is fogged described in U.S. Pat. No. 4,082,553, a silver halide grain of which inside is fogged described in U.S. Pat. No. 4,626,498 and JP-A-59-214852 or a colloidal silver to a light-sensitive silver halide emulsion layer and/or a substantially light-insensitive hydrophilic colloid layer. The term "silver halide grain of which inside or surface is fogged" as used herein means a silver halide grain which can achieve uniform (non-imagewise) development of a light-sensitive material irrespective of an unexposed area or an exposed area. The preparation method of such a grain is described in U.S. Pat. No. 4,626,498 and JP-A-59-214852. The silver halide forming the inside nucleus of a core/shell type silver halide grain of which inside is fogged may have a different halogen composition. The silver halide for the grain of which inside or surface is fogged may be any of silver chloride, silver bromide, silver iodobromide and silver chloroiodobromide. The fogged silver halide grain has an average grain size of preferably from 0.01 to 0.75 μm, more preferably from 0.05 to 0.6 μm. The grain may have a regular form or may be a polydisperse emulsion, but it is preferably monodisperse (namely, at least 95% by weight or by number of silver halide grains having a grain size within an average grain size ±40%).

In the present invention, a light-insensitive fine grain silver halide is preferably used. The term "light-insensitive fine grain silver halide" as used herein means a silver halide fine grain which is not sensitive to light at the imagewise exposure for obtaining a dye image and substantially not developed at the development process. The light-insensitive fine grain silver halide is preferably not fogged previously. The fine grain silver halide has a silver bromide content of from 0 to 100 mol % and may contain, if desired, silver chloride and/or silver iodide. It preferably contains from 0.5 to 10 mol % of silver iodide. The fine grain silver halide has an average grain size (an average of circle-corresponding diameters of the projected area) of preferably from 0.01 to 0.5 μm, more preferably from 0.02 to 0.2 μm.

The fine grain silver halide can be prepared by the same method as that for the normal light-sensitive silver halide. The surface of the silver halide grain needs not be optically sensitized nor be spectrally sensitized. However, it is preferred to add a known stabilizer such as a triazole-based compound, an azaindene-based compound, a benzothiazolium-based compound, a mercapto-based compound or a zinc compound, to the fine grain silver halide in advance of the addition to a coating solution. A layer containing the fine grain silver halide grain may contain colloidal silver.

The light-sensitive material of the present invention has a coated silver amount of preferably 6.0 g/m$^2$ or less, most preferably 4.5 g/m$^2$ or less.

The photographic additives which can be used in the present invention are also described in RDs and the portions having description thereon are shown in the table below.

| Kinds of Additives | RD17643 (Dec. 1978) | RD18716 (Nov. 1979) | RD307105 (Nov. 1989) |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 648, right col.-p. 649, right col. | pp. 866–868 |
| 4. Whitening agent | p. 24 | p. 647, right col. | p. 868 |
| 5. Antifoggant, stabilizer | pp. 24–25 | p. 649, right col. | pp. 866–870 |
| 6. Light absorbent, filter dye, UV absorbent | pp. 25–26 | p. 649, right col.-p. 650, left col. | p. 873 |
| 7. Stain inhibitor | p. 25, right col. | p. 650, left to right cols. | p. 872 |
| 8. Dye image stabilizer | p. 25 | p. 650, left col. | p. 872 |
| 9. Hardening agent | p. 26 | p. 651, left col. | p. 874–875 |
| 10. Binder | p. 26 | p. 651, right col. | pp. 873–874 |
| 11. Plasticizer, lubricant | p. 27 | p. 650, right col. | p. 876 |
| 12. Coating aid, surface active agent | pp. 26–27 | p. 650, right col. | pp. 875–876 |
| 13. Antistatic agent | p. 27 | p. 650, right col. | pp. 876–877 |
| 14. Matting agent | | | pp. 878–879 |

Various dye-forming couplers can be used in the light-sensitive material of the present invention and the following couplers are particularly preferred.

Yellow Coupler:

Couplers represented by formulae (I) and (II) of EP-A-502424; couplers represented by formulae (1) and (2) (particularly, Y-28 at page 18) of EP-A-513496; couplers represented by formula (I) in claim 1 of JP-A-5-307248; couplers represented by formula (I) in column 1, lines 45 to 55 of U.S. Pat. No. 5,066,576; couplers represented by formula (I) in paragraph 0008 of JP-A-4-274425; couplers (particularly, D-35 at page 18) described in claim 1 at page 40 of EP-A-498381; couplers represented by formula (Y) at page 4 (particularly, Y-1 (page 17) and Y-54 (page 41)) of EP-A-447969; couplers represented by formulae (II) to (IV) in column 7, lines 36 to 58 (particularly, II-17, II-19 (column 17) and II-24 (column 19)) of U.S. Pat. No. 4,476,219.

Magenta Coupler:

L-57 (page 11, right lower column), L-68 (page 12, right lower column) and L-77 (page 13, right lower column) of JP-A-3-39737; [A-4]-63 (page 134), [A-4]-73 and [A-4]-75 (page 139) of EP 456257; M-4, M-6 (page 26) and M-7 (page 27) of EP 486965; M-45 in paragraph 0024 of JP-A-6-43611; M-1 in paragraph 0036 of JP-A-5-204106; M-22 in paragraph 0237 of JP-A-4-362631.

Cyan Coupler:

CX-1, CX-3, CX-4, CX-5, CX-11, CX-12, CX-14 and CX-15 (pages 14 to 16) of JP-A-204843; C-7, C-10 (page 35), C-34, C-35 (page 37), (I-1) and (I-17) (pages 42 and 43) of JP-A-4-43345; couplers represented by formulae (Ia) and (Ib) in claim 1 of JP-A-6-67385.

Polymer Coupler:

P-1 and P-5 (page 11) of JP-A-2-44345.

As the coupler which provides a colored dye having an appropriate diffusibility, those described in U.S. Pat. No. 4,366,237, British Patent 2,125,570, EP-B-96873 and German Patent 3,234,533 are preferred.

As the coupler for correcting unnecessary absorption of a colored dye, yellow colored cyan couplers represented by formula (CI), (CII), (CIII) or (CIV) described at page 5 of EP-A-456257 (particularly, YC-86 at page 84); Yellow Colored Magenta Couplers ExM-7 (page 202), EX-1 (page 249) and EX-7 (page 251) described in EP-A-456257; Magenta Colored Cyan Couplers CC-9 (column 8) and CC-13 (column 10) described in U.S. Pat. No. 4,833,069; and colorless masking couplers represented by formula (2) (column 8) of U.S. Pat. No. 4,837,136 and formula (A) in claim 1 of W092/11575 (particularly, compounds described in pages 36 to 45) are preferred.

Compounds (including couplers) which release a photographically useful compound residue upon reaction with an oxidation product of a developing agent are described below.

Development Inhibitor-Releasing Compound:

Compounds represented by formula (I), (II), (III) or (IV) described at page 11 of EP-A-378236 (particularly, T-101 (page 30), T-104 (page 31), T-113 (page 36), T-131 (page 45), T-144 (page 51) and T-158 (page 58)); compounds represented by formula (I) described in page 7 of EP-A-436938 (particularly, D-45 (page 51)); compounds represented by formula (1) of JP-A-5-307248 (particularly, (23) in paragraph 0027); and compounds represented by formula (I), (II) or (III) described in pages 5 to 6 of EP-A-440195 (particularly, I-(1) at page 29);

Bleaching Accelerator-Releasing Compound:

Compounds represented by formula (I) or (I') at page 5 of EP-A-310125 (particularly (60) and (61) at page 61); and compounds represented by formula (I) in claim 1 of JP-A-6-59411 (particularly, (7) in paragraph 0022);

Ligand-Releasing Compound:

Compounds represented by LIG-X described in claim 1 of U.S. Pat. No. 4,555,478 (particularly, compounds in column 12, lines 21 to 41);

Leuco Dye-Releasing Compound:

Compounds 1 to 6 in columns 3 to 8 of U.S. Pat. No. 4,749,641;

Fluorescent Dye-Releasing Compound:

Compounds represented by COUP-DYE in claim 1 of U.S. Pat. No. 4,774,181 (particularly, compounds 1 to 11 in columns 7 to 10);

Development Accelerator- or Fogging Agent-Releasing Compound:

Compounds represented by formula (1), (2) or (3) in column 3 of U.S. Pat. No. 4,656,123 (particularly (I-22) in column 25) and ExZK-2 at page 75, lines 36 to 38 of EP-A-450637;

Compound Which Releases Group Capable of Becoming Dye First When Released:

Compounds represented by formula (I) in claim 1 of U.S. Pat. No. 4,857,447 (particularly, Y-1 to Y-19 in columns 25 to 36).

Preferred additives other than couplers are described below.

Dispersion Medium of Oil-Soluble Organic Compound:

P-3, P-5, P-16, P-19, P-25, P-30, P-42, P-49, P-54, P- 55, P-66, P-81, P-85, P-86 and P-93 of JP-A-62-215272 (pages 140 to 144);

Latex for Impregnation of Oil-Soluble Organic Compound:

Latexes described in U.S. Pat. No. 4,199,363;

Developing Agent Oxidation Product Scavenger:

Compounds represented by formula (I) in column 2, lines 54 to 62 of U.S. Pat. No. 4,978,606 (particularly, I-(1), I-(2), I-(6) and I-(12) (columns 4 to 5)) and compounds represented by formulae in column 2, lines 5 to 10 of U.S. Pat. No. 4,923,787 (particularly, Compound 1 (column 3));

Stain Inhibitor:

Compounds represented by formula (I), (II) or (III) at page 4, lines 30 to 33 of EP-A-298321 (particularly, I-47, I-72, III-1 and III-27 (pages 24 to 48));

Discoloration Inhibitor:

A-6, A-7, A-20, A-21, A-23, A-24, A-25, A-26, A-30, A-37, A-40, A-42, A-48, A-63, A-90, A-92, A-94 and A-164 of EP-A-298321 (pages 69 to 118), II-1 to III-23 in columns 25 to 38 of U.S. Pat. No. 5,122,444 (particularly, III-10), I-1 to II-4 at pages 8 to 12 of EP-A-471347 (particularly, II-2) and A-1 to A-48 in columns 32 to 40 of U.S. Pat. No. 5,139,931 (particularly, A-39 and A-42);

Material Which Reduces Use Amount of Coloration Reinforcing Agent or Color Mixing Inhibitor:

I-1 to II-15 at pages 5 to 24 of EP-A-411324 (particularly, I-46);

Formalin Scavenger:

SCV-1 to SCV-28 at pages 24 to 29 of EP-A-477932 (particularly SCV-8);

Hardening Agent:

H-1, H-4, H-6, H-8 and H-14 at page 17 of JP-A-1-214845, compounds (H-1 to H-54) represented by any one of formulae (VII) to (XII) in columns 13 to 23 of U.S. Pat. No. 4,618,573, Compounds (H-1 to H-76) represented by formula (6) at page 8, right lower column of JP-A-2-214852 (particularly, H-14) and compounds described in claim 1 of U.S. Pat. No. 3,325,287;

Development Inhibitor Precursor:

P-24, P-37 and P-39 of JP-A-62-168139 (pages 6 to 7) and compounds described in claim 1 of U.S. Pat. No. 5,019,492 (particularly, 28 and 29 in column 7);

Antiseptic Antimold:

I-1 to III-43 in columns 3 to 15 of U.S. Pat. No. 4,923,790 (particularly, II-1, II-9, II-10, II-18 and III-25);

Stabilizer, Antifoggant:

I-1 to I-(14) in columns 6 to 16 of U.S. Pat. No. 4,923,793 (particularly, I-1, 1-60, I-(2) and I-(13)) and compounds 1 to 65 in columns 25 to 32 of U.S. Pat. No. 4,952,483 (particularly, 36);

Chemical Sensitizer:

triphenylphosphine, selenide and compound 50 of JP-A-5-40324;

Dye:

a-1 to b-20 at pages 15 to 18 (particularly, a-1, a-12, a-18, a-27, a-35, a-36 and b-5) and V-1 to V-23 at pages 27 to 29 of JP-A-3-156450 (particularly, V-1), F-I-1 to F-II-43 at pages 33 to 55 of EP-A-445627 (particularly, F-I-11 and F-II-8), III-1 to III-36 at pages 17 to 28 of EP-A-457153 (particularly, III-1 and III-3), fine crystal dispersion products of Dye-1 to Dye-124 at pages 8 to 26 of WO88/04794, compounds 1 to 22 at pages 6 to 11 of EP-A-319999 (particularly, Compound 1), compounds D-1 to D-87 (pages 3 to 28) represented by formula (1), (2) or (3) of EP-A-519306, compounds 1 to 22 (columns 3 to 10) represented by formula (I) of U.S. Pat. No. 4,268,622 and compounds (1) to (31) (columns 2 to 9) represented by formula (I) of U.S. Pat. No. 4,923,788;

UV Absorbent:

Compounds (18b) to (18r) and 101 to 427 (pages 6 to 9) represented by formula (1) of JP-A-46-3335, compounds (3) to (66) (pages 10 to 44) represented by formula (I) and compounds HBT-1 to HBT-10 (page 14) represented by formula (III) of EP-A-520938, and compounds (1) to (31) (columns 2 to 9) represented by formula (1) of EP-A-521823.

The present invention can be applied to various color light-sensitive materials such as color negative film for general use or for movie, color reversal film for slide or for television, color paper, color positive film and color reversal paper. Further, the present invention is suitably used for a film unit with a lens described in JP-B-2-32615 and JP-B-

U-3-39784 (the term "JP-B-U" as used herein means an "examined Japanese utility model publication).

Examples of the support properly used in the present invention are described in RD No. 17643, page 28, ibid., No. 18716, from page 647, right column to page 648, left column and ibid., No. 307105, page 879.

In the light-sensitive material of the present invention, the total thickness of all hydrophilic colloid layers on the side having emulsion layers is preferably 28 μm or less, more preferably 23 μm or less, still more preferably 18 μm or less and most preferably 16 μm or less. The film swelling speed $T_{1/2}$ is preferably 30 seconds or less, more preferably 20 seconds or less. $T_{1/2}$ is defined as the time required for the film thickness to reach a half (½) of a saturation film thickness which corresponds to 90% of the maximum swollen thickness achieved at the processing with a color development at 30° C. for 3 minutes and 15 seconds. The film thickness means a film thickness determined at 25° C. and 55% RH (relative humidity) under humidity conditioning (2 days). $T_{1/2}$ can be measured by means of a swellometer described in A. Green, *Photogr. Sci. Eng.*, Vol. 19, 2, pp. 124–129. The $T_{1/2}$ can be adjusted by adding a hardening agent to gelatin as a binder or changing the aging conditions after the coating. The swelling rate is preferably from 150 to 400%. The swelling rate can be obtained from the maximum swollen film thickness under the above-described conditions according to the formula:

$$\frac{\text{maximum swollen film thickness} - \text{film thickness}}{\text{film thickness}}$$

In the light-sensitive material of the present invention a hydrophilic colloid layer (called back layer) having the total dry thickness of from 2 to 20 μm is preferably provided on the side opposite to the side having emulsion layers. This back layer preferably contains an light absorbent, a filter dye, an ultraviolet absorbent, an antistatic agent, a hardening agent, a binder, a plasticizer, a lubricant, a coating agent or a surface active agent which all are described above. The back layer has a swelling rate of preferably from 150 to 500%.

The light-sensitive material of the present invention can be developed according to usual methods described in RD No. 17643, pp. 28–29, ibid., No. 18716, p. 651, from left to right columns and ibid., No. 307105, pp. 880–881.

The color developer used in development of the light-sensitive material of the present invention is preferably an alkaline aqueous solution comprising as a main component an aromatic primary amine color developing agent. As the color developing agent, an aminophenol-based compound may be useful but a p-phenylenediamine-based compound is preferably used and representative and preferred examples thereof include compounds described in EP-A-556700, page 28, lines 43 to 52. These compounds can be used in combination of two or more depending on the purpose.

The color developer usually contains a pH buffering agent such as a carbonate, a borate or a phosphate of an alkali metal or a development inhibitor or an antifoggant such as a chloride salt, a bromide salt, an iodide salt, a benzimidazole, a benzothiazole or a mercapto compound. The color developer may also contain, if desired, a preservative such as hydroxylamine, diethylhydroxylamine, sulfite, hydrazines, e.g., N,N-biscarboxymethylhydrazine, phenylsemicarbazides, triethanolamine and catecholsulfonic acids; an organic solvent such as ethylene glycol and diethylene glycol; a development accelerator such as benzyl alcohol, polyethylene glycol, a quaternary ammonium salt and amines; a dye-forming coupler; a competing coupler; an auxiliary developing agent such as 1-phenyl-3-pyrazolidone; a tackifying agent; and various chelating agents including aminopolycarboxylic acid, aminopolyphosphonic acid, alkylphosphonic acid and phosphonocarboxylic acid. Representative examples of the chelating agent include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenyl-acetic acid) and a salt thereof.

In carrying out reversal processing, the color development usually follows black-and-white development. The black-and-white developer uses known black-and-white developing agents such as dihydoxybenzenes, e.g., hydroquinone, 3-pyrazolidones, e.g., 1-phenyl-3-pyrazolidone, and aminophenols, e.g., N-methyl-p-aminophenols, individually or in combination. The color developer or the black-and-white developer usually has a pH of from 9 to 12. The replenishing amount of these developers is, although it may vary depending on the color photographic material processed, generally 3 l or less per $m^2$ of the light-sensitive material and when the bromide ion concentration of the replenisher is lowered, the replenishing amount may be reduced to 500 ml or less. When the replenishing amount is reduced, the contact area of the processing tank with air is preferably reduced to prevent evaporation or air oxidation of the solution.

The processing effect resulting from contact of the photographic processing solution with air in a processing tank can be evaluated by an opening ratio (=[contact area of the processing solution with air ($cm^2$)]÷[volume of the processing solution ($cm^3$)]. The opening ratio as defined above is preferably 0.1 or less, more preferably from 0.001 to 0.05. The opening ratio can be reduced, for example, by providing a shielding material such as a floating lid on the surface of the photographic processing solution in the processing tank, by using a movable lid described in JP-A-1-82033 or by a slit development method described in JP-A-63-216050. The opening ratio is preferably reduced not only in the color development and black-and-white development but also in any subsequent step such as bleaching, bleach-fixing, fixing, water washing or stabilization. Further, by using a means for suppressing the accumulation of bromide ions in the developer, the replenishing amount can be reduced.

The color development time is usually set to from 2 to 5 minutes, however, further reduction in the processing time can be achieved by carrying out the processing at high temperature and high pH and by using a color developing agent in a high concentration.

After the color development, the photographic emulsion layer is usually subjected to bleaching. The bleaching may be conducted at the same time with the fixing (bleach-fixing) or may be conducted separately. For the purpose of rapid processing, the bleaching may be followed by bleach-fixing. Further, a processing in a bleach-fixing bath consisting of two continuous tanks, a processing comprising fixing before bleach-fixing or a processing comprising bleaching after bleach-fixing may be freely selected depending upon the purpose. Examples of the bleaching agent include compounds of a polyvalent metal such as iron(III), peracids, quinones and nitro compounds. Representative examples of the bleaching agent include organic complex salts of iron (III), e.g., complex salts with an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid, or complex salts with citric acid, tartaric acid or malic acid. Among these, an aminopolycarboxylic acid ferrate complex salt including an ethylenediaminetetraacetato ferrate complex salt and 1,3-diaminopropanetetraacetato ferrate complex salt is preferred in view of rapid processing and environmental conservation. Further, the aminopolycarboxylic acid ferrate complex salt is particularly useful for the bleaching solution or for bleach-fixing solution. The bleaching solution or the bleach-fixing solution using the aminopolycarboxylic acid ferrate complex salt has a pH of generally from 4.0 to 8 but the processing may be carried out at a lower pH for expediting the processing.

A bleaching accelerator may be used, if desired, in the bleaching solution, the bleach-fixing solution or a prebath thereof. Specific examples of useful bleaching accelerators include compounds described in the following specifications: for example, compounds having a mercapto group or a disulfide group described in U.S. Pat. No. 3,893,858, German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-18426 and RD No. 17129 (July, 1978); thiazolidine derivatives described in JP-A-50-140129; thiourea derivatives described in JP-B-45-8506, JP-A-52-20832, JP-A-53-32735 and U.S. Pat. No. 3,706,561; iodide salts described in German Patent 1,127,715 and JP-A-58-16235; polyoxyethylene compounds described in German Patent Nos. 966,410 and 2,748,430; polyamine compounds described in JP-B-45-8836; compounds described in JP-A-49-40943, JP-A-49-59644, JP-A-53-94927, JP-A-54-35727, JP-A-55-26506 and JP-A-58-163940; and bromide ions. Among these, compounds having a mercapto group or a disulfide group are preferred in view of a large acceleration effect and in particular, compounds described in U.S. Pat. No. 3,893,858, German Patent No. 1,290,812 and JP-A-53-95630 are preferred. Also, compounds described in U.S. Pat. No. 4,552,834 are preferred. The bleaching accelerator may be incorporated into the light-sensitive material. The bleaching accelerator is particularly effective in bleach-fixing a color light-sensitive material for photographing.

In addition to the above-described compounds, the bleaching solution or the bleach-fixing solution preferably contains an organic acid in order to prevent bleaching stain. Particularly preferred organic acid is a compound having an acid dissociation constant (pKa) of from 2 to 5 and specific examples thereof include acetic acid, propionic acid and hydroxyacetic acid.

Examples of the fixing agent for use in the fixing solution or the bleach-fixing solution include thiosulfates, thiocyanates, thioether-based compounds, thioureas and a large quantity of iodides. Among these, a thiosulfate is commonly used and an ammonium thiosulfate can be most widely used. Also, a combination use of a thiosulfate with a thiocyanate, a thioether-based compound or a thiourea is preferred. As the preservative for the fixing solution or the bleach-fixing solution, sulfites, bisulfites, carbonyl bisulfite adducts and sulfinic acid compounds described in EP-A-294769 are preferred. Further, the fixing solution or the bleach-fixing solution preferably contains various aminopolycarboxylic acids or organic phosphonic acids for the purpose of stabilization of the solution.

In the present invention, in order to adjust the pH, a compound having a pKa of from 6.0 to 9.0, preferably, an imidazole such as imidazole, 1-methylimidazole, 1-ethylimidazole and 2-methylimidazole is preferably added to the fixing solution or the bleach-fixing solution in an amount of from 0.1 to 10 mol/liter.

The total desilvering time is preferably as short as possible if desilvering failure is not caused. The time is preferably from 1 to 3 minutes, more preferably from 1 to 2 minutes. The processing temperature is from 25° to 50° C., preferably from 35° to 45° C. In this preferred temperature range, the desilvering rate is improved and the occurrence of stains after processing can be effectively prevented.

In the desilverization, the stirring is preferably intensified as highly as possible. Specific examples of the method for intensifying stirring include a method comprising colliding a jet stream of a processing solution against the emulsion surface of the light-sensitive material described in JP-A-62-183460, a method for increasing the stirring effect using a rotary means described in JP-A-62-183461, a method for increasing the stirring effect by moving the light-sensitive material while putting the emulsion surface into contact with a wire blade provided in the solution to cause turbulence on the emulsion surface, and a method for increasing the circulation flow rate of the entire processing solutions. Such a means for intensifying the stirring is effective in any of the bleaching solution, the bleach-fixing solution and the fixing solution. The intensification of stirring is considered to increase the supply rate of the bleaching agent or the fixing agent into the emulsion layer and as a result, to elevate the desilverization rate. The above-described means for intensifying stirring is more effective when a bleaching accelerator is used and in this case, the acceleration effect can be outstandingly increased or the fixing inhibitory action by the bleaching accelerator can be eliminated.

The automatic developing machine used for the light-sensitive material of the present invention preferably has a transportation means for a light-sensitive material described in JP-A-60-191257, JP-A-60-191258 and JP-A-60-191259. As described in JP-A-60-191257 above, the transportation means can extremely decrease the amount of a processing solution carried over from a previous bath to a post bath, provides a great effect in preventing the deterioration in capacity of the processing solution and is particularly effective in reducing the processing time or decreasing the replenishing amount of a processing solution in each step.

The light-sensitive material of the present invention is generally subjected to water washing and/or stabilization after the desilvering. The amount of water in the water washing can be set over a wide range according to the characteristics (e.g., due to the material used such as a coupler) or the use of the photographic material and in addition, the temperature of washing water, the number of water washing tanks (stage number), the replenishing system such as countercurrent and co-current or other various conditions. Among these, the relation between the number of water washing tanks and the amount of water in a multi-stage countercurrent system can be obtained according to the method described in *Journal of the Society of Motion Picture and Television Engineers.*, Vol. 64, pp. 248–253 (May, 1955). According to the multi-stage countercurrent system described in the above-described publication, the amount of washing water may be greatly reduced but due to the increase in the residence time of water in the tank, a problem is caused such that bacteria proliferate and the floats generated adhere to the photographic material. In order to solve such a problem, a method for reducing calcium ions or magnesium ions described in JP-A-62-288838 can be very effectively used. Further, isothiazolone compounds and thiabendazoles described in JP-A-57-8542, chlorine-based germicides such as sodium chlorinated isocyanurate or germicides such as benzotriazole described in Hiroshi Horiguchi, *Bokin, Bobai-Zai no Kagaku*, Sankyo Shuppan (1986), *Biseibutsu no Mekkin, Sakkin, Bobai-Gijutsu* compiled by Eisei Gijutsu Kai, issued by Kogyo Gijutsu Kai (1982), and *Bokin-Bobai Zai Jiten* compiled by Nippon Bokin Bobai Gakkai (1986) can be also used.

The washing water in the processing of the light-sensitive material of the present invention has a pH of from 4 to 9, preferably from 5 to 8. The temperature and the processing time of water washing may be set variously according to the characteristics and use of the light-sensitive material, but they are commonly from 15° to 45° C. and from 20 seconds to 10 minutes, preferably from 25° to 40° C. and from 30 seconds to 5 minutes, respectively. The light-sensitive material of the present invention can be processed directly with a stabilizing solution in place of the above-described water washing. In such a stabilization processing, any known methods described in JP-A-57-8543, JP-A-58-14834 and JP-A-60-220345 can be used.

In some cases, the stabilization processing may be further carried out after the above-described water washing. An example thereof is a stabilization bath containing a dye stabilizing agent and a surface active agent used as a final bath of a color light-sensitive material for photographing. Examples of the dye stabilizing agent include aldehydes such as formalin and glutaraldehyde, N-methylol compounds and hexamethylenetetramine or aldehyde sulfite addition products. This stabilization bath may also contain various chelating agent and antimolds.

The overflow solution accompanying the replenishing of the above-described washing water and/or stabilization solution can be re-used in other processing steps such as desilvering.

In the processing, for example, using an automatic developing machine, if the above-described respective processing solutions are concentrated due to evaporation, water is preferably added to correct the concentration.

A color developing agent may be incorporated into the light-sensitive material of the present invention so as to simplify and expedite the processing. The color developing agent is preferably incorporated into the light-sensitive material in the form of a precursor. Examples of the precursor include indoaniline compounds described in U.S. Pat. No. 3,342,597, Schiff base-type compounds described in U.S. Pat. No. 3,342,599, *Research Disclosure* No. 14850 and ibid., No. 15159, aldol compounds described in ibid., No. 13924, metal salt complexes described in U.S. Pat. No. 3,719,492 and urethane-based compounds described in JP-A-53-135628.

The light-sensitive material of the present invention may contain, if desired, various 1-phenyl-3-pyrazolidones for the purpose of accelerating the color development. Typical examples of the compound are described in JP-A-56-64339, JP-A-57-144547 and JP-A-58-115438.

Each processing solution used for processing the light-sensitive material of the present invention is used at a temperature of from 10° to 50° C. Usually, the temperature as a standard is from 33° to 38° C. but higher temperatures may be used to accelerate the processing to thereby shorten the processing time or on the contrary, lower temperatures may be used to achieve improved image quality or improved stability of the processing solution.

There is no particular restriction on various additives and development processing used when the present invention is applied to a black-and-white light-sensitive material and, for example, those described in JP-A-2-68539, JP-A-5-11389 and JP-A-2-58041 can be preferably used, of which pertinent portions are described below.

1. Silver halide emulsion and production process thereof:
   JP-A-2-68539, from page 8, right lower column, line 6 from the bottom to page 10, right upper column, line 12
2. Chemical sensitization method:
   JP-A-2-68539, page 10, from right upper column, line 13 to left lower column, line 16, and selenium sensitization method described in JP-A-5-11389
3. Antifoggant, stabilizer:
   JP-A-2-68539, from page 10, left lower column, line 17 to page 11, left upper column, line 7 and from page 3, left lower column, line 2 to page 4, left lower column
4. Spectral sensitizing dye:
   JP-A-2-68539, from page 4, right lower column, line 4 to page 8, right lower column and JP-A-2-58041, page 12, from left lower column, line 8 to right lower column, line 19
5. Surface active agent, antistatic agent:
   JP-A-2-68539, from page 11, left upper column, line 14 to page 12, left upper column, line 9 and JP-A-2-58041, from page 2, left lower column, line 14 to page 5, line 12.
6. Matting agent, plasticizer, lubricant:
   JP-A-2-68539, page 12, from left upper column, line 10 to right upper column, line 10 and JP-A-2-58041, from page 5, left lower column, line 13 to page 10, left lower column, line 3
7. Hydrophilic colloid:
   JP-A-2-68539, page 12, from right upper column, line 11 to left lower column, line 16
8. Hardening agent:
   JP-A-2-68539, from page 12, left lower column, line 17 to page 13, right upper column, line 6
9. Development processing:
   JP-A-2-68539, page 15, from left upper column, line 14 to left lower column, line 13

The silver halide light-sensitive material of the present invention can also be applied to a heat developable light-sensitive material described in U.S. Pat. No. 4,500,626, JP-A-60-133449, JP-A-59-218443, JP-A-61-238056 and EP-A-210660.

The synthesis example of the hydrazone compound of the present invention is described below.

SYNTHESIS EXAMPLE 1

Synthesis of Compound (I-32)

Compound (I-32) was synthesized according to Scheme 1.

Scheme 1

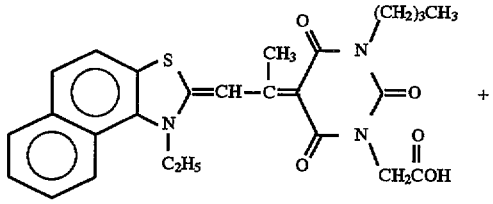

(1)

-continued

Scheme 1

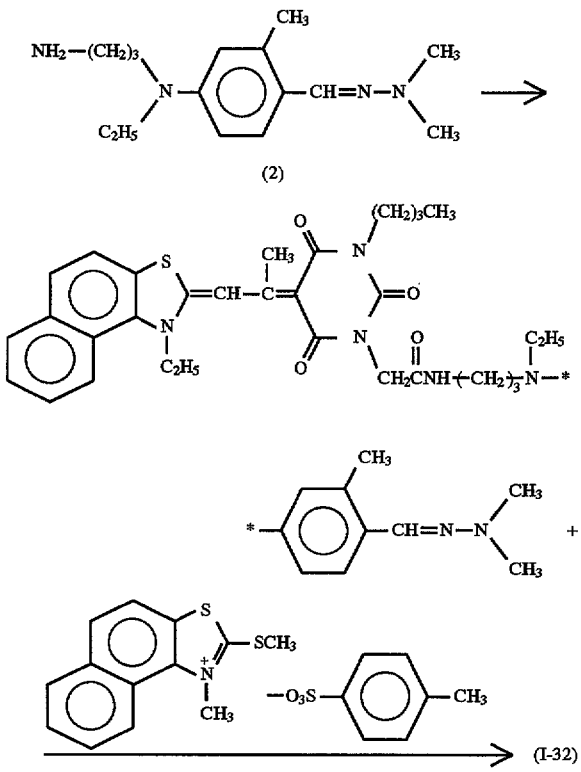

1.6 g (0.0032 mol) of Compound (1), 1.3 g (0.0049 mol) of Compound (2), 1.32 g (0.0064 mol) of DCC (dicyclohexylcabodiimide) and 16 ml of pyridine were stirred at room temperature for 24 hours. To the resulting reaction solution, 100 ml of ethyl acetate was added and the crystals precipitated were separated by suction filtration to obtain 2.27 g of Compound (3) (yield: 96%).

Thereafter, 1.5 ml (0.0105 mol) of triethylamine was added to 2.2 g (0.003 mol) of Compound (3), 1.87 g (0.0045 mol) of Compound (4) and 25 ml of dimethylacetamide and the mixture was stirred at an outer temperature of 70° C. for 1 hour. To the resulting reaction solution, 200 ml of ethyl acetate was added and the crystals precipitated were separated by suction filtration. The crystals were purified by a silica gel column chromatography (developing solvent: methanol/chloroform=1/9) and then recrystallized with methanol to obtain 70.28 g of Compound (I-32) (yield: 10%, melting point: 138°–142° C., $\lambda_{max}$: 598 nm, $\epsilon=1.87\times10^5$ (methanol)).

SYNTHESIS EXAMPLE 2

Synthesis of Compounds (I-4) and (I-2)

Compounds (I-4) and (I-2) were synthesized according to Scheme 2.

Scheme 2

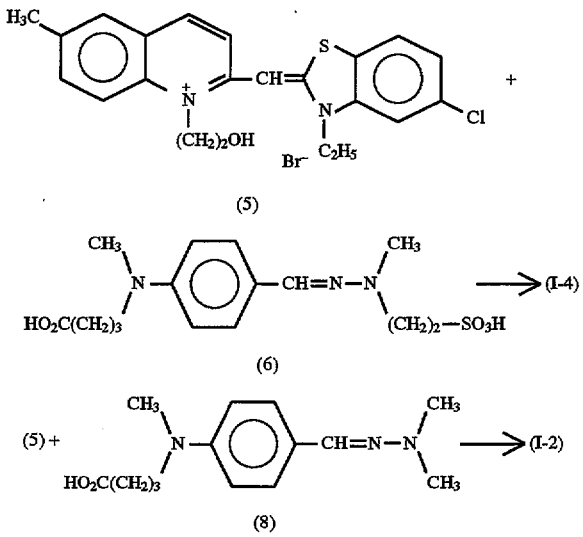

a) Synthesis of Compound (I-4)

2.9 g (0.006 mol) of Compound (5), 5.5 g (0.009 mol) of Compound (6), 0.34 g of p-toluenesulfonic acid monohydrate and 11.2 g (0.054 mol) of DCC (dicyclohexylcarbodiimide) were heated under reflux for 30 minutes. After distilling under reduced pressure, the reaction solution was purified by a silica gel column chromatography (developing solvent: methanol/chloroform=1/4) and recrystallized with isopropanol to obtain 1.14 g of Compound (I-4) (yield: 26%, melting point: 161°–163° C., $\lambda_{max}$: 492 nm ($\epsilon=4.53\times10^4$), 316 nm ($\epsilon=3.23\times10^4$)).

b) Synthesis of Compound (I-2)

Compound (I-2) was obtained in the same manner as in a) above except for replacing Compound (6) by Compound (8) (yield: 10%, melting point: 111°–116° C., $\lambda_{max}$: 492 nm ($\epsilon=5.14\times10^4$), 314 nm ($\epsilon=3.31\times10^{-4}$)).

SYNTHESIS EXAMPLE 3

Synthesis of Compound (II-10)

Compound (II-10) was synthesized according to Scheme 3.

Scheme 3

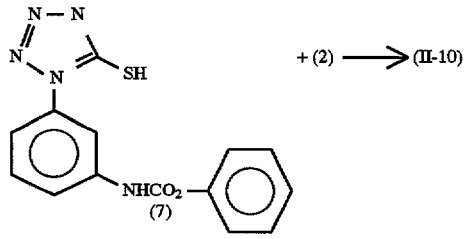

3 g (0.0096 mol) of Compound (7), 1.73 g (0.021 mol) of Compound (2), 2.8 g (0.0105 mol) of 2-methylimidazole and 30 ml of acetonitrile were heated under reflux for 1 hour. To the resulting reaction solution, 3 ml of triethylamine, 100 ml of chloroform and 100 ml of $H_2O$ were added, the chloroform layer was extracted through a separating funnel and dried over $Na_2SO_4$ and then the solvent was distilled off. To the resulting oily substance, 20 ml of methanol, 10 ml of $H_2O$ and 0.8 g of concentrated hydrochloric acid were added and the mixture was cooled to −20° C. The crystals obtained were separated by suction filtration to obtain 1.68 g of Compound (II-10) (yield: 36%, melting point: 101°–106° C.).

The synthesis example of the metallocene compound of the present invention is described below.

SYNTHESIS EXAMPLE 4

Synthesis of Compounds (IA-10) and (IA-11)

Compounds (IA-10) and (IA-11) were synthesized according to Scheme 4.

Scheme 4

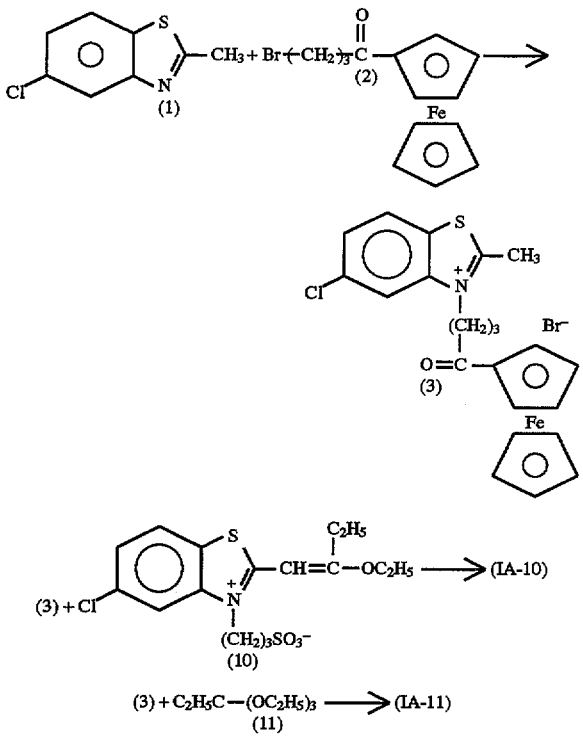

a) Synthesis of Compound (IA-10)

5 g (0.027 mol) of Compound (1) and 10 g (0.03 mol) of Compound (2) were stirred at an outer temperature of 120° C. for 2 hours, then thereto 100 ml of ethyl acetate was added and the crystals precipitated were separated by suction filtration to obtain 5 g of Compound (3) (yield: 36%).

4.5 g (0.0087 mol) of Compound (3), 2.7 g (0.007 mol) of Compound (10), 2.9 ml (0.021 mol) of triethylamine, 15 ml of acetonitrile and 30 ml of chloroform were stirred at room temperature for 1 hour, purified by a silica gel-flash column chromatography (developing solvent: methanol/dichloromethane=1/6) and then recrystallized with methanol to obtain 0.37 g of Compound (IA-10) (yield: 6.8%, melting point: 23°–232° C., $\lambda_{max}$: 562 nm, $\epsilon=1.2\times10^5$ (methanol/chloroform=9/1 solvent)).

b) Synthesis of Compound (IA-11)

4 g (0.0077 mol) of Compound (3), 4.6 g (0.026 mol) of Compound (11), 8 ml of pyridine and 1.5 ml of acetic acid were stirred under heating at an outer temperature of 120° C. for 30 minutes. The resulting reaction solution was purified by a silica gel-flash column chromatography (developing solvent: methanol/chloroform=1/4), the solvent was distilled off, 10 ml of methanol and 0.3 g of NaI were added and the crystals precipitated were separated by suction filtration to obtain 70 ml of Compound (IA-11) (yield: 1.8%, melting point: 184°–190° C., $\lambda_{max}$: 560 nm, $\epsilon=1.15\times10^5$ (methanol)).

SYNTHESIS EXAMPLE 5

Synthesis of Compounds (IA-26) and (IA-27)

Compounds (IA-26) and (IA-27) were synthesized according to Scheme 5.

Scheme 5

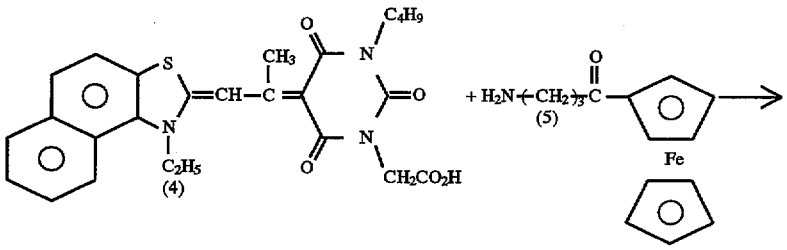

-continued

Scheme 5

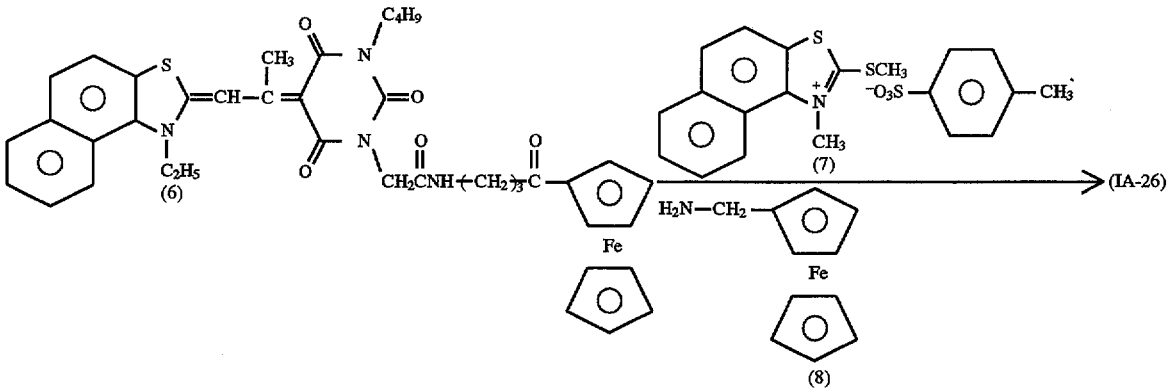

a) Synthesis of Compound (IA-26)

2.15 g (0.0044 mol) of Compound (4), 1.77 g (0.0065 mol) of Compound (5), 1.8 g (0.0087 mol) of dicyclohexylcarbodiimide (DCC) and 22 ml of pyridine were stirred at room temperature for 24 hours, then 100 ml of ethyl acetate was added thereto and the crystals precipitated were separated by suction filtration to obtain 2.06 g of Compound (6) (yield: 63%).

2 g (0.0027 mol) of Compound (6), 1.7 g (0.004 mol) of Compound (7), 1.3 ml (0.0094 mol) of triethylamine and 20 ml of dimethylacetamide were stirred under heating at an outer temperature of 70° C. for 1 hour. To the reaction solution, 100 ml of ethyl acetate was added and the crystals precipitated were separated by suction filtration, purified by a silica gel-flash column chromatography (developing solvent: methanol/chloroform=1/8) and recrystallized with methanol to obtain 0.2 g of Compound (IA-26) (yield: 8%, melting point: 229°–234° C., $\lambda_{max}$: 598 nm, $\epsilon=1.26\times10^5$ (methanol)).

b) Synthesis of Compound (IA-27)

Compound (IA-27) was obtained thoroughly in the same manner as for Compound (IA-26) except for replacing Compound (5) as a raw material by Compound (8) in the synthesis of Compound (IA-26) (yield: 33%, melting point: 137°–143° C., $\lambda_{max}$: 595 nm $\epsilon=1.20\times10^5$ (methanol)).

SYNTHESIS EXAMPLE 6

Synthesis of Compound (IA-12)

Compound (IA-12) was synthesized according to Scheme 6.

Scheme 6

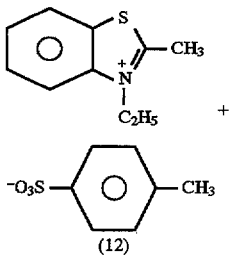

-continued

Scheme 6

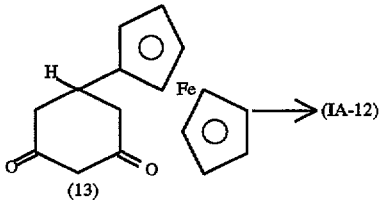

10 g (0.0286 mol) of Compound (12) and 4.24 g (0.0143 mol) of Compound (13) were stirred under heating at an outer temperature of 165° C. for 1 hour. The reaction solution was purified by a silica gel-flash column chromatography (developing solvent: methanol/chloroform=1/8) and after distilling off the solvent, crystallized by adding 50 ml of methanol, 50 ml of ethyl acetate and 50 ml of $H_2O$ and the crystals were separated by suction filtration to obtain 2.5 g of Compound (IA-12) (yield: 22%, melting point: decomposed around 200° C., $\lambda_{max}$: 648 nm, $\epsilon=1.91\times10^5$ (methanol)).

The present invention is described below in greater detail with reference to examples, but the present invention should not be construed as being limited to these examples.

EXAMPLE 1

To a reaction vessel, 1,000 ml of water, 25 g of deionized osseous gelatin, 15 ml of a 50% aqeuous $NH_4NO_3$ solution and 7.5 ml of a 25% aqueuos $NH_3$ solution were added and the mixture was kept at 50° C. and well dried. Then, 750 ml of a 1N $AgNO_3$-aqueous solution and a 1N-KBr aqueous solution were added thereto over 50 minutes. The silver potential during the reaction was kept +50 mV to the saturation calomel electrode.

The resulting silver bromide grains were monodisperse grains each being cubic and having an average side length of from 0.75 to 0.8 μm. To this emulsion a copolymer of isobutene and monosodium maleate was added, the emulsion was washed by sedimentation to be desalted and thereto 95 g of deionized osseous gelatin and 430 ml of water were added. After adjusting the pH and the pAg at 50° C. to 6.5 and 8.3, respectively, the emulsion was ripened at 55° C. for 50 minutes by adding sodium thiosulfate so as to give optimal sensitivity. The resulting emulsion contained 0.74 mol/kg of silver bromide.

Further, to 45 g of this emulsion, sensitizing dyes and subsequently, compounds represented by formula (I) or (II)

were added as shown in Tables 1 and 2 and each mixture was mixed and stirred at 40° C.

To the mixture, 15 g of a 10% gel of deionized gelatin and 55 ml of water were added and the resulting solution was coated on a polyethylene terephthalate film base as follows.

The amount of the coating solution was set so as to give a silver amount of 2.5 g/m$^2$ and a gelatin amount of 3.8 g/m$^2$ and an aqueous solution containing as main components 0.22 g/l of sodium dodecylbenzene sulfonate, 0.50 g/l of sodium p-sulfostyrene homopolymer, 3.1 g/l of sodium 2,4-dichloro-6-hydroxy-1,3,5-triazine and 50 g/l of gelatin was simultaneously coated as an upper layer to give a gelatin amount of 1.0 g/m$^2$.

Each sample was exposed to tungsten light (2856° K) for 1 second through a continuous wedge using a blue filter (a band pass filter transmitting light of from 395 to 440 nm) and a yellow filter (a filter transmitting light having a wavelength longer than 560 nm).

After the exposure, each sample was developed with a developer having the following composition at 20° C. for 10 minutes. The developed film was measured on the density using a densitometer manufactured by Fuji Photo Film Co., Ltd. and a yellow filter sensitivity (SY), a blue filter sensitivity (SB) and fog were determined. The standard point of optical density in determining the sensitivity was [fog+0.2]. The SB was shown by a relative sensitivity to the sensitivity, taken as 100, of a sample to which a sensitizing dye and a hydrazone compound were not added. The SY was shown by a relative value between samples having added thereto the same sensitizing dye, while taking the sensitivity of a sample to which a hydrazone compound was not added as 100.

| Composition of Developer: | |
|---|---|
| Metol | 2.5 g |
| α-Ascorbic acid | 10.0 g |
| Potassium bromide | 1.0 g |
| Nabox | 35.0 g |
| Water to make | 1.0 liter (pH 9.8) |

The results obtained as a relative value are shown in Tables 1 and 2.

Comparative Compound (A-1)

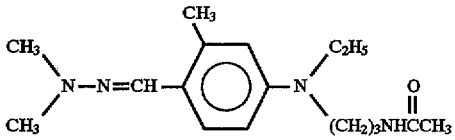

(A-2)

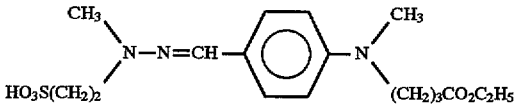

Compound described in Example 1 of U.S. Pat. No. 3,679,427 (A-3)

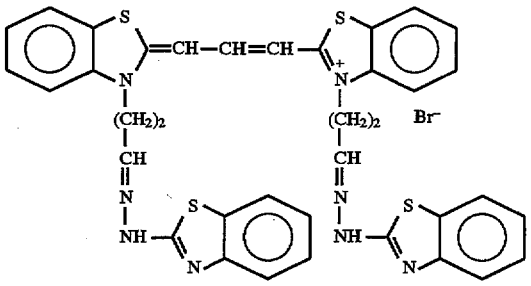

Compound (7) of JP-A-61-196240 (A-4)

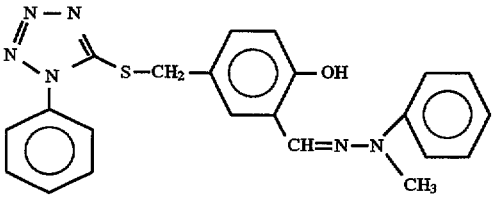

(A-5)

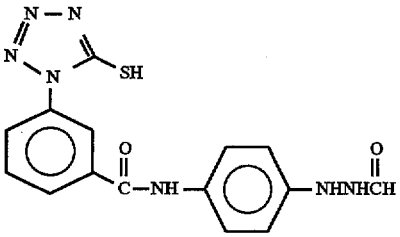

(B-1)

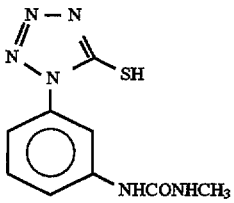

(B-2)

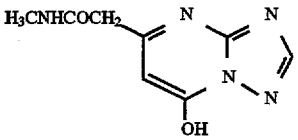

(B-3)

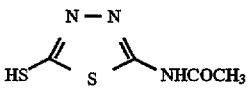

(B-4)

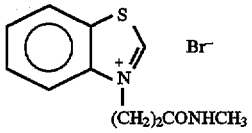

(C-1)

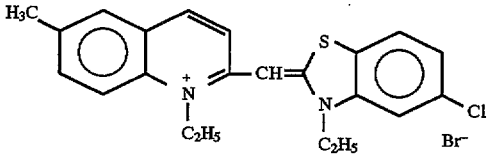

-continued

Comparative Compound

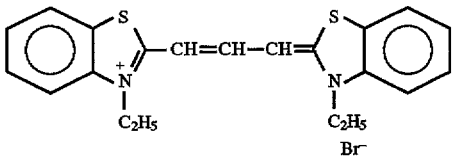

(C-2)

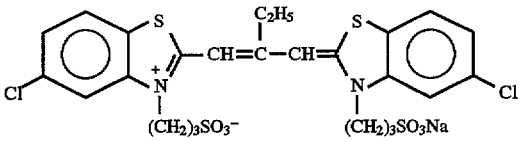

(C-3)

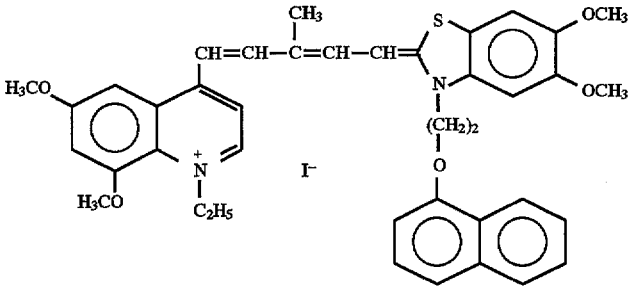

(C-4)

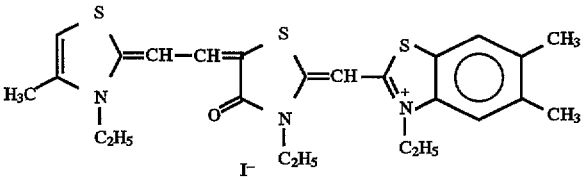

(C-5)

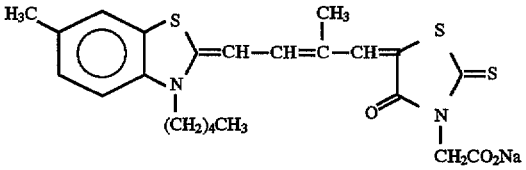

(C-6)

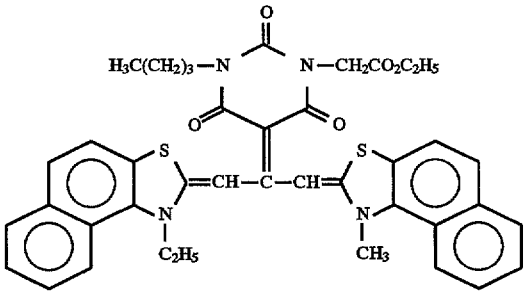

(C-7)

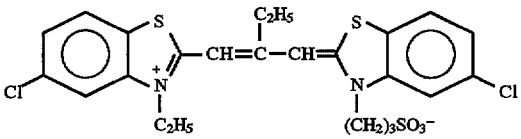

(C-8)

TABLE 1

| Test No. | Sensitizing Dye and Addition Amount ($10^{-4}$ mol/mol-Ag) | | Hydrazone Compound or Comparative Compound and Addition Amount ($10^{-4}$ mol/mol-Ag) | | Relative Sensitivity SB | Relative Sensitivity SY | Fog | Remarks |
|---|---|---|---|---|---|---|---|---|
| 1-1 | — | | — | | 100 (standard) | — | 0.03 | Comparison |
| 1-2 | C-1 | 4.5 | — | | 85 | 100 (standard) | 0.07 | " |
| 1-3 | " | " | (A-5) | 1 | 83 | 101 | 0.09 | " |
| 1-4 | " | " | (A-2) | 1 | 86 | 105 | 0.07 | " |
| 1-5 | " | " | (A-2) | 10 | 88 | 107 | 0.07 | " |
| 1-6 | " | 3.5 | (I-4) | 1 | 99 | 235 | 0.05 | Invention |
| 1-7 | " | 4.5 | (A-1) | 1 | 86 | 105 | 0.07 | Comparison |
| 1-8 | " | " | (B-1) | 1 | 81 | 98 | 0.07 | " |
| 1-9 | " | " | (II-10) | 1 | 100 | 245 | 0.05 | Invention |
| 1-10 | C-2 | 8.0 | — | | 65 | 100 (standard) | 0.09 | Comparison |
| 1-11 | " | " | (A-1) | 1 | 68 | 105 | 0.09 | " |
| 1-12 | " | 7.0 | (A-3) | 1 | 65 | 102 | 0.12 | " |
| 1-13 | " | " | (I-13) | 1 | 85 | 263 | 0.05 | Invention |
| 1-14 | C-3 | 8.0 | — | | 60 | 100 (standard) | 0.09 | Comparison |
| 1-15 | " | " | (A-1) | 1 | 63 | 108 | 0.09 | " |
| 1-16 | " | " | (B-1) | 1 | 58 | 100 | 0.09 | " |

TABLE 1-continued

| Test No. | Sensitizing Dye and Addition Amount ($10^{-4}$ mol/mol-Ag) | | Hydrazone Compound or Comparative Compound and Addition Amount ($10^{-4}$ mol/mol-Ag) | | Relative Sensitivity SB | SY | Fog | Remarks |
|---|---|---|---|---|---|---|---|---|
| 1-17 | " | " | (B-2) | 1 | 57 | 99 | 0.09 | " |
| 1-18 | " | " | (A-4) | 1 | 60 | 99 | 0.07 | " |
| 1-19 | " | " | (II-10) | 1 | 84 | 325 | 0.05 | Invention |
| 1-20 | " | " | (II-1) | 1 | 83 | 310 | " | " |

TABLE 2

| Test No. | Sensitizing Dye and Addition Amount ($10^{-4}$ mol/mol-Ag) | | Hydrazone Compound or Comparative Compound and Addition Amount ($10^{-4}$ mol/mol-Ag) | | Relative Sensitivity SB | SY | Fog | Remarks |
|---|---|---|---|---|---|---|---|---|
| 1-21 | C-4 | 2.0 | — | | 42 | 100 (standard) | 0.15 | Comparison |
| 1-22 | " | " | (A-1) | 0.5 | 43 | 105 | 0.15 | " |
| 1-23 | " | " | (B-3) | " | 38 | 98 | 0.14 | " |
| 1-24 | " | " | (II-14) | " | 65 | 375 | 0.08 | Invention |
| 1-25 | C-5 | 6.0 | — | | 75 | 100 (standard) | 0.10 | Comparison |
| 1-26 | " | " | (A-1) | 1 | 76 | 101 | 0.10 | " |
| 1-27 | " | " | (B-3) | 1 | 72 | 85 | 0.09 | " |
| 1-28 | " | " | (II-20) | 1 | 93 | 283 | 0.05 | Invention |
| 1-29 | " | 5.0 | (I-29) | 1 | 92 | 275 | 0.05 | " |
| 1-30 | C-6 | 4.0 | — | | 70 | 100 (standard) | 0.12 | Comparison |
| 1-31 | " | " | (A-1) | 0.5 | 70 | 102 | 0.12 | " |
| 1-32 | " | " | (B-1) | " | 65 | 95 | 0.12 | " |
| 1-33 | " | " | (II-10) | " | 93 | 330 | 0.08 | Invention |
| 1-34 | " | 3.5 | (I-24) | " | 92 | 321 | 0.08 | " |
| 1-35 | C-8 | 10.0 | — | | 58 | 100 (standard) | 0.09 | Comparison |
| 1-36 | " | " | (A-1) | 1 | 59 | 102 | 0.09 | " |
| 1-37 | " | " | (B-1) | " | 55 | 95 | 0.09 | " |
| 1-38 | " | " | (C-7) | " | 65 | 115 | 0.09 | " |
| 1-39 | " | " | (II-10) | " | 87 | 295 | 0.07 | Invention |
| 1-40 | " | " | (I-32) | " | 86 | 275 | 0.07 | " |

As is clearly seen from the results in Tables 1 and 2, by using the hydrazone compound of the present invention, the dye desensitization (SB) was improved and the spectral sensitivity (SY) was remarkably increased. Also, fog was reduced. The effect on improvements are outstandingly large as compared with the results of conventionally known comparative compounds.

EXAMPLE 2

(1) Preparation of Emulsion

To an aqueous solution containing 6 g of potassium bromide and 30 g of inactive gelatin having an average molecular weight of 15,000 dissolved in 3.7 l of distilled water, while well stirring the aqueous solution, a 14% aqueous potassium bromide solution and a 20% aqueous silver nitrate solution were added by a double jet method at a constant flow rate over 1 minute at 55° C. and a pBr of 1.0 (at this addition, 2.4% of the total silver amount was consumed).

An aqueous gelatin solution (17%, 300 ml) was added thereto, the mixture was stirred at 55° C. and then a 20% aqueous silver nitrate solution was added at a constant flow rate until the pBr reached 1.4 (at this addition, 5.0% of the total silver amount was consumed). Further, a 20% potassium iodobromide solution ($KBr_{1-x}I_x$; x=0.04) and a 33% aqueous silver nitrate solution were added by a double jet method over 43 minutes (at this addition, 50% of the total silver amount was consumed). After adding thereto an aqueous solution containing 8.3 g of potassium iodide, 14.5 ml of a 0.001 wt % $K_3IrCl_6$-aqueous solution was added and then a 20% potassium bromide solution and a 33% aqueous silver nitrate solution were added by a double jet method over 39 minutes (at this addition, 42.6% of the total silver amount was consumed). The amount of silver nitrate used in this emulsion was 425 g. After desalting by usual flocculation method, the pAg and the pH were adjusted at 40° C. to 8.2 and 5.8, respectively. As a result, Tabular Silver Iodobromide Emulsion (Em-1) having an average aspect ratio of 6.5, a coefficient of variation of 18% and a sphere-corresponding diameter of 0.8 μm was prepared. From the observation through a 200 kV transmission-type electron microscope at a liquid $N_2$ temperature, it was found that dislocation lines were present in the vicinity of the outer circumference of a tabular grain in the number of 50 or more on average per one grain. Emulsion Em-2 was prepared thoroughly in the same manner as for Emulsion Em-1 except for conducting grain formation by adding, after the pBr reached 1.4, only thiourea dioxide to the reaction vessel in an amount of $1.2\times10^{-5}$ mol per mol of silver. Further, Emulsion Em-3 was prepared thoroughly in the same manner as for Emulsion Em-2 except for replacing the thiourea dioxide by $2.5\times10^{-3}$ mol/mol-Ag of an L-ascorbic acid.

Emulsion Em-4 was prepared thoroughly in the same manner as for Emulsion Em-2 except that in the grain formation of Emulsion Em-2, Compound (XX-2) was added 10 minutes after the initiation of final shell formation, in an amount of $1.2\times10^{-4}$ mol per mol of silver.

To each of the thus-prepared Emulsions Em-1 to Em-4, $5\times10^{-4}$ mol/mol-Ag of Sensitizing Dye A, $2\times10^{-4}$ mol/mol-Ag of Sensitizing Dye B and $2\times10^{-4}$ mol/mol-Ag of Sensitizing Dye C shown in Table 3 were added and then each sample was subjected to optimal gold-selenium-sulfur sensitization by adding thereto sodium thiosulfate, chloroauric acid, N,N-dimethylselenourea and potassium thiocyanate. Thus, Emulsions 101 to 104 were prepared.

TABLE 3

Sensitizing Dye A

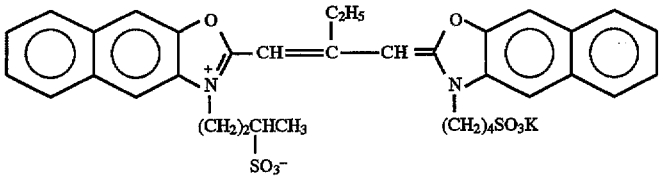

Sensitizing Dye B

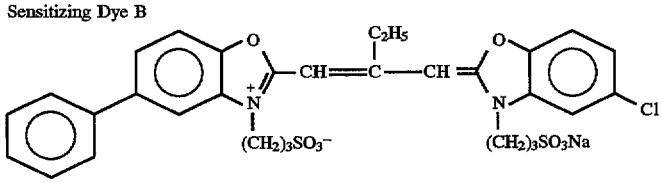

Sensitizing Dye C

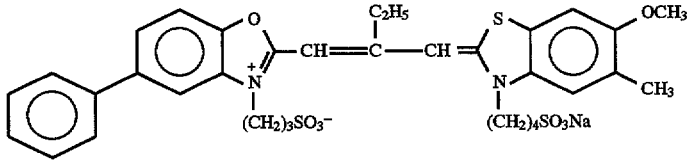

Further, Emulsions 105 to 108 were prepared in the same manner as for Emulsions 101 to 104 except that $0.5\times10^{-4}$ mol/mol-Ag of Compound (I-6) of the present invention was added to each of Emulsions Em-1 to Em-4 and the addition amount of Sensitizing Dye C was reduced to $5.5\times10^{-4}$ mol/mol-Ag. Also, Emulsions 109 to 112 were prepared in the same manner as for Emulsions 101 to 104 except for adding $0.9\times10^{-4}$ mol/mol-Ag of Compound (II-10) of the present invention to each of Emulsions Em-1 to Em-4.

An emulsion layer and a protective layer were coated on a triacetyl cellulose support having an undercoat layer in an amount as shown in Table 4 to prepare Samples 1001 to 1012 using emulsions 101 to 112, respectively.

TABLE 4

Emulsion Coating Conditions

| | |
|---|---|
| (1) Emulsion Layer | |
| Emulsion (Emulsions 101 to 112) | as silver $2.1\times10^{-2}$ mol/m$^2$ |
| Coupler | $1.5\times10^{-3}$ mol/m$^2$ |

TABLE 4-continued

Emulsion Coating Conditions

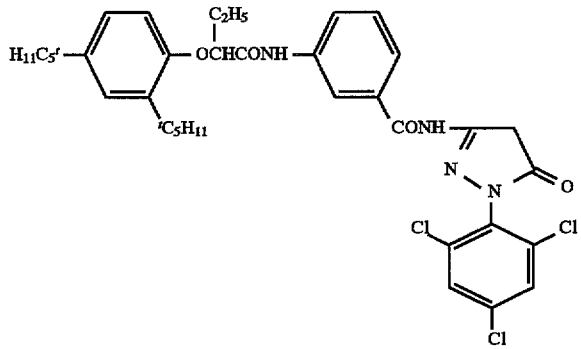

| | |
|---|---|
| Tricresyl phosphate | 1.10 g/m$^2$ |
| Gelatin | 2.30 g/m$^2$ |
| (2) Protective Layer | |
| 2,4-Dichlorotriazine-6-hydroxy-s-triazine sodium salt | 0.08 g/m$^2$ |
| Gelatin | 1.80 g/m$^2$ |

Each of these samples was subjected to exposure for sensitometry for 1/100 second through a continuous wedge at a color temperature of 4800° K and then to development processing at 38° C. under the following conditions.

Processing Procedure:

| Step | Processing Time (sec.) | Processing Temperature (°C.) |
|---|---|---|
| Color development | 45 | 38 |
| Bleaching | 30 | 38 |
| Fixing | 45 | 38 |
| Stabilization (1) | 20 | 38 |
| Stabilization (2) | 20 | 38 |
| Stabilization (3) | 20 | 38 |
| Drying | 30 | 60 |

*Stabilization was in a countercurrent system from Stabilization (3) to Stabilization (1).

The composition of each processing solution is shown below.

(Color Developer)

| | |
|---|---|
| Ethylenetriaminetetraacetic acid | 3.0 g |
| Disodium 4,5-dihydroxybenzene-1,3-disulfonate | 0.3 g |
| Potassium carbonate | 30.0 g |
| Sodium chloride | 5.0 g |
| Disodium N,N-bis(sulfonate ethyl)-hydroxylamine | 6.0 g |
| 4-[N-Ethyl-N-(β-hydroxyethyl)amino]-2-methylaniline sulfate | 5.0 g |
| Water to make | 1.0 liter |
| pH (adjusted with potassium hydroxide and sulfuric acid) | 10.00 |

(Bleaching Solution)

| | |
|---|---|
| Ammonium 1,3-diaminopropanetetraacetato ferrate monohydrate | 140 g |
| 1,3-Diaminopropanetetraacetic acid | 3 g |
| Ammonium bromide | 80 g |
| Ammonium nitrate | 15 g |
| Hydroxyacetic acid | 25 g |
| Acetic acid (98%) | 40 g |
| Water to make | 1.0 liter |
| pH (adjusted with aqueous ammonia and acetic acid) | 4.3 |

(Fixing Solution)

| | |
|---|---|
| Disodium ethylenediaminetetraacetate | 15 g |
| Ammonium sulfite | 19 g |
| Imidazole | 15 g |
| Ammonium thiosulfate (70 wt %) | 280 ml |
| Water to make | 1.0 liter |
| pH (adjusted with aqueous ammonia and acetic acid) | 7.4 |

(Stabilizing Solution)

| | |
|---|---|
| Sodium p-toluenesulfinate | 0.03 g |
| Polyoxyethylene-p-monononylphenyl ether (average polymerization degree: 10) | 0.2 g |
| Disodium ethylenediaminetetraacetate | 0.05 g |
| 1,2,4-triazole | 1.3 g |
| 1,4-Bis(1,2,4-triazole-1-ylmethyl)-piperazine | 0.75 g |
| Water to make | 1.0 liter |
| pH (adjusted with aqueous ammonia and acetic acid) | 8.5 |

Each of the processed samples was determined on the density using a green filter.

Evaluation was made on the resulting sensitivity and fog. With respect to the sensitivity, a relative value to the reciprocal of an exposure amount required to give an optical density 0.2 higher than the fog was shown as the sensitivity. Separately, unexposed films were stored at 30% RH and 60° C. for 3 days and then exposed and developed in the same manner and evaluation was made on the resulting sensitivity and fog.

The results obtained are shown in Table 5.

TABLE 5

| Sample | Emulsion | Reduction Sensitizer | Thiosulfonic Acid | Fresh Fog | Fresh Sensitivity | Aged Fog | Aged Sensitivity | Remarks |
|---|---|---|---|---|---|---|---|---|
| 1001 | 101 | none | none | 0.23 | 100 | 0.40 | 95 | Comparison |
| 1002 | 102 | thiourea dioxide | " | 0.46 | 108 | 0.86 | 104 | " |
| 1003 | 103 | L-ascorbic acid | " | 0.42 | 117 | 0.85 | 110 | " |
| 1004 | 104 | thiourea dioxide | (XX-2) | 0.40 | 123 | 0.80 | 115 | " |
| 1005 | 105 | none | none | 0.15 | 145 | 0.17 | 142 | Invention |
| 1006 | 106 | thiourea dioxide | " | 0.15 | 176 | 0.17 | 174 | |
| 1007 | 107 | L-ascorbic acid | " | 0.15 | 178 | 0.17 | 176 | " |
| 1008 | 108 | thiourea dioxide | (XX-2) | 0.12 | 195 | 0.12 | 194 | " |
| 1009 | 109 | none | none | 0.15 | 148 | 0.17 | 146 | " |
| 1010 | 110 | thiourea dioxide | " | 0.15 | 182 | 0.17 | 181 | " |
| 1011 | 111 | L-ascorbic acid | " | 0.15 | 180 | 0.17 | 179 | " |
| 1012 | 112 | thiourea dioxide | (XX-2) | 0.11 | 198 | 0.08 | 198 | " |

As is clearly seen from Table 5, Samples 1005 to 1012 of the present invention each was high in the sensitivity and reduced in the fog and also showed high storage stability as compared with comparative samples. These effects were remarkable in samples subjected to reduction sensitization.

Samples 1008 and 1012 using a thiosulfonic acid were particularly outstanding in view of these effects.

EXAMPLE 3

A multi-layer color light-sensitive material as Sample 101 was prepared by coating layers each having the following composition in a superposed fashion on a cellulose triacetate film support having an undercoat layer.

Composition of Light-Sensitive Layer

Numerals corresponding to respective ingredients show coating amounts expressed by the unit g/m$^2$ and in case of silver halide, they show coating amounts in terms of silver. With respect to sensitizing dyes, the coating amount is shown by the unit mol per mol of silver halide in the same layer.

(Sample 101)

First Layer (antihalation layer)

| | | |
|---|---|---|
| Black colloidal silver | as silver | 0.09 |
| Gelatin | | 1.30 |
| ExM-1 | | 0.12 |
| ExF-1 | | $2.0 \times 10^{-3}$ |
| Solid Disperse Dye ExF-2 | | 0.030 |
| Solid Disperse Dye ExF-3 | | 0.040 |
| HBS-1 | | 0.15 |
| HBS-2 | | 0.02 |

Second Layer (interlayer)

| | | |
|---|---|---|
| ExC-2 | | 0.04 |
| Polyethylacrylate latex | | 0.20 |
| Gelatin | | 1.04 |

Third Layer (low sensitivity red-sensitive emulsion layer)

| | | |
|---|---|---|
| Emulsion A | as silver | 0.25 |
| Emulsion B | as silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |

Fourth Layer (medium sensitivity red-sensitive emulsion layer)

| | | |
|---|---|---|
| Emulsion D | as silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |

Fifth Layer (high sensitivity red-sensitive emulsion layer)

| | | |
|---|---|---|
| Emulsion D | as silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |

Sixth Layer (interlayer)

| | | |
|---|---|---|
| Cpd-1 | | 0.090 |
| Solid Disperse Dye ExF-4 | | 0.030 |
| HBS-1 | | 0.050 |
| Polyethylacrylate latex | | 0.15 |
| Gelatin | | 1.10 |

Seventh Layer (low sensitivity green-sensitive emulsion layer)

| | | |
|---|---|---|
| Emulsion A | as silver | 0.15 |
| Emulsion B | as silver | 0.15 |
| Emulsion C | as silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |

-continued (Sample 101)

| | | |
|---|---|---|
| HBS-3 | | 0.010 |
| Gelatin | | 0.73 |

Eighth Layer (medium sensitivity green-sensitive emulsion layer)

| | | |
|---|---|---|
| Emulsion (Emulsions 101 to 112) | as silver | 1.20 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.88 |

Ninth Layer (high sensitivity green-sensitive emulsion layer)

| | | |
|---|---|---|
| Emulsion D | as silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.00 |

Tenth Layer (yellow filter layer)

| | | |
|---|---|---|
| Yellow colloidal silver | as silver | 0.015 |
| Cpd-1 | | 0.16 |
| Solid Disperse Dye ExF-5 | | 0.060 |
| Solid Disperse Dye ExF-6 | | 0.060 |
| Oil-Soluble Dye ExF-7 | | 0.010 |
| HBS-1 | | 0.60 |
| Gelatin | | 0.70 |

Eleventh Layer (low sensitivity blue-sensitive emulsion layer)

| | | |
|---|---|---|
| Emulsion A | as silver | 0.08 |
| Emulsion B | as silver | 0.07 |
| Emulsion F | as silver | 0.07 |
| ExS-7 | | $8.6 \times 10^{-4}$ |
| ExC-8 | | $7.0 \times 10^{-3}$ |
| ExY-1 | | 0.050 |
| ExY-2 | | 0.73 |
| ExY-4 | | 0.020 |
| Cpd-2 | | 0.10 |
| Cpd-3 | | $4.0 \times 10^{-3}$ |
| HBS-1 | | 0.32 |
| Gelatin | | 1.20 |

Twelfth Layer (high sensitivity blue-sensitive emulsion layer)

| | | |
|---|---|---|
| Emulsion G | as silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |

Thirteenth Layer (first protective layer)

| | | |
|---|---|---|
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.2 |

Fourteenth Layer (second protective layer)

| | | |
|---|---|---|
| Emulsion I | as silver | 0.10 |
| H-1 | | 0.40 |
| B-1 (diameter: 1.7 μm) | | $5.0 \times 10^{-2}$ |

-continued

| (Sample 101) | |
|---|---|
| B-2 (diameter: 1.7 μm) | 0.15 |
| B-3 | 0.05 |
| S-1 | 0.20 |
| Gelatin | 0.70 |

Further, in order to provide good preservability, processability, pressure durability, antimold/fungicidal property, antistatic property and coatability, W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, iron salt, lead salt, gold salt, platinum salt, palladium salt, iridium salt or rhodium salt was appropriately added to each layer.

Preparation of Dispersion Product of Organic Solid Disperse Dye

Solid Disperse Dye ExF-2 was dispersed as follows. That is, 21.7 ml of water, 3 ml of a 5% aqueous solution of sodium p-octylphenoxyethoxyethoxyethanesulfonate and 0.5 g of a 5% aqueous solution of p-octylphenoxypolyoxyethylene ether (polymerization degree: 10) were poured into 700 ml-volume pot mill, then thereto 5.0 g of Dye ExF-2 and 500 ml of zirconium oxide beads (diameter: 1 mm) were added and the content was dispersed for 2 hours. In this dispersion, a BO-type vibration ball mill manufactured by Chuo Koki KK was used. After the dispersion, the content was taken out and added to 8 g of a 12.5% aqueous gelatin solution and the beads were removed by filtration to obtain a gelatin dispersion of the dye. The dye fine particles had an average particle size of 0.44 μm.

Solid dispersion products of ExF-3, ExF-4 and ExF-6 each was obtained in the same manner. The average particle size of dye fine particles was 0.24, 0.45 or 0.52 μm, respectively. ExF-5 was dispersed by the microprecipitation method described in Example 1 of EP-A-549489. The average particle size was 0.06 μm.

Specifications of emulsions used are shown in Table 6 and chemical structures of compounds used are shown in the following pages.

TABLE 6

| Emulsion | Average AgI Content (%) | Average grain size (μm) | Coefficient of Variation of Grain Size (%) | Diameter/ Thickness Ratio | Silver Amount Ratio (AgI content %)) |
|---|---|---|---|---|---|
| A | 4.0 | 0.45 | 27 | 1 | core/shell = 1/3 (13/1), double structure grain |
| B | 8.9 | 0.70 | 14 | 1 | core/shell = 3/7 (25/2), double structure grain |
| C | 10 | 0.75 | 30 | 2 | core/shell = 1/2 (24/3), double structure grain |
| D | 16 | 1.05 | 35 | 2 | core/shell = 4/6 (40/0), double structure grain |
| F | 4.0 | 0.25 | 28 | 1 | core/shell = 1/3 (13/1), double structure grain |
| G | 14.0 | 0.75 | 25 | 2 | core/shell = 1/2 (42/0), double structure grain |
| I | 1 | 0.07 | 15 | 1 | uniform grain |

ExC-1

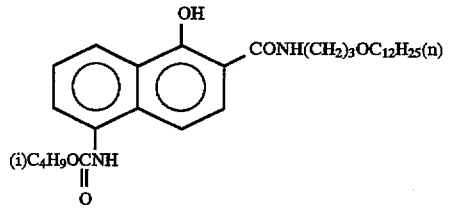

ExC-2

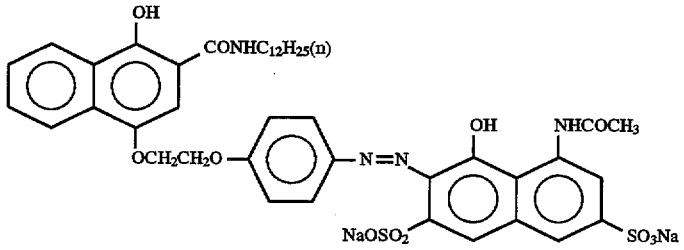

ExC-3

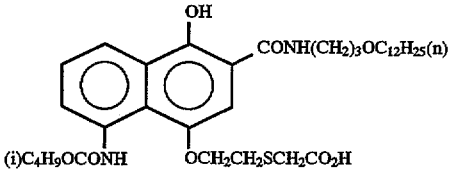

ExC-4

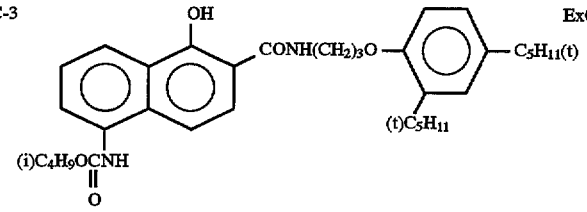

-continued
ExC-5
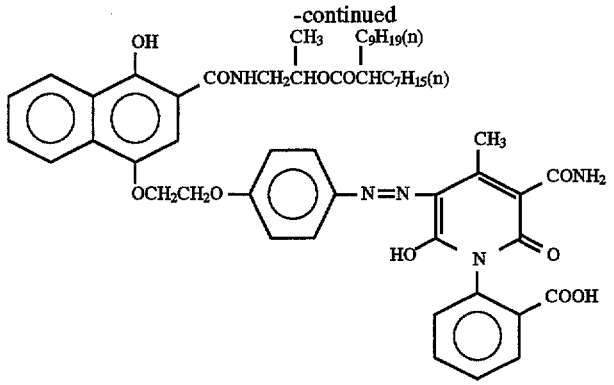
ExC-6
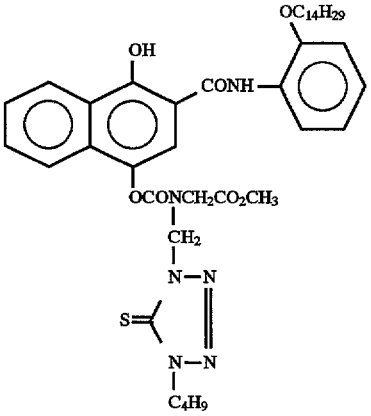
ExC-7
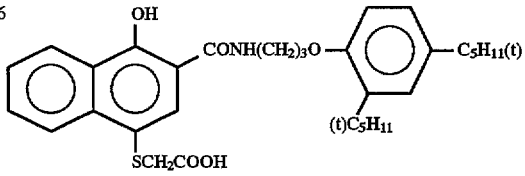
ExC-8
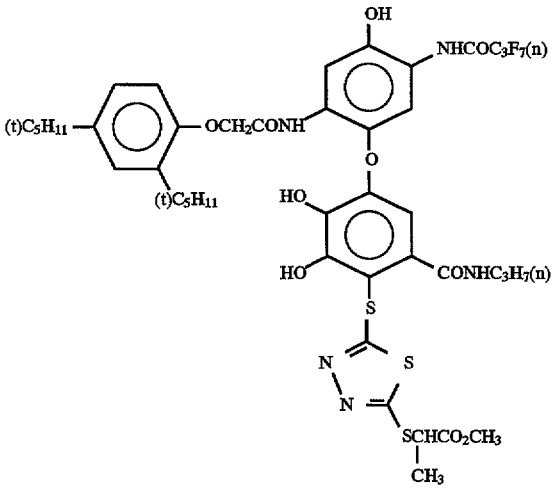
ExM-1
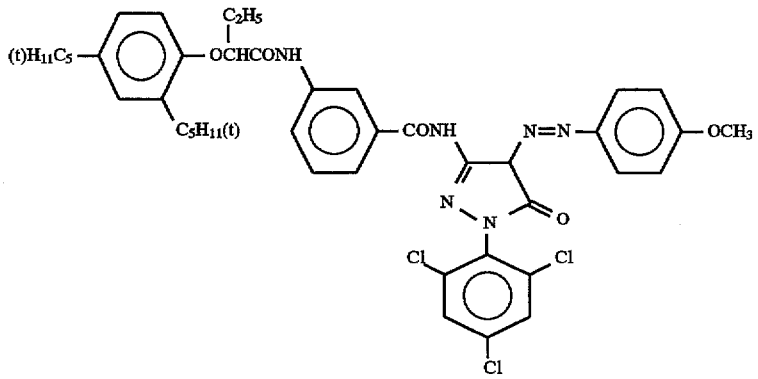

-continued
ExM-2
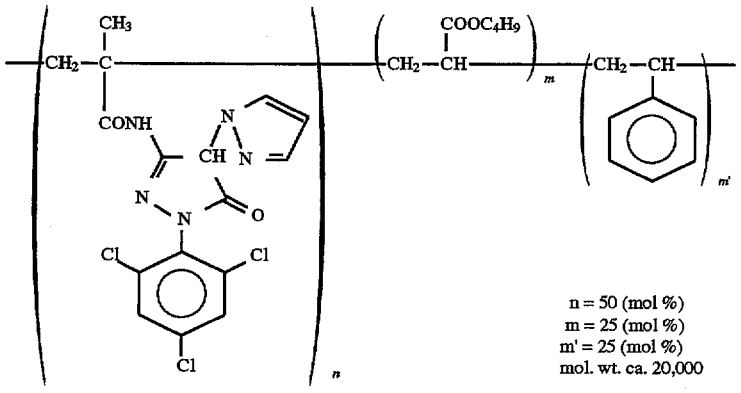
n = 50 (mol %)
m = 25 (mol %)
m' = 25 (mol %)
mol. wt. ca. 20,000
ExM-3
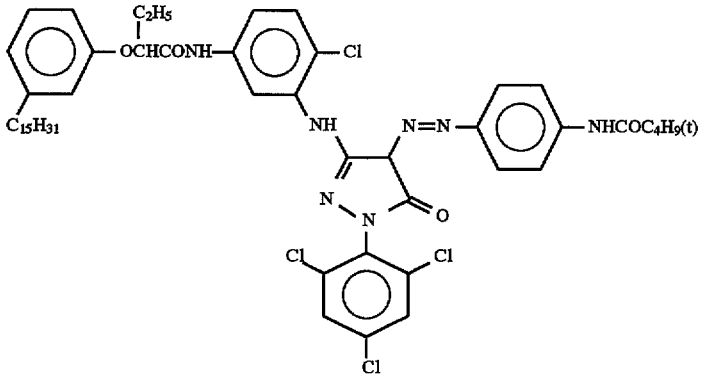
ExM-4
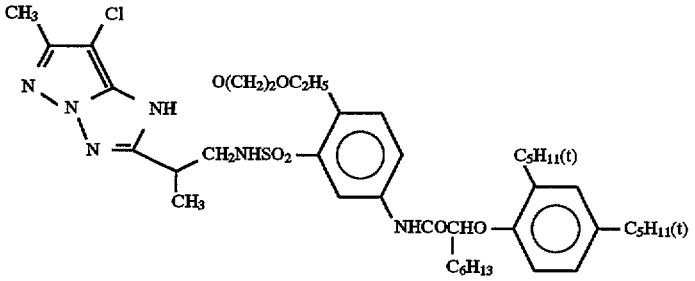
ExM-5
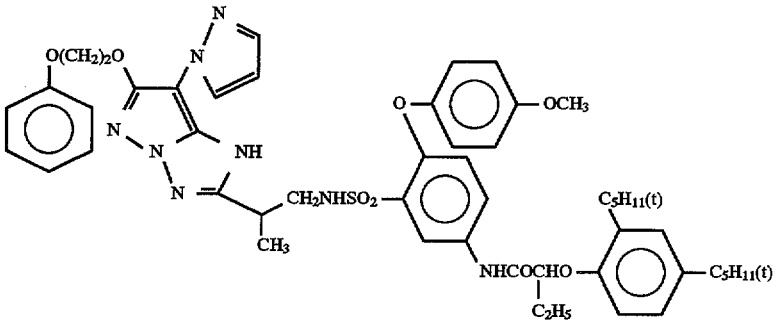

-continued
ExY-1
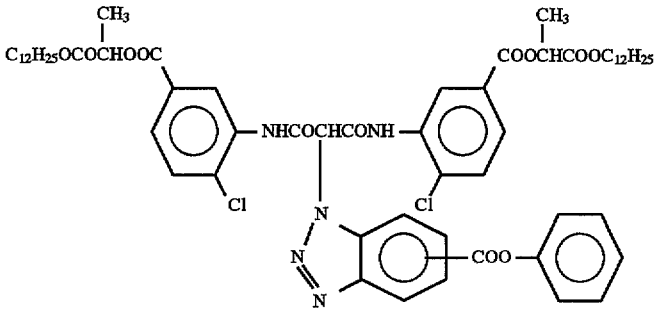
ExY-2
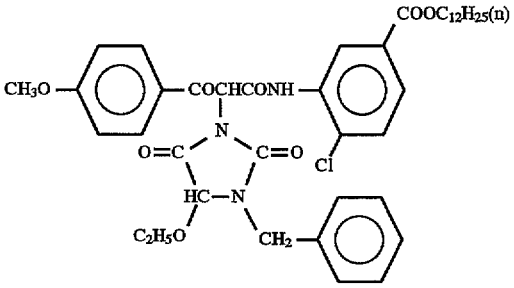
ExY-3
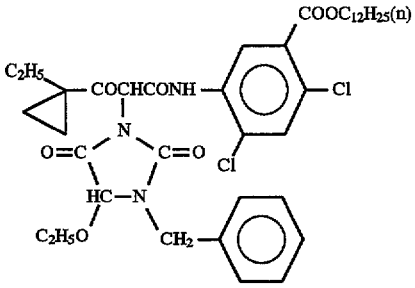
ExY-4
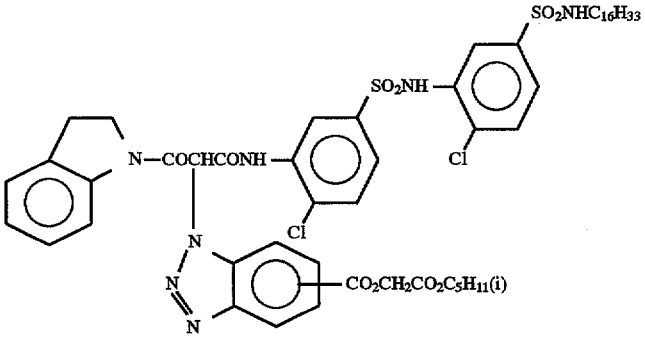
Cpd-1
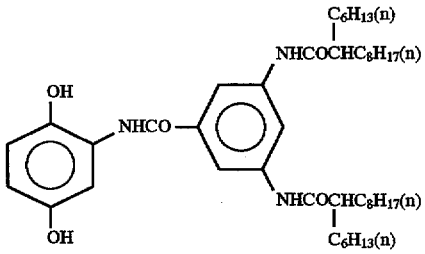
Cpd-2
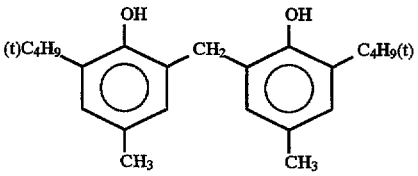
Cpd-3
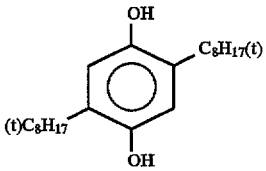
UV-1
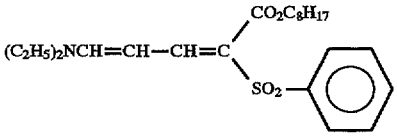
UV-2
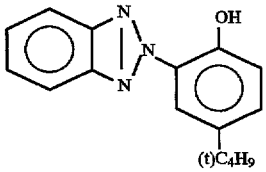

-continued
UV-3
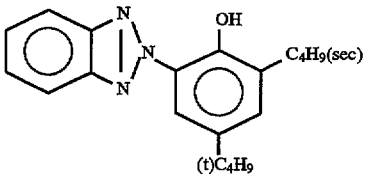
Tricresyl phosphate HBS-1
Di-n-butyl phthalate HBS-2
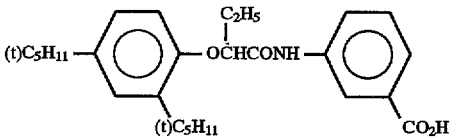
HBS-3
Tri(2-ethylhexyl) phosphate HBS-4
ExY-5
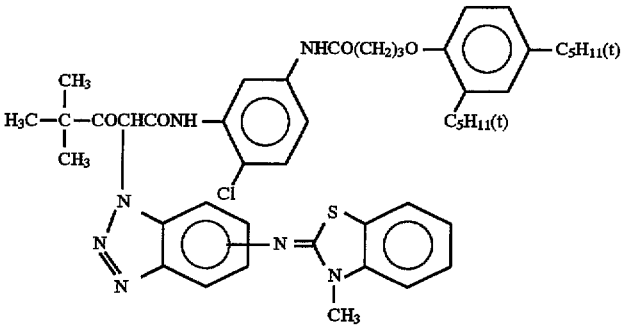
ExF-1
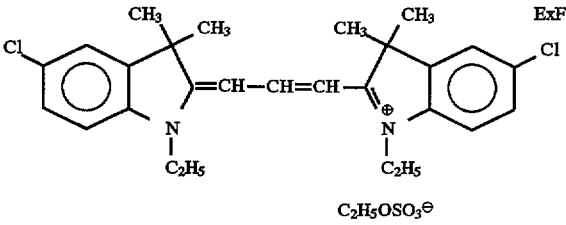
ExF-2
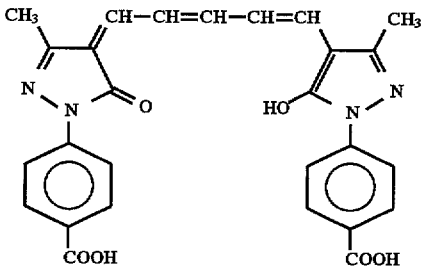
ExF-3
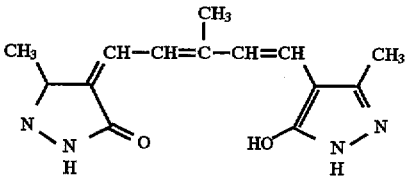
ExF-4
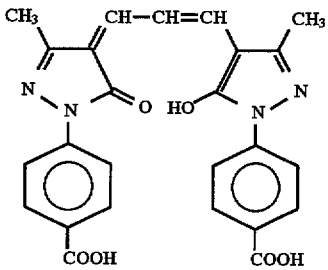
ExF-5
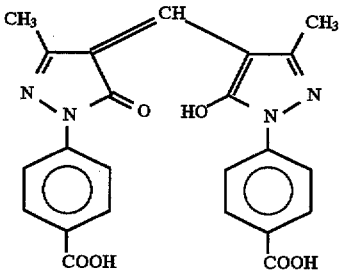
ExF-6
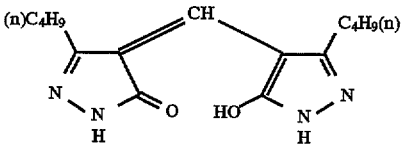

-continued
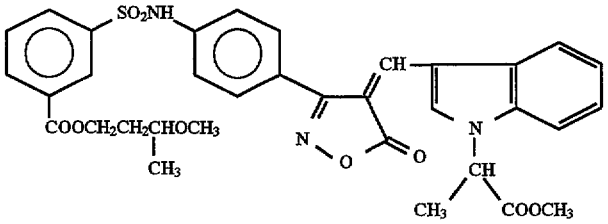
ExF-7
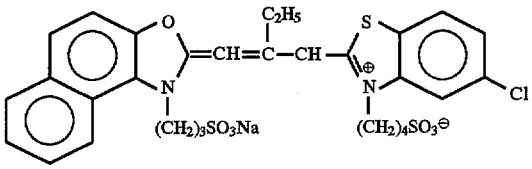
ExS-1
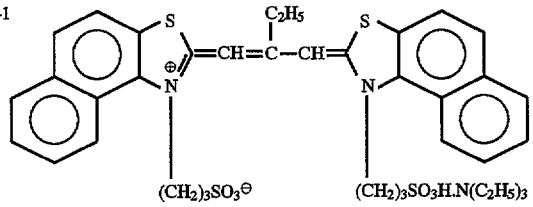
ExS-2
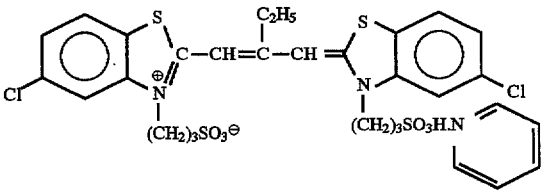
ExS-3
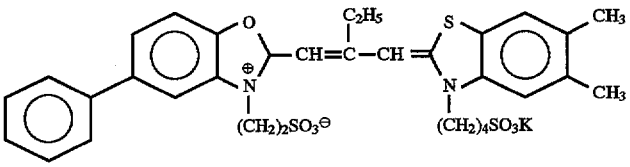
ExS-4
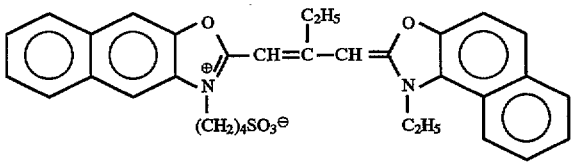
ExS-5
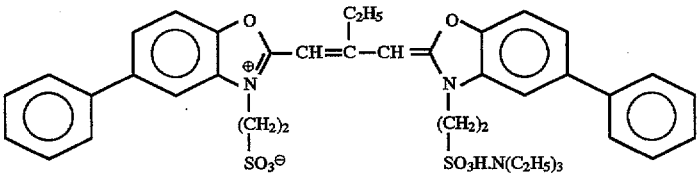
ExS-6
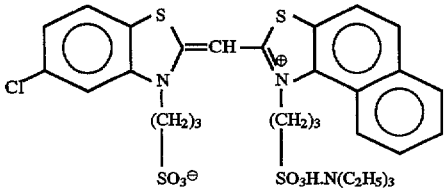
ExS-7
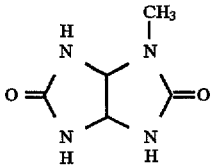
S-1
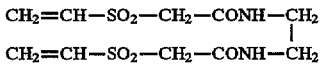
H-1
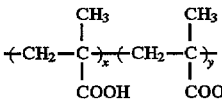
x/y = 10/90 (mol %)
B-1

-continued
B-2
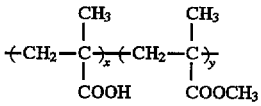
x/y = 40/60 (mol %)
B-3
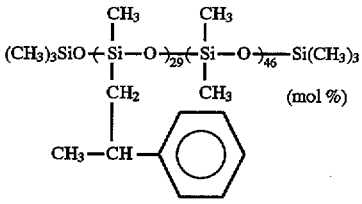
(mol %)
B-4
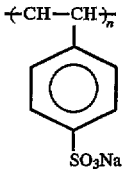
(n = an integer of ca 1,000)
B-5
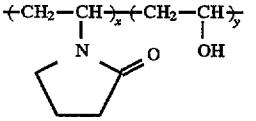
x/y = 70/30 (mol %)
B-6
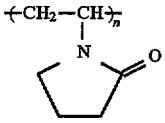
(mol. wt. about 10,000)
(n = an integer)
W-1
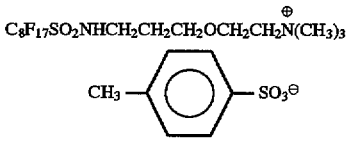
W-2
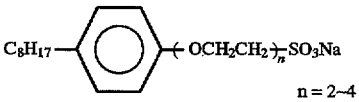
n = 2~4
W-3
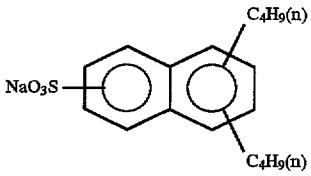
F-1
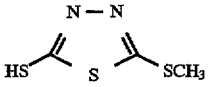
F-2
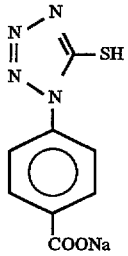
F-3
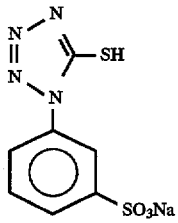
F-4
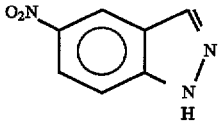
F-5
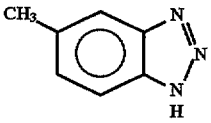
F-6
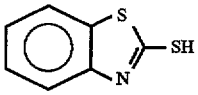
F-7
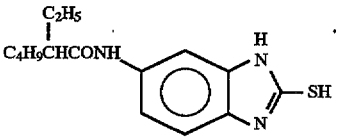
F-8
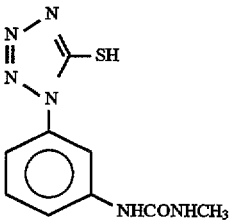

-continued

F-9

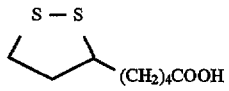

F-10

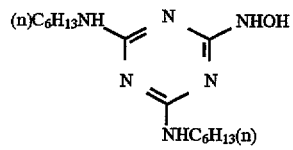

F-11

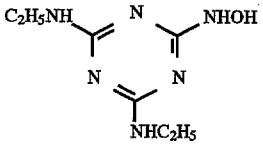

F-12

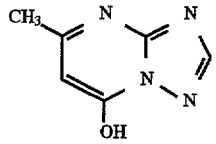

F-13

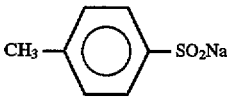

F-14

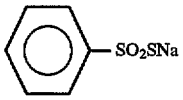

F-15

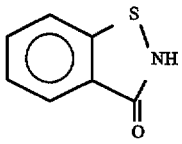

F-16

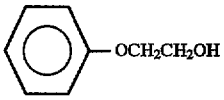

F-17

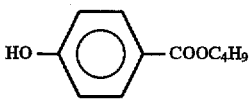

ExS-8

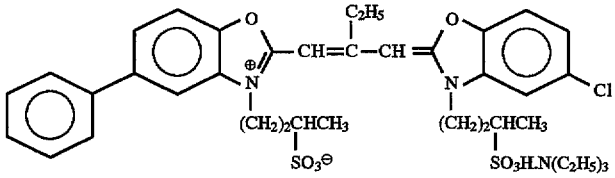

ExS-9

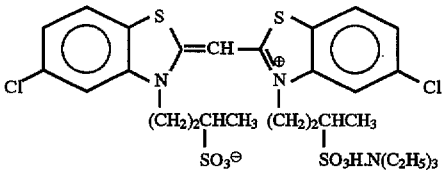

Samples 3001 to 3012 were prepared using Emulsions 101 to 112 prepared in Example 2 in the eighth layer, respectively, and each sample was exposed and processed in the same manner as in Example 2 except for changing the color development time in the processing to 3 minutes and 15 seconds.

Samples using Emulsions 105 to 112 of the present invention were high in the sensitivity and reduced in fog similarly as seen in Example 2.

The same samples were stored at 50° C. and 80% RH (relative humidity) for 2 months and then subjected to the same exposure and processing, and the change in the fog density was measured on each sample. The results obtained are shown in Table 7.

TABLE 7

| Sample | Emulsion used in 8th Layer | Change in Magenta Density 50° C., 80% RH | Remarks |
|---|---|---|---|
| 3001 | Emulsion 101 | 0.45 | Comparison |
| 3002 | 102 | 0.65 | " |
| 3003 | 103 | 0.65 | " |
| 3004 | 104 | 0.65 | " |

TABLE 7-continued

| Sample | Emulsion used in 8th Layer | Change in Magenta Density 50° C., 80% RH | Remarks |
|---|---|---|---|
| 3005 | 105 | 0.12 | Invention |
| 3006 | 106 | 0.12 | " |
| 3007 | 107 | 0.12 | " |
| 3008 | 108 | 0.06 | " |
| 3009 | 109 | 0.12 | " |
| 3010 | 110 | 0.11 | " |
| 3011 | 111 | 0.10 | " |
| 3012 | 112 | 0.05 | " |

It is clearly seen from the results in Table 7 that Samples 3005 to 3012 using Emulsions 105 to 112 of the present invention showed not only high sensitivity and low fog but also very reduced change in the fog density under high temperature and high humidity.

EXAMPLE 4

6.5 g of potassium bromide, 1.2 g of potassium iodide and 4.9 g of potassium thiocyanate were added to 1 l of a 2% aqueous gelatin solution and thereto while stirring the solution at 70° C., 0.4 l of an aqueous solution containing 57.5 g of potassium bromide and 2.5 g of potassium iodide and 0.4 l of an aqueous solution containing 85 g of silver nitrate were added at a constant flow rate by a double jet method over 45 minutes.

Then, a copolymer of isobutene and monosodium maleate was added to adjust the pH to 3.8, the solution was washed by sedimentation and thereto gelatin, water and phenol were added to adjust the pH and the pAg to 6.8 and 8.7, respectively. The thus-obtained silver halide grain had an average diameter of 1.64 μm and an average thickness of 0.47 μm (average diameter/thickness=3.49). After adding sodium thiosulfate pentahydrate and potassium tetraaurate, the emulsion was ripened at 60° C.

To the thus-prepared silver halide emulsion, a compound according to the present invention was added and then mixed and stirred at 40° C.

Further, 15 g of a 10% gel of deionized gelatin and 55 ml of water were added to the emulsion and the resulting solution was coated on a polyethylene terephthalate film base as follows.

The amount of the coating solution was set so as to give a silver amount of 2.5 g/m$^2$ and a gelatin amount of 3.8 g/m$^2$ and an aqueous solution containing as main components 0.22 g/l of sodium dodecylbenzene sulfonate, 0.50 g/l of sodium p-sulfostyrene homopolymer, 3.1 g/l of sodium 2,4-dichloro-6-hydroxy-1,3,5-triazine and 50 g/l of gelatin was simultaneously coated as an upper layer to give a gelatin amount of 1.0 g/m$^2$.

Each sample was exposed to tungsten light (2856° K) for 1 second through a continuous wedge using a blue filter (a band pass filter transmitting light of from 395 to 440 nm) and a yellow filter (a filter transmitting light having a wavelength longer than 500 nm).

After the exposure, each sample was developed with a developer having the following composition at 20° C. for 10 minutes. The developed film was measured on the density using a densitometer manufactured by Fuji Photo Film Co., Ltd. and a yellow filter sensitivity (SY), a blue filter sensitivity (SB) and fog were determined. The standard point of optical density in determining the sensitivity was [fog+0.2]. The SB was shown by a relative sensitivity to the sensitivity taken as 100, of a sample to which a sensitizing dye and a metallocene compound were not added. The SY was shown by a relative value between samples having added thereto the same sensitizing dye, while taking the sensitivity of a sample to which a metallocene compound was not added as 100.

| Composition of Developer: | |
|---|---|
| Metol | 2.5 g |
| α-Ascorbic acid | 10.0 g |
| Potassium bromide | 1.0 g |
| Nabox | 35.0 g |
| Water to make | 1.0 liter (pH 9.8) |

The results obtained as a relative value are shown in Tables 8 and 9.

Comparative Compound

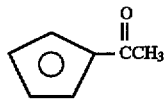

(AA-1)

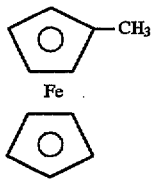

(AA-2)

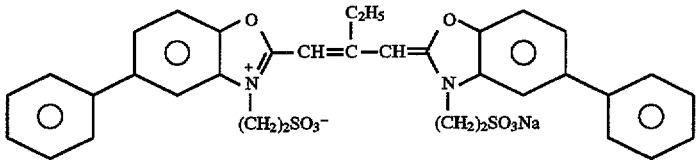

(CC-1)

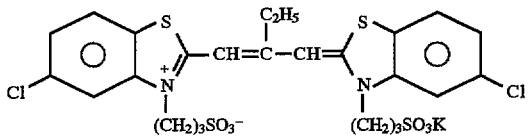

(CC-2)

-continued
(CC-3)
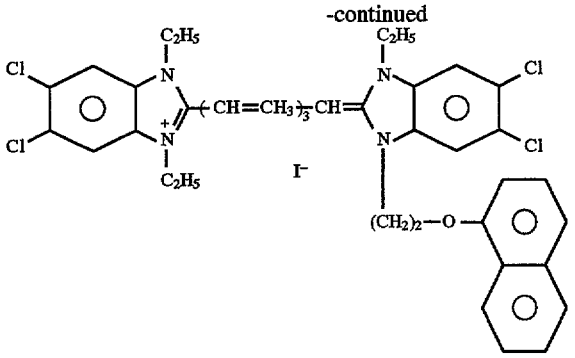
(CC-4)
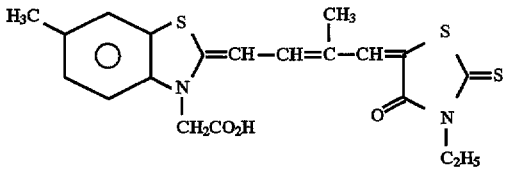
(CC-5)
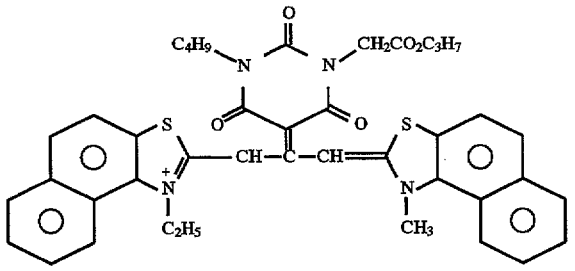
(CC-6)
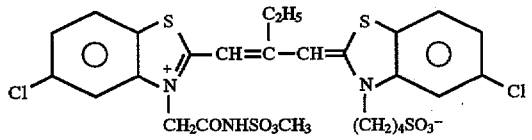
(CC-7)
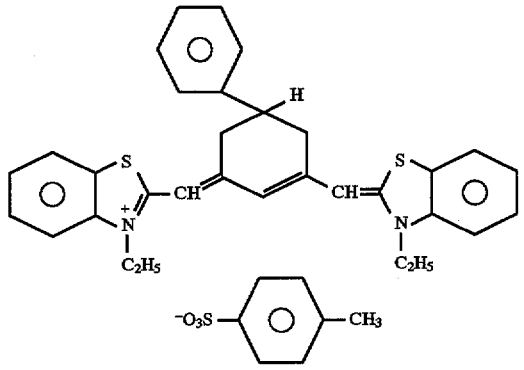
(CC-8)
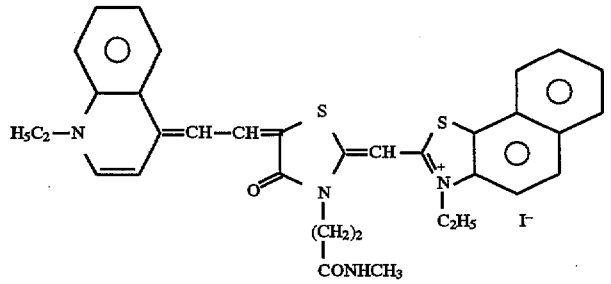

TABLE 8

| Test No. | Sensitizing Dye and Addition Amount ($10^{-4}$ mol/mol-Ag) | | Metallocene Compound or Comparative Compound and Addition Amount ($10^{-4}$ mol/mol-Ag) | | Relative Sensitivity SB | Relative Sensitivity SY | Fog | Remarks |
|---|---|---|---|---|---|---|---|---|
| 2-1 | — | | — | | 100 (standard) | — | 0.06 | Comparison |
| 2-2 | (CC-1) | 12.0 | — | | 80 | 100 (standard) | 0.08 | " |
| 2-3 | " | " | (AA-2) | 1.0 | 83 | 103 | 0.08 | " |
| 2-4 | " | 11.5 | (IA-2) | 0.5 | 98 | 285 | 0.06 | Invention |
| 2-5 | (CC-2) | 15.0 | — | | 35 | 100 (standard) | 0.09 | Comparison |
| 2-6 | " | " | (AA-1) | 1.0 | 40 | 105 | 0.09 | " |
| 2-7 | " | 14.0 | (IA-10) | 1.0 | 85 | 312 | 0.07 | Invention |
| 2-8 | " | " | (IA-11) | 1.0 | 87 | 315 | 0.07 | " |
| 2-9 | (CC-3) | 5.0 | — | | 30 | 100 (standard) | 0.12 | Comparison |
| 2-10 | " | " | (AA-2) | 0.5 | 33 | 104 | 0.12 | " |
| 2-11 | " | 4.5 | (IA-13) | 0.5 | 85 | 255 | 0.08 | Invention |

TABLE 9

| Test No. | Sensitizing Dye and Addition Amount ($10^{-4}$ mol/mol-Ag) | | Metallocene Compound or Comparative Compound and Addition Amount ($10^{-4}$ mol/mol-Ag) | | Relative Sensitivity SB | Relative Sensitivity SY | Fog | Remarks |
|---|---|---|---|---|---|---|---|---|
| 2-12 | (CC-4) | 8.0 | — | | 62 | 100 (standard) | 0.10 | Comparison |
| 2-13 | " | " | (AA-1) | 1.0 | 65 | 105 | 0.10 | " |
| 2-14 | " | 7.0 | (IA-19) | 1.0 | 91 | 315 | 0.06 | Invention |
| 2-15 | (CC-6) | 13.0 | — | | 45 | 100 (standard) | 0.10 | Comparison |
| 2-16 | " | " | (AA-1) | 1.0 | 48 | 102 | 0.10 | " |
| 2-17 | " | " | (AA-2) | " | 47 | 103 | 0.10 | " |
| 2-18 | " | " | (CC-5) | " | 48 | 103 | 0.10 | " |
| 2-19 | " | " | (IA-26) | " | 85 | 283 | 0.07 | Invention |
| 2-20 | " | " | (IA-27) | " | 85 | 287 | " | " |
| 2-21 | (CC-7) | 5.0 | — | | 63 | 100 (standard) | 0.09 | Comparison |
| 2-22 | " | " | (AA-2) | 1.0 | 65 | 104 | 0.09 | " |
| 2-23 | " | 4.0 | (IA-12) | " | 85 | 195 | 0.07 | Invention |
| 2-24 | (CC-8) | 12.0 | — | | 63 | 100 (standard) | 0.09 | Comparison |
| 2-25 | " | " | (AA-2) | 1.0 | 68 | 103 | " | " |
| 2-26 | " | 11.0 | (IA-25) | 1.0 | 91 | 220 | 0.07 | Invention |

As is clearly seen from the results in Tables 8 and 9, by using the metallocene compound of the present invention, the dye desensitization (SB) was improved and the spectral sensitivity (SY) was remarkably increased. Also, fog was reduced.

The effect on improvements are outstandingly large as compared with the results of conventionally known comparative compounds.

EXAMPLE 5

(1) Preparation of Emulsion

Emulsions Em-1 to Em-3 were prepared in the same manner as in Example 2.

Emulsion Em-4' was prepared thoroughly in the same manner as Emulsion Em-2 except that in the grain formation of Emulsion Em-2, Compound (XX-2) was added 10 minutes after the initiation of final shell formation, in an amount of $1.2\times10^{-4}$ mol per mol of silver.

To each of the thus-prepared Emulsions Em-1, Em-2, Em-3 and Em-4', $5\times10^{-4}$ mol/mol-Ag of Sensitizing Dye A, $2\times10^{-5}$ mol/mol-Ag of Sensitizing Dye B and $2\times10^{-4}$ mol/mol-Ag of Sensitizing Dye C shown in Table 3 of Example 2 were added and then each sample was subjected to optimal gold-selenium-sulfur sensitization by adding thereto sodium thiosulfate, chloroauric acid, N,N-dimethylselenourea and potassium thiocyanate. Thus, Emulsions 201 to 204 were prepared.

Further, Emulsions 205 to 208 were prepared in the same manner as for Emulsions 201 to 204 except that $0.5\times10^{-4}$ mol/mol-Ag of Compound (IA-5) of the present invention was added to each of Emulsions Em-1, Em-2, Em-3 and Em-4' and the addition amount of Sensitizing Dye C was reduced to $5.5\times10^{-4}$ mol/mol-Ag.

An emulsion layer and a protective layer were coated on a triacetyl cellulose support having an undercoat layer in an amount as shown in Table 10 to prepare Samples 2001 to 2008 using emulsions 201 to 208, respectively.

TABLE 10

| Emulsion Coating Conditions | |
|---|---|
| (1) Emulsion Layer | |
| Emulsion (Emulsions 201 to 208) | as silver $2.1 \times 10^{-2}$ mol/m$^2$ |
| Coupler | $1.5 \times 10^{-3}$ mol/m$^2$ |
| 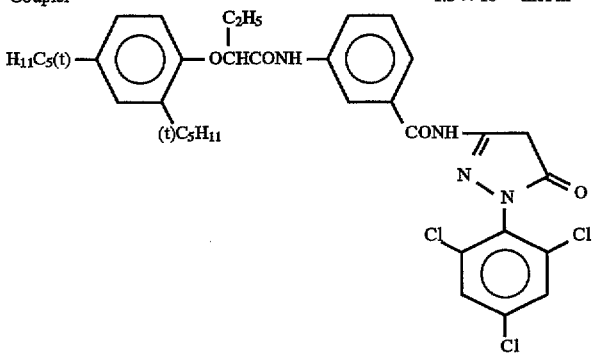 | |
| Tricresyl phosphate | 1.10 g/m$^2$ |
| Gelatin | 2.30 g/m$^2$ |
| (2) Protective Layer | |
| 2,4-Dichlorotriazine-6-hydroxy-s-triazine sodium salt | 0.08 g/m$^2$ |
| Gelatin | 1.80 g/m$^2$ |

Each of these samples was subjected to exposure and then to development processing in the same manner as in Example 2.

Each of the processed samples was determined on the density using a green filter.

Evaluation was made on the resulting sensitivity and fog in the same manner as in Example 2. The results obtained are shown in Table 11.

TABLE 11

| Sample | Emulsion | Reduction Sensitizer | Thiosulfonic Acid | Fresh Fog | Fresh Sensitivity | Aged Fog | Aged Sensitivity | Remarks |
|---|---|---|---|---|---|---|---|---|
| 2001 | 201 | none | none | 0.23 | 100 | 0.40 | 95 | Comparison |
| 2002 | 202 | thiourea dioxide | " | 0.46 | 108 | 0.86 | 104 | " |
| 2003 | 203 | L-ascorbic acid | " | 0.42 | 117 | 0.85 | 110 | " |
| 2004 | 204 | thiourea dioxide | (XX-2) | 0.40 | 123 | 0.80 | 115 | " |
| 2005 | 205 | none | none | 0.15 | 144 | 0.17 | 141 | Invention |
| 2006 | 206 | thiourea dioxide | " | 0.15 | 175 | 0.17 | 172 | " |
| 2007 | 207 | L-ascorbic acid | " | 0.15 | 173 | 0.17 | 170 | " |
| 2008 | 208 | thiourea dioxide | (XX-2) | 0.12 | 193 | 0.12 | 192 | " |

As is clearly seen from Table 11, Samples 2005 to 2008 of the present invention each was high in the sensitivity and reduced in the fog and also showed high storage stability as compared with comparative samples. These effects were remarkable in samples subjected to reduction sensitization.

Samples 2008 using a thiosulfonic acid were particularly outstanding in view of these effects.

EXAMPLE 6

Samples 4001 to 4008 were prepared using Emulsions 201 to 208 prepared in Example 5 in the eighth layer of a multi-layer color light-sensitive material (Sample 101) of Example 3 and each sample was exposed and processed in the same manner as in Example 4 except for changing the color development time in the processing to 3 minutes and 15 seconds.

Samples using Emulsions 205 to 208 of the present invention were high in the sensitivity and reduced in fog similarly as seen in Example 5.

The same samples were stored at 50° C. and 80% RH (relative humidity) for 2 months and then subjected to the same exposure and processing, and the change in the fog density was measured on each sample. The results obtained are shown in Table 12.

TABLE 12

| Sample | Emulsion used in 8th Layer | Change in Magenta Density 50° C., 80% RH | Remarks |
|---|---|---|---|
| 4001 | Emulsion 201 | 0.45 | Comparison |
| 4002 | 202 | 0.65 | " |

TABLE 12-continued

| Sample | Emulsion used in 8th Layer | Change in Magenta Density 50° C., 80% RH | Remarks |
|---|---|---|---|
| 4003 | 203 | 0.65 | " |
| 4004 | 204 | 0.65 | " |
| 4005 | 205 | 0.13 | Invention |
| 4006 | 206 | 0.12 | " |
| 4007 | 207 | 0.11 | " |
| 4008 | 208 | 0.06 | " |

It is clearly seen from the results in Table 12 that Samples 4005 to 4008 using Emulsions 205 to 208 of the present invention showed not only high sensitivity and low fog but also very reduced change in the fog density under high temperature and high humidity.

The compounds of the present invention described in Synthesis Examples are excellent as verified in Examples 1 to 6 so that a silver halide photographic material having high sensitivity, reduced in fog and excellent in the storage stability can be obtained. These effects are particularly remarkable on the emulsion subjected to reduction sensitization.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, said silver halide photographic material containing at least one metallocene compound having a methine dye residue through a covalent bond.

2. The silver halide photographic material as claimed in claim 1, wherein said metallocene compound is represented by formula (IA):

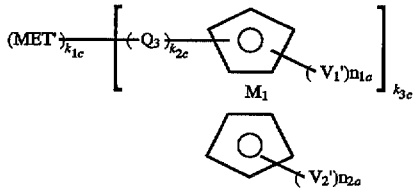

(IA)

wherein MET' represents a methine dye residue;

$Q_3$ represents a linking group comprising an atom or atomic group containing at least one of carbon atom, nitrogen atom, sulfur atom and oxygen atom;

$M_1$ represents Fe, Ti, V, Cr, Co, Ni, Ru, Os or Pd;

$V_1'$ and $V_2'$ each represents a monovalent substituent;

$n_{1a}$ represents 0 or an integer of from 1 to 4;

$n_{2a}$ represents 0 or an integer of from 1 to 5;

$k_{1c}$ represents an integer of from 1 to 4;

$k_{3c}$ represents an integer of from 1 to 4; and $k_{2c}$ represents 0 or 1.

3. The silver halide photographic material as claimed in claim 1, wherein said at least one silver halide emulsion layer contains the metallocene compound and silver halide grains in said at least one silver halide emulsion layer are subjected to reduction sensitization.

4. The silver halide photographic material as claimed in claim 3, wherein the metallocene compound is represented by formula (IA):

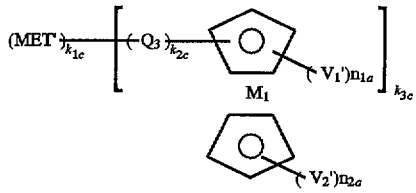

(IA)

wherein MET' represents a methine dye residue;

$Q_3$ represents a linking group comprising an atom or atomic group containing at least one of carbon atom, nitrogen atom, sulfur atom and oxygen atom;

$M_1$ represents Fe, Ti, V, Cr, Co, Ni, Ru, Os or Pd;

$V_1'$ and $V_2'$ each represents a monovalent substituent;

$n_{1a}$ represents 0 or an integer of from 1 to 4;

$n_{2a}$ represents 0 or an integer of from 1 to 5;

$k_{1c}$ represents an integer of from 1 to 4;

$k_{3c}$ represents an integer of from 1 to 4; and $k_{2c}$ represents 0 or 1.

5. The silver halide photographic material as claimed in claim 1, wherein said silver halide emulsion layer further contains at least one compound represented by formula (XX), (XXI) or (XXII):

$$R_{101}—SO_2S—M_{101} \quad (XX)$$

$$R_{101}—SO_2S—R_{102} \quad (XXI)$$

$$R_{101}—SO_2S—(E)_a—SSO_2—R_{103} \quad (XXII)$$

wherein $R_{101}$, $R_{102}$ and $R_{103}$ each represents an aliphatic group, an aromatic group or a heterocyclic group, $M_{101}$ represents a cation, E represents a divalent linking group and a represents 0 to 1.

6. The silver halide photographic material as claimed in claim 2, wherein said silver halide emulsion layer further contains at least one compound represented by formula (XX), (XXI) or (XXII):

$$R_{101}—SO_2S—M_{101} \quad (XX)$$

$$R_{101}—SO_2S—R_{102} \quad (XXI)$$

$$R_{101}—SO_2S—(E)_a—SSO_2—R_{103} \quad (XXII)$$

wherein $R_{101}$, $R_{102}$ and $R_{103}$ each represents an aliphatic group, an aromatic group or a heterocyclic group, $M_{101}$ represents a cation, E represents a divalent linking group and a represents 0 or 1.

7. The silver halide photographic material as claimed in claim 3, wherein said silver halide emulsion layer further contains at least one compound represented by formula (XX), (XXI) or (XXII):

$$R_{101}—SO_2S—M_{101} \quad (XX)$$

$$R_{101}—SO_2S—R_{102} \quad (XXI)$$

$$R_{101}—SO_2S—(E)_a—SSO_2—R_{103} \quad (XXII)$$

wherein $R_{101}$, $R_{102}$ and $R_{103}$ each represents an aliphatic group, an aromatic group or a heterocyclic group, $M_{101}$ represents a cation, E represents a divalent linking group and a represents 0 or 1.

8. The silver halide photographic material as claimed in claim 4, wherein said silver halide emulsion layer further contains at least one compound represented by formula (XX), (XXI) or (XXII):

$$R_{101}—SO_2S—M_{101} \quad (XX)$$

$$R_{101}—SO_2S—R_{102} \quad (XXI)$$

$$R_{101}—SO_2S—(E)_a—SSO_2—R_{103} \quad (XXII)$$

wherein $R_{101}$, $R_{102}$ and $R_{103}$ each represents an aliphatic group, an aromatic group or a heterocyclic group, $M_{101}$ represents a cation, E represents a divalent linking group and a represents 0 or 1.

* * * * *